United States Patent [19]

Yamada et al.

[11] Patent Number: 4,968,595

[45] Date of Patent: Nov. 6, 1990

[54] SILVER HALIDE PHOTOGRAPHIC EMULSIONS

[75] Inventors: Sumito Yamada; Tadashi Ito; Hiroyuki Mifune; Keisuke Shiba; Toshihiro Nishikawa; Hideo Ikeda, all of Kanagawa, Japan

[73] Assignee: Fuji Photo Film Co., Ltd., Kanagawa, Japan

[21] Appl. No.: 202,852

[22] Filed: Jun. 6, 1988

[30] Foreign Application Priority Data

Jun. 5, 1987 [JP] Japan ..... 62-141112
Jun. 18, 1987 [JP] Japan ..... 62-152330

[51] Int. Cl.[5] ..... G03C 1/07
[52] U.S. Cl. ..... 430/567; 430/569
[58] Field of Search ..... 430/567, 569

[56] References Cited

U.S. PATENT DOCUMENTS 4,379,837 4/1983 Lapp et al. ..... 430/434
4,463,087 7/1984 Maskasky ..... 430/567
4,469,784 9/1984 Heki et al. ..... 430/567
4,684,607 8/1987 Maskasky ..... 430/567
4,764,457 8/1988 Hoffa et al. ..... 430/569
4,820,624 4/1989 Hasebe et al. ..... 430/567
4,828,972 5/1989 Ihama et al. ..... 430/569

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A silver halide photographic emulsion containing silver halide grains having (III) faces, at least 50% (by projected area) of which are (a) silver halide grains controlled so that the development thereof is initiated at the corners or in the vicinity of the corners of the grains, and/or (b) silver halide grains controlled so that the development thereof is initiated at the edges or in the vicinity of the edges of the grains.

21 Claims, 9 Drawing Sheets

SILVER HALIDE PHOTOGRAPHIC EMULSIONS

FIELD OF THE INVENTION

This invention relates to a high-speed silver halide photographic emulsion being excellent in graininess as well as the shelf life thereof and the stability of latent images formed, having less dependence on a light exposure time, proceeding the development thereof in parallel proceeding type, showing less fluctuation in gradation, and capable of being quickly processed. In particular, the invention relates to a photographic light-sensitive material excellent in stability at the production thereof and the uniformity of the finished image quality.

BACKGROUND OF THE INVENTION

With the increased propagation of silver halide photographic materials, it has been required to obtain photographs of high image quality with uniform finished quality quickly, easily and at high photographing successfulness.

In general, it is known that for a high-speed photographic light-sensitive materials for photographing, a silver iodobromide photographic emulsion having a mean silver iodide content of from about 4 to 20 mole %. A silver iodobromide emulsion having, in particular, high silver iodide content is advantageous for obtaining high speed and images of high quality but, on the other hand, has difficulty in quickening of development processing and also specific techniques are required for obtaining the stability of latent images and excellent reciprocity law failure characteristics.

In general, a silver chloride, silver chlorobromide or silver iodochlorobromide emulsion having a high mean silver chloride content (e.g., 30 mole % to 100 mole %) being used for black-and-white photographic papers and color print photographic papers is advantageous for quickening photographic processing but has difficulties not only in high sensitivity, images of high quality, the progression of the gradation of development, and the inhibition of fog but also in the shelf life thereof, the stability of latent images formed, and the reciprocity law failure characteristics. Also, a silver halide photographic emulsion having a low mean silver iodide content of, for example, 0 to 4 mole % is advantageous for quick stabilization of desilvering in the case of using, in particular, for color photographic light-sensitive materials but has a difficulty in obtaining images of high quality.

It is known that the various characteristics of a silver halide photographic emulsion containing silver halide grains having (100) faces are totally improved by converting the emulsion into a corner development type silver halide (CDG) photographic emulsion using a CR-compound (i.e., a halogen conversion inhibitor or a chemical sensitization reaction inhibitor), preferably during or before the chemical sensitization step as described, for example, in Japanese Patent Application No. 311131/86.

A silver halide photographic emulsion containing silver halide grains having (111) faces is easily obtained in, mainly, a silver iodobromide emulsion and has various disadvantages as described above. Aforesaid Japanese Patent Application No. 311131/86 does not mention the solving method of the disadvantages of the photographic emulsions. A method of improving each disadvantage is proposed on normal crystal silver halide grains having the (111) faces, such as octahedral grains, tetradecahedral grains, tabular grains, tabular twin crystal grains, etc. However, a method of totally improving the properties of the silver halide photographic emulsions have not yet been proposed by the reasons of being influenced by other various factors outside object.

For example, such improvements are described in Japanese Patent Application (OPI) Nos. 147727/85, 99751/87, 162540/84, 147728/85, 153428/77, 155827/79, 95337/83, 113926/83, 133540/84, 82835/82, 108526/83, 48756/84, 210345/86, 26589/80, 196749/85, and 205929/86 (the term "OPI" as used herein means an "unexamined published patent application"), U.S. Pat. Nos. 4,434,226, 4,414,310, 4,433,048, 3,966,476, 4,414,306, 4,490,458, 4,413,053, and 4,183,756, and British Patent No. 2,038,792.

In particular, Japanese Patent Application (OPI) No. 108526/83 shows in Examples 6 and 7 thereof that according to an arrested development study, epitaxial silver halide grains, that is, silver halide grains formed by epitaxially joining silver bromide grains or silver chloride grains to the corner portions of tabular silver iodobromide grains having an aspect ratio of at least 8 as a host silver halide cause a development at the corner portions. However, neither the objects nor effects of the present invention are suggested therein.

Silver halide photographic emulsions containing silver halide grains having (111) planes and having, for example, a mean silver iodide content of from 0 to 4 mole % and a mean silver chloride content of at least 30 mole %, preferably at least 50 mole % are described in Japanese Patent Application Nos. 144228/86, 144229/86 and 47225/87. The photographic emulsions of such halogen compositions have a tendency of showing the aforesaid disadvantages as compared to ordinary silver iodobromide emulsions.

For photographic light-sensitive materials of a multilayer structure, in particular, multilayer color photographic materials, a stability is required not only on the sensitivity and gradation but also the exposure temperature, exposure time, latent images, development progress, etc., over all the layers and the stability gives crucial influences on the finished image quality of the photographic materials.

Furthermore, a developer for obtaining a sufficient sensitivity in a short period of time, a light-sensitive material excellent in developability and giving sufficient blackened density in a short period of time, and characteristics of drying in a short period of time after washing are required.

For improving the drying property of light-sensitive materials, there is generally a method of reducing the water content in the light-sensitive materials before initiating drying by previously incorporating a sufficient amount of a hardening agent (gelatin crosslinking agent) to the light-sensitive materials at coating step therefor to reduce the swelling amount of the emulsion layers and the surface protective layer(s) thereof at the steps of development, fixing and washing. According to the method, by using a large amount of a hardening agent, the drying time can be shortened the shorter but the reduction of the swelling amount of the photographic layers is accompanied by delaying of development, the reduction of sensitivity, softening of tone, and the reduction of covering power.

Moreover, in high-temperature quick processing by a developer and a fix solution having substantially no gelatin hardening action as described, for example, in Japanese Patent Application No. 292018/86, it is inevitable to sufficiently harden light-sensitive materials and in the case of using silver halide emulsions showing slow development progressing property, quick processing in a short period of time can not be realized.

On the other hand, a method of increasing the development activity of a developer is known and the amount of a developing agent and an auxiliary developing agent in the developer, the pH of the developer, and the temperature for processing can be increased.

However, these methods have such disadvantages that the preservability of the developer is reduced, the tone is softened although the sensitivity may be increased, and the light-sensitive materials are liable to be fogged.

On the other hand, apart from the view point of quick processing, the further increase of the sensitivity of light-sensitive materials and the improvement of graininess are a theme to be continuously persued.

If the sensitivity of a light-sensitive material is increased by increasing the grain size of silver halide grains of silver halide photographic emulsions for light-sensitive materials, the graininess is reduced.

Thus, it is necessary to obtain a high sensitivity with same grain sizes (in the case of tabular grains, the grain size is same as the diameter of the projected area thereof) or improve the graininess with a same sensitivity.

An object of this invention is to provide a silver halide photographic emulsion showing a very excellent development progressing property, sensitivity to fog ratio, and graininess and giving a high covering power in a tabular grain silver halide emulsion of a same diameter of projected area and same thickness.

For improving the view point as described above, techniques of utilizing tabular grain silver halide emulsions are described in U.S. Pat. Nos. 4,439,520, 4,425,425, 4,414,304, etc., but the object of the present invention relates to obtain the maximum performance of such tabular silver halide grains and provides far excellent performance thereof over those described in the aforesaid patents.

Also, Japanese Patent Application (OPI) No. 108526/83 discloses a technique of controlling the development initiating point by forming silver halide crystal (epitaxial growth) at a specific portion (for example, the top or center) of a tabular silver halide grain but such a technique is undesirable since the silver halide emulsion containing the silver halide grains reduces the stability thereof with the passage of time during when the emulsion is dissolved in water or is stored.

Furthermore, it is known as described in U.S. Pat. Nos. 3,628,969 and 4,225,666 that a spectral sensitization of a silver halide emulsion is performed simultaneously with a chemical sensitization by adding thereto a sensitizing dye and a chemical sensitizer at a same time and also it is known a described in Japanese Patent Application No. 113928/83 that a spectral sensitization of a silver halide emulsion can be performed prior to a chemical sensitization thereof and that a spectral sensitization of a silver halide emulsion can be initiated by adding thereto a sensitizing dye before finishing the precipitation of silver halide grains. Furthermore, it is known as disclosed in U.S. Pat. No. 4,225,666 that these sensitizing dyes are dividedly added to a silver halide emulsion, that is, a part of these compounds are added to an emulsion prior to the chemical sensitization thereof and the residue is added thereto after the chemical sensitization and also it is known as described in U.S. Pat. No. 4,183,756, etc., that the addition of the sensitizing dyes may be at any period during the formation of the silver halide grains.

However, these known techniques described above are yet insufficient.

SUMMARY OF THE INVENTION

The object of this invention is, therefore, to provide a silver halide photographic emulsion containing substantially normal crystal or tabular silver halide grains having the following totally improved characteristics:

(1) high sensitivity with less fog;
(2) less reciprocal law failure characteristics;
(3) high stability of latent images with less dependence on temperature, time, and humidity;
(4) fast development progressing property, quickness of development, and high stability of gradation; and
(5) high covering power and excellent graininess.

As the result of intensive investigations, the inventors have discovered that the aforesaid object of this invention can be attained by using a silver halide photographic emulsion containing silver halide crystals having (111) faces, wherein the photographic emulsion contains a silver halide grain group having development initiating sites thereof controlled to the specific sites as the characteristics of the group of silver halides obtained by coating the emulsion on a support to form a light-sensitive emulsion layer, applying thereto a definite light exposure, and developing the emulsion layer using a developer having a composition same as that of a developer practically used.

That is, the object of this invention has been attained by a silver halide photographic emulsion containing silver halide grains dispersed in a dispersion medium and a photographic light-sensitive material using the silver halide photographic emulsion, wherein said silver halide grains have (111) faces and at least 50% (by projected area) of the silver halide grains having the (111) faces are (a) corner development type grains (CDG), i.e., silver halide grains controlled so that the development thereof is initiated at the corners or in the vicinity of the corners of the grains, and/or (b) edge development type grains (EDG), i.e., silver halide grains controlled so that the development thereof is initiated at the edges or in the vicinity of the edges of the grains.

DETAILED DESCRIPTION OF THE INVENTION

Figure 1:
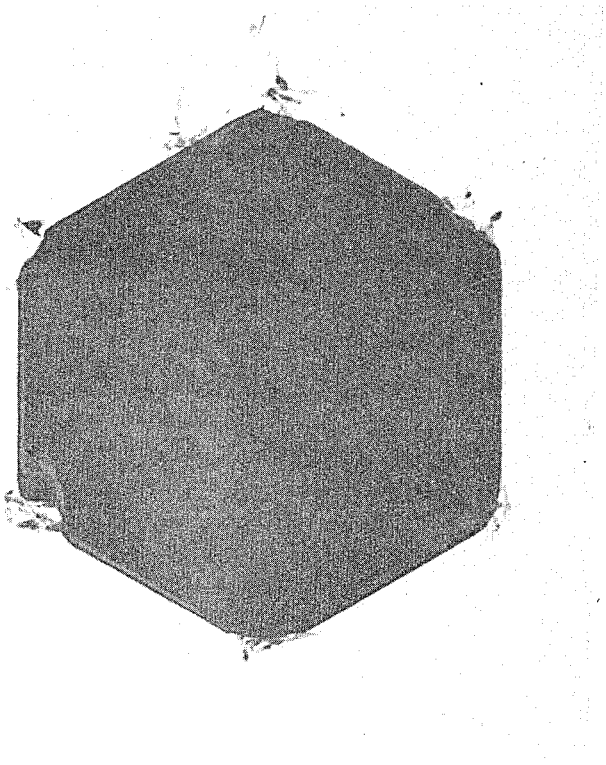
FIGS. 1 to 3 are electron microphotographs of the crystal structures of silver halide grains in the silver halide emulsions used for Samples 1, 4, and 5, respectively, in Example 1. The Photographing magnification is 60,000 magnifications.

The corner development type grains (CDG) in this invention are silver halide grains which are controlled so that when the emulsion containing the silver halide grains is coated on a support and the light-sensitive material thus obtained is developed, the development is initiated from the corners and/or the vicinity of the corners of the grains.

Also, the edge development type grains (EDG) in this invention are silver halide grains which are controlled so that when the emulsion containing the silver halide grains is coated on a support and the light-sensitive material thus obtained is developed, the development is initiated from the edge and/or the vicinity of the edges of the grains.

In this case, the term "silver halide grains are controlled so that the development thereof is initiated from the corners or the vicinity thereof, or from the edges or the vicinity thereof" means that more than 70%, and particularly preferably more than 90% of the development initiation point of the silver halide grain exist at the corners or the vicinity thereof and/or at the edges or the vicinity thereof of the grain.

For specifying the sites of the development initiation points of silver halide grains, the following method is used. That is, a silver halide emulsion is exposed in the range of from an exposure amount corresponding to (maximum density − minimum density)$\times\frac{3}{4}$ of a silver image in the characteristic curve of the emulsion formed by processing a light-sensitive material obtained by coating the photographic emulsion on a support with a developer under a standard development condition to an exposure amount of 100 times larger than the aforesaid exposure amount and when in the case of developing the light-sensitive material by a developer having substantially same composition as the aforesaid developer, the development of the emulsion layer begins to initiate, the development is stopped using an aqueous solution of 5% glacial acetic acid. Thereafter, by observing the silver halide grains in the emulsion by an electron microphotograph, the development initiating sites can be specified.

The term "corners or the vicinity of the corners, or edges or the vicinity of the edges" of silver halide crystals means the corners or edges of normal crystals such as octahedral crystals, tetradecahedral crystals, tetracosahedral crystals, etc., twins thereof, tabular multiple twins, etc., or the vicinity of the corners or the edges, and in the case of crystals having rounding or jointed crystals, the term means the sites substantially crystallographically decided as the corners or the edges thereof and the vicinity thereof.

Also, the term "the vicinity of the corners" means the insides of semi-circles (circular arcs) formed using the length of about $\frac{1}{3}$, preferably about $\frac{1}{4}$ of the diameter of a circle corresponding to the projected area of the grains as the radius with the corner as the center. Also, the term "the vicinity of the edges" means the insides of rectangles formed by the edge and lines apart therefrom by the length of about $\frac{1}{3}$, preferably about $\frac{1}{4}$ of the diameter of the aforesaid circle. When the aforesaid radius or the distance between the edge and the line is about 1/5 of the diameter of the aforesaid circle, more remarkable effects are obtained.

The silver halide grains in this invention are normal crystal silver halide grains such as octahedral grains, tetradecahedral grains, etc., and tabular silver halide grains excluding epitaxially joined grains. The external form of the silver halide grains is preferably simple. Silver halide grains having an epitaxially joined form of plural grains such as epitaxially joined silver halide grains are reluctant to easily control the chemical sensitization and to easily control the development progressing property and the developing efficiency of the silver halide and are unsuitable for the object of this invention.

It is preferred that the composition of a developer being used for observing the development initiation points of silver halide crystals is same as the composition of a developer which is practically used for developing photographic light-sensitive materials using the CDG type silver halide emulsions or EDG type silver halide emulsions.

For facilitating the observation, the developer may be diluted to, for example, about 50 times the original volume at use. The development temperature is preferably same as the temperature practically employed for developing the light-sensitive materials.

As a developer for evaluating the development initiating points, a developer having, for example, the composition shown below can be used. In other words, whether a silver halide emulsion is the CDG emulsion or the EDG emulsion can be evaluated by using the developer of the following composition.

| For Color Photographic Material | |
|---|---|
| Diethylenetriaminepentaacetic Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 3-Methyl-4-amino-N-ethyl-N-$\beta$-hydroxyethyl-aniline Sulfate | 4.5 g |
| Water to make | 1.0 liter |
| (pH controlled to 10.05) | |
| For Black-and-White Photographic Material | |
| Metol | 2.0 g |
| Sodium Sulfite | 100 g |
| Hydroquinone | 5.0 g |
| Borax $5.H_2O$ | 1.53 g |
| Water to make | 1.0 liter |
| (pH controlled to 8.60) | |

In the silver halide emulsion of this invention, the silver halide grains having the (111) faces are contained in an amount of at least 50% (by projected area), preferably at least 70% and most preferably at least 90% based on the total silver halide grains contained in the emulsion, and at least 50% (by projected area) of the grains having the (111) faces are CDG and/or EDG and preferably more than 70%, particularly preferably more than 80%, are CDG and/or EDG.

In the CDG emulsion (i.e., the emulsion composed of EDG) or the EDG emulsion (i.e., the emulsion composed of EDG), a corner development or edge development ordinary dominates, respectively, but sometimes, in these emulsions, the corner development and the edge development proceed simultaneously. The essential feature of the CDG emulsion or the EDG emulsion is that the formation (e.g., the growth, ripening or halogen conversion) and the chemical sensitization of silver halide crystals are controlled so as to selectively concentrate the development initiating points to specific sites on the surface of the silver halide grains and at the same time so as to concentrate the development initiating points of the silver halide grains contained in the emulsion in a production lot to the specific sites.

Hitherto, indicators for the growing surface of silver halide crystals have been known but the silver halide emulsions having the aforesaid development characteristics and the excellent characteristics of the emulsions have not known.

By controlling the development initiating points of normal crystal grains having (111) faces or tabular grains having (111) faces without having epitaxial junction, aforesaid disadvantages in conventional emulsions can be simultaneously improved, which can be said to be an astonishing knowledge.

The 1st factor relating to the control of the development initiating points of the CDG emulsion or EDG emulsion of this invention is a crystal habit of silver halide grains. The silver halide grains in this invention have (111) faces. As easily obtainable silver halide grains having (111) faces, there are usually substantial normal grains such as octahedral grains, tetradecahedral grains, etc., tabular grains and multiple with tabular grains, and preferably normal crystal grains and tabular grains.

The 2nd factor is the halogen composition of silver halide grains. If the halogen composition such as silver iodide, silver chloride, etc., is changed, the photographic characteristics are changed as described above and the view point for disadvantages, that is, problems being improved are changed. These problems can be improved by this invention. This is considered to be caused by that the essences of the problems perhaps relate directly or indirectly to the formation sites of development centers, the number of the sites formed, and the selective concentration of the sites.

The 3rd factor is to control sites of forming the surfaces of silver halide grains and sites of causing chemical sensitization reaction by the CR-compound (i.e., halogen conversion inhibitor or chemical sensitization reaction inhibitor) existing on the surfaces of silver halide grains during the chemical sensitization thereof to control the sites of sensitivity specks.

The 4th factor is the developer or the development condition being used for developing the silver halide emulsion of this invention. Since this is a factor defined as a development process for photographic light-sensitive materials using the silver halide emulsions of this invention, the factor is to find a silver halide emulsion giving the aforesaid features in the development condition.

Other factors will become apparent from the descriptions of the examples shown hereinafter.

Then, the silver halide photographic emulsions of this invention are explained. The silver halide photographic emulsion of this invention is a photographic emulsion containing silver halide grains having (111) faces and in this case, it is preferred that at least 30% of the total surfaces of the silver halide grain are (111) faces.

Silver halide grains having (111) faces are described, for example, in T. H. James, *The Theory of the Photographic Process,* 4th edition, pages 97 to 100, published by Macmillan Co., 1977, U.S. Pat. No. 4,434,226, Japanese Patent Application (OPI) Nos. 95337/83, 113926/83, 153428/77, 35726/85, and 108526/83.

In the substantial normal crystal silver halide grains having (111) faces in this invention, at least 30%, preferably at least 50%, and more preferably at least 75% of the total outer surfaces of the grain are composed of (111) faces. Such silver halide grains are typically octahedral grains, tetrahedral grains, etc. The term "substantial normal crystal grains" means grains showing, in appearance, corners and edges and these grains may microscopically have twinned surfaces, dislocated surfaces, and joined surfaces.

The silver halide grains in this invention may have a uniform crystal structure throughout the whole grain or a multilayer structure wherein the composition of the inside of the silver halide grain differs from the composition of the surface portion thereof. It is preferred that the core of the silver halide grain has a higher silver iodide content, that is, the core contains 20 mole % to 40 mole % silver iodide and the shell contains lower silver iodide lower than the core. It is also preferred that the silver halide grains have a thin layer of a high silver iodide content as the outermost layer of the shell having a low silver iodide content. Also, the core of silver halide grains may have a silver iodide content of 4 mole % or lower, a layer having a lower silver iodide content than the core is formed as the outer shell layer, and a thin layer of silver iodide may be formed as the outermost shell layer.

It is preferred that at the formation of these silver halide grains, the formation of the surfaces of the grains is controlled in the existence of the CR-compound by a method of performing the ripening, the growth, or the conversion of the silver halide grains in the existence of a material having a property of silver halide solvent.

Then, silver halide grains of a high silver chloride content having (111) faces are explained.

As described in T. H. James, *The Theory of the Photographic Process,* page 98, right column, a specific technique is required for obtaining silver halide grains of high silver chloride content having (111) faces. Octahedral silver halide grains are described in Claes et al., *The Journal of Photographic Science,* Vol. 21, 39 (1973) and Wyrsh, *International Congress of Photographic Science,* III—13, 122 (1978).

Also, Japanese Patent Application (OPI) No. 26589/80 discloses the formation of octahedral silver halide grains by using merocyanine dyes. This method gives preferred photographic properties since the adsorption of the dye is strengthened. However, since dyes used for forming octahedral grains are limited to dyes having specific structure in this method, it is frequently difficult to give absorption maximum for specific wavelength or control the form of spectra according to the purposes at the preparation of a blue-sensitive silver halide emulsion, a green-sensitive silver halide emulsion, a red-sensitive silver halide emulsion, etc.

A silver halide emulsion containing silver halide grains of a high silver chloride content having (111) faces has a disadvantage that when the emulsion is chemically sensitized to increase the sensitivity thereof, fog is liable to form and a reciprocity low failure is liable to become larger as compared to other silver halide emulsions. Also, the silver halide emulsion of this type has large faults such as the instability of latent images, the large dependence of gradation on the development progress, etc., which are the faults specific to a high silver chloride type silver halide emulsion.

Accordingly, the improvement effects by the present invention are particularly remarkable in the silver halide emulsion containing silver halide grains of high silver chloride content having (111) faces.

In the normal crystal grains in this invention, the aforesaid difficulties can be overcome by localizing a high silver bromide-containing layer at the surfaces of the grains or the vicinity thereof by using, if necessary, the CR compound or forming thereon a high silver bromide-containing layer or a high silver iodide-containing layer by halogen conversion and further applying a chemical sensitization to the layer. Furthermore, the formation of fog can be prevented by using a compound shown by formula (VI) described below.

As the substantially normal crystal grains in this invention, silver halide grains having a mean silver iodide content of less than 4 mole %, preferably less than 2 mole %, and more preferably less than 1 mole % (containing substantially no silver iodide) are useful. The silver halide grains suitable for the purposes of this invention can be obtained by applying a conversion to the aforesaid silver halide grains by adding thereto an iodide or a bromide together with, for example, the CR-compound or by growing the surface of the silver halide grains in the existence of a silver halide solvent, and in particular by performing the conversion in the existence of the CR compound, silver bromide or silver iodobromide grains, and a silver halide solvent. Furthermore, the silver halide photographic emulsion containing normal crystal silver halide grains of a high silver chloride content having a mean silver iodide content of less than 4 mole % and having (111) faces is particularly useful since such silver halide emulsion of a conventional type has various difficulties.

The halogen composition of silver halide grains can be measured by using an electron ray microanalyzer for each silver halide grain. The aforesaid EPMA method is described in Japanese Patent Application (OPI) No. 143332/85, etc.

The silver halide composition of the surfaces of the silver halide grains in this invention can be observed by a XPS (X-ray photoelectron spectroscopy) method using a spectroscope, ESCA Type 750 (trade name, made by Shimazo Du Pont Co.).

The measurement of the silver halide composition by the XPS method is described in Someno and Yasumori, *Hyomen Bunseki* (*Surface Analysis*), published by Kodan Sha, 1977.

As described above, the CDG emulsion and the EDG emulsion of this invention can be prepared by using various techniques known as the preparation methods of silver halide emulsions but typical preparation methods for the emulsions of this invention are as follows.

(1) Host silver halide grains having (111) faces are prepared and after adsorbing the CR-compound onto the main surfaces of the host grains, the host grains are subjected to a halogen conversion. Thereafter, the silver halide grains are chemically sensitized.

In this method, it is performed to gently perform the halogen conversion. The term "gently" means that since the rapid addition of an aqueous halide solution to the host grains has a danger of randomly causing epitaxial growth, the conversion is slowly performed to an extent of not causing such a random epitaxial growth.

(2) Host grains having (111) faces are prepared and after adsorbing the CR-compound onto the main surfaces of the grains, a silver salt and a halide are newly supplied to the system to grow silver halide mainly at the corner portions and the edge portions thereof. Thereafter, the silver halide grains are chemically sensitized.

As the silver salt and the halide newly supplied, they may be supplied in the form of silver ion and halide ion or may be supplied in the form of silver halide fine crystal grains.

Furthermore, in this case, a silver halide solvent may exist in the system.

(3) Host silver halide grains having adsorbed thereto a specific CR-compound are chemically sensitized.

As the CR-compound being used in the method, the compounds shown by formulae (IV) and (V) described hereinbelow are preferably used.

Then, as the emulsion of this invention containing tabular silver halide grains having (111) faces, a silver halide emulsion containing tabular silver halide grains having the ratio of diameter of a circle corresponding to the projected areas of the grains to the thickness of the grains (aspect ratio) of from 2 to 10, and preferably from 4 to 7, wherein such tabular grains exist in the emulsion in an amount of at least 50%, preferably at least 70%, and particularly preferably at least 90% of the total grains calculated as the projected areas.

For preparing the multiple twin crystal tabular or normal crystal tabular silver halide grains, a method is generally used wherein the concentrations of silver nitrate, a bromide, and an iodide, in particular, the concentrations of a bromide and an iodide (shown by pBr and pI, respectively) in the considerably excessive addition amounts ranges of them. Also, by the use of a certain compound, twin crystals can be grown to form tabular grains. However, the aforesaid matter does not relate to the control of the development initiating sites. For example, as such few compounds for accelerating the growth of twins, there is ammonia as described in *Shashin Kogaku no Kiso* (*The Base of Photographic Engineering*), pages 162 and 167, published by Corona Sha, 1978 and Japanese Patent Application (OPI) No. 108525/83. However, such a compound is used in an emulsion having high pH only and in this case there is a difficulty that the silver halide grains are reluctant to be prepared stably in the grain sizes and grain form such as the aspect ratio, etc., owing to the dissolution of silver halide. Also, in this case, the development initiation sites can not always be controlled to the corners or the edges thereof. The use of the CR-compound of contributing to the ripening of the surfaces of grains, the halogen conversion, and the formation of silver halide grains on the surfaces thereof by properly controlling the dissolution action of the silver halide and further controlling the chemical sensitization reaction in succession to the aforesaid step and the reaction sites is different from the acceleration of the growth of twins.

In the tabular silver iodobromide grains in this invention, the content of silver iodide is not more than 20 mole %, and preferably from 4 mole % to 10 mole %. Also, in the silver iodobromide grains of low silver iodide content in this invention, the silver iodide content is not more than 4 mole %, and preferably not more than 2 mole %.

If the halogen composition of silver halide grains is changed as described above, the photographic characteristics are changed and the view points to be improved are also changed. The preferred tabular silver halide grains in this invention have a multiple structure and also have a thin layer of silver iodide at the vicinity of the surface thereof. It is preferred that the cores of the tabular silver halide grains are silver iodobromide having a silver iodide content of from 4 mole % to 20 mole %, have at the outside thereof a silver iodobromide layer of a lower silver iodide content than that of the core, and further have a thin layer of silver iodide on the shell. As a matter of course, tabular silver halide grains having silver iodobromide cores and shells having a silver bromide content or silver iodide content of not more than 4 mole % and also tabular silver halide grains having a uniform silver iodide content of from 0 to 3.5 mole % are preferably used in this invention.

In the particularly useful tabular silver halide grains of a high silver chloride content having (111) faces, the mean silver chloride content of at least 50 mole %, preferably at least 70 mole %, and more preferably at least 90 mole %. It is better that the tabular silver halide grains of a high silver chloride content in this invention have layer of silver bromide or a layer of a high silver bromide content locally existing at the vicinity of the surfaces of the grains. The localization of the aforesaid layer can be realized by halogen conversion, etc.

The tabular silver halide grains of high silver chloride content in this invention preferably have an aspect ratio of from 2 to 10 as other tabular grains in this invention. It is particularly preferred that the tabular grains of high silver chloride content having a aspect ratio of from 2 to 10 exist in an amount of at least 70%, and particularly at least 90% of the total projected areas of the grains.

It is more preferred that the tabular grains of high silver chloride content having an aspect ratio of at least 2 in this invention have a mean aspect ratio of from 3 to 10, and particularly from 5 to 8.

If silver halide grains having an aspect ratio of less than 2 exist in a large amount, the color sensitized sensitivity becomes low and if the amount of the tabular grains having an aspect ratio of larger than 10 is large, the development progress is delayed and further pressing resistance, etc., are lowered.

In this invention, it is preferred that the mean diameter of the tabular silver halide grains in this invention is from 0.5 to 3.0 μm. Also, the mean thickness of the tabular silver halide grains in this invention is less than 0.3 μm, and preferably less than 0.2 μm.

In general, a tabular silver halide grain is a tabular grain having two parallel planes and hence the term "thickness" of the tabular grains in this invention means the distance between the two parallel planes constituting the tabular silver halide grains.

The mean volume of the volume load of the grains is preferably less than 2 $\mu m^3$, and more preferably less than 0.8 $\mu m^3$.

In this invention, the mean volume (V) of the volume load is shown by the following formula:

$$\overline{V} = \frac{\Sigma(n_i V_i)V_i}{\Sigma n_i V_i}$$

$n_i$: number $V_i$: grain volume

The tabular grain silver halide emulsion of high silver chloride content of this invention may be an internal latent image type tabular grain emulsion or a surface latent image type tabular grain emulsion.

The CR compound for use in this invention is a compound selectively adsorbing to, in particular, (111) faces of silver halide crystals.

The selection of the such CR-compounds differs according to the conditions being used, such as the halogen composition of silver halide grains, the halogen ion concentration of emulsion, the ion conductivity and pH, etc., the compound can be selected from azoles such as benzothiazolium salts, nitroindazoles, triazoles, benzotriazoles, benzimidazoles (in particular, nitro-substituted or halogen-substituted benzimidazoles), etc.; heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines, etc.; the aforesaid heterocyclic mercapto compounds having a water solubilizing group such as a carboxy group and a sulfo group; thioketo compounds such as oxazolinethione, etc.; azaindenes such as tetrazaindenes (in particular, 4-hydroxy-substituted (1,3,3a,7)tetrazaindenes); benzenethiosulfonic acids, benzenesulfinic acid, etc.

As preferred natural materials, nucleic acid and adenines which are the derivatives thereof are useful.

Then, other preferred CR compounds are described below. That is, other preferred CR compounds for use in this invention are shown by following general formulae.

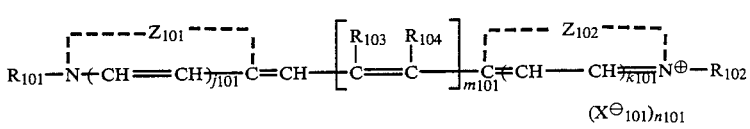

(I)

wherein $Z_{101}$ and $Z_{102}$ each represents an atomic group necessary for forming a heterocyclic nucleus.

As the heterocyclic nucleus, a 5- or 6-membered cyclic nucleus (a condensed ring or further a substituent may be bonded to the ring) containing nitrogen atom(s) as well as a sulfur atom, an oxygen atom, a selenium atom, or a tellurium atom is preferred.

Practical examples of the aforesaid heterocyclic nucleus are a thiazole nucleus, a benzothiazole nucleus, a naphthothiazole nucleus, a selenazole nucleus, a benzoselenazole nucleus, a naphthoselenazole nucleus, an oxazole nucleus, a benzoxazole nucleus, a naphthoxazole nucleus, an imidazole nucleus, a benzimidole nucleus, a naphthimidazole nucleus, a 4-quinoline nucleus, a pyrroline nucleus, a pyridine nucleus, atetrazole nucleus, an indolenine nucleus, a benzindolenine nucleus, an indole nucleus, a tetrazole nucleus, a benzotetrazole nucleus, and a naphthotetrazole nucleus.

In aforesaid formula (I), $R_{101}$ and $R_{102}$ each represents an alkyl group, an alkenyl group, an alkinyl group, or an aralkyl group. These groups as well as the groups described below may have substituent. For example, alkyl groups include unsubstituted and substituted alkyl groups and these groups may be straight chain, branched or cyclic group. The carbon atom number of the alkyl group is preferably from 1 to 8.

Also, practical examples of the substituent of the substituted alkyl group are a halogen atom, a cyano group, an alkoxy group, a substituted or unsubstituted amino group, a carboxylic acid group, a sulfonic acid group, and a hydroxy group. The alkyl group may have one or more such substituents.

Practical examples of the alkenyl group are a vinylmethyl group, etc.

Practical examples of the aralkyl group are a benzyl group and a phenyl group.

In formula (I) described above, $m_{101}$ represents 1, 2 or 3. When $m_{101}$ represents 1, $R_{103}$ represents a hydrogen atom, a lower alkyl group, an aralkyl group, or an aryl group and $R_{104}$ represents a hydrogen atom. When $m_{101}$ described above represents 2 or 3, $R_{103}$ represents a hydrogen atom and $R_{104}$ represents a hydrogen atom, a lower alkyl group, an aralkyl group, or may combine with $R_{102}$ to form a 5-membered or 6-membered ring. Also, when $m_{101}$ represents 2 or 3 and $R_{104}$ represents a hydrogen atom, $R_{103}$ may combine with the other $R_{103}$ to form a hydrocarbon ring or a heterocyclic ring. These rings are preferably 5- or 6-membered rings.

In formula (I) described above, $j_{101}$ and $k_{101}$ each represents 0 or 1, $X_{101}$ represents an acid anion, and $n_{101}$ represents 0 or 1.

Practical examples of the aryl moiety in formula (I) are a substituted or unsubstituted phenyl group.

In formula (II), $Q_{201}$ represents a sulfur atom, an oxygen atom, a selenium atom or

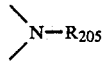

(wherein $R_{205}$ has the same significance as $R_{203}$), and $j_{201}$, $k_{201}$, $X^{\ominus}_{201}$ and $n_{201}$ have the same significance as $j_{101}$, $k_{101}$, $X^{\ominus}_{101}$, and $n_{101}$.

(III)

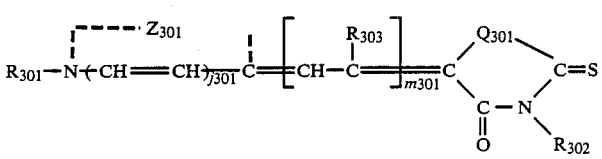

wherein $Z_{301}$ represents an atomic group necessary for forming a heterocyclic group such as those described above in regard to $Z_{101}$ and $Z_{102}$. Practical examples of the heterocyclic group are thiazolidine, thiazolindine, benzothiazoline, naphthothiazoline, selenazolidine, selenazoline, benzoselenazoline, naphthoselenazoline, benzoxazoline, naphthoxazoline dihydropyridine, dihydroquinoline, benzimidazoline, and naphthoimidazoline.

In formula (III), $Q_{301}$ has the same significance as (II)

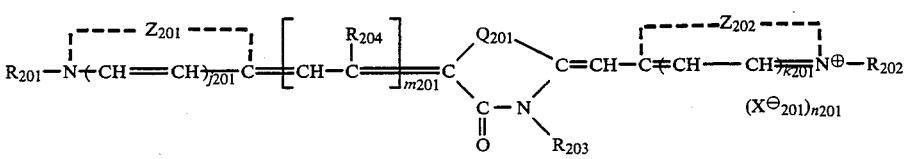

wherein $Z_{201}$ and $Z_{202}$ have the same significance as afore-said $Z_{101}$ and $Z_{102}$, $R_{201}$ and $R_{202}$ have the same significance as $R_{101}$ and $R_{102}$; $R_{203}$ represents an alkyl group, an alkenyl group, an alkinyl group or an aryl group; $m_{201}$ represents 0, 1, or 2, $R_{204}$ represents a hydrogen atom, a lower alkyl group, or an aryl group, and when $m_{201}$ represents 2, $R_{204}$ and the other $R_{204}$ may combine with each other to form a hydrocarbon ring or a heterocyclic ring, which is preferably a 5- or 6-membered ring.

$Q_{201}$, $R_{301}$ has the same significance as $R_{101}$ or $R_{102}$, and $R_{302}$ has the same significance as $R_{203}$. Also, $m_{301}$ has the same significance as $m_{201}$. $R_{303}$ has the same significance as $R_{204}$ and further when $m_{301}$ is 2 or 3, said plural $R_{303}$s may be combined with each other to form a hydrocarbon ring or a heterocyclic group. Also, $j_{301}$ has the same significance as $j_{101}$.

Then, specific examples of sensitizing dyes as the CR compound for use in this invention are illustrated below although the invention is not limited to these compounds.

CR-(1)

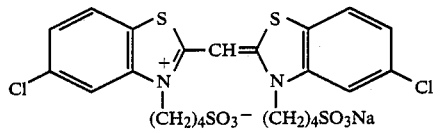

CR-(2)

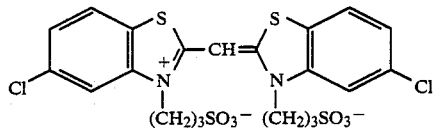

-continued
CR-(3)
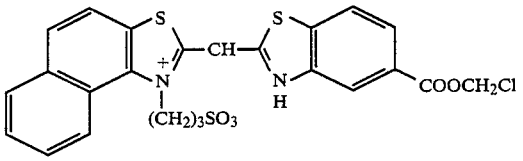
CR-(4)
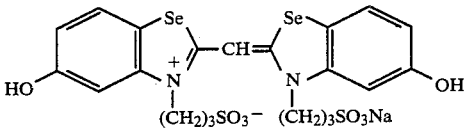
CR-(5)
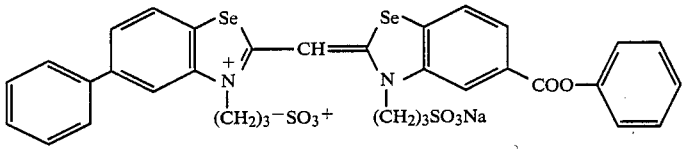
CR-(6)
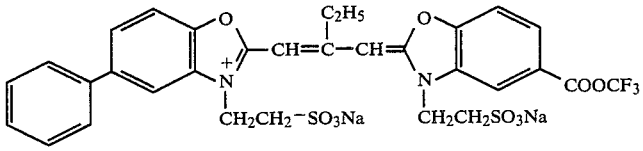
CR-(7)
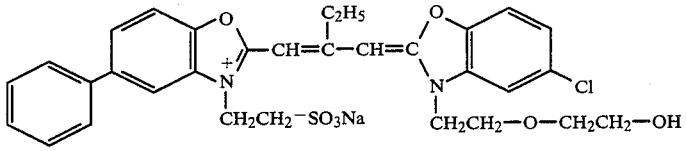
CR-(8)
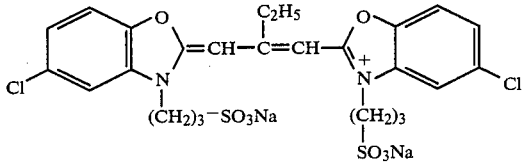
CR-(9)
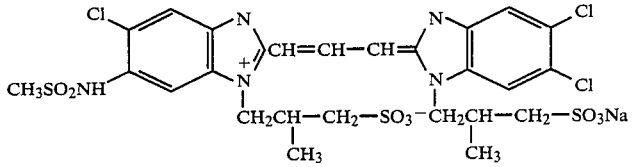
CR-(10)
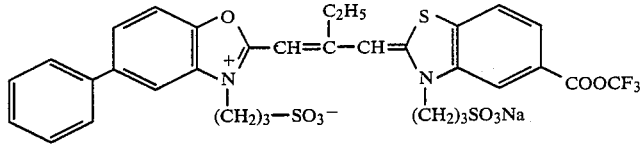
CR-(11)
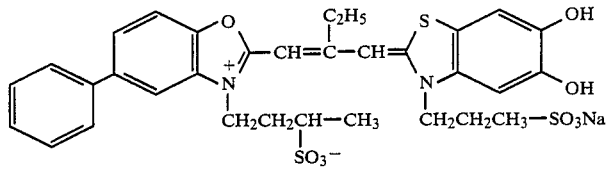

-continued
CR-(12)
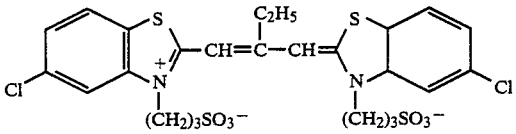
CR-(13)
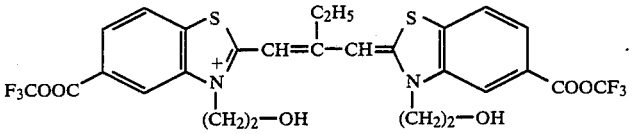
CR-(14)
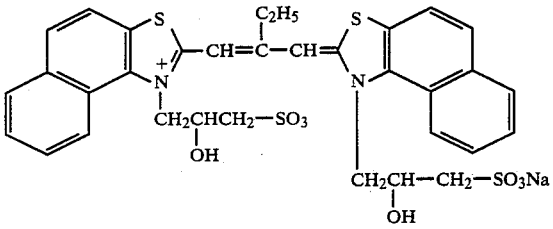
CR-(15)
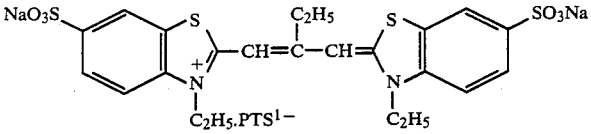
CR-(15)'
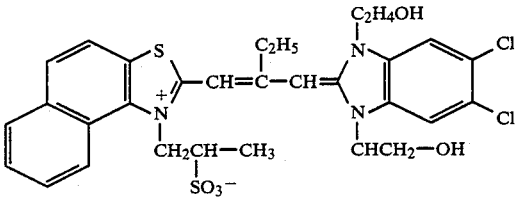
CR-(16)
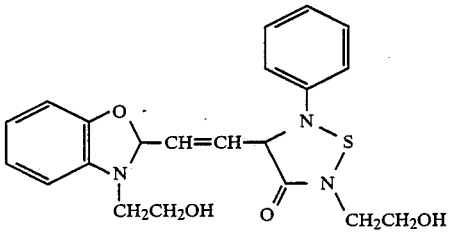
CR-(17)
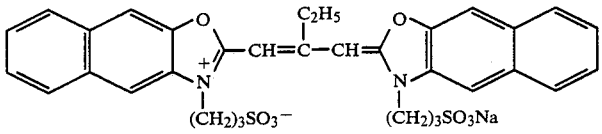
CR-(18)
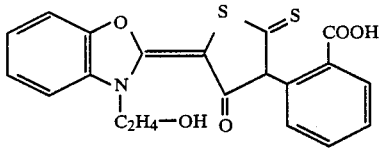
CR-(19)
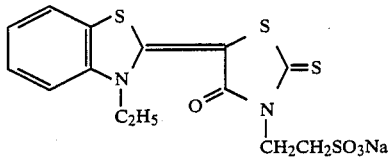

-continued

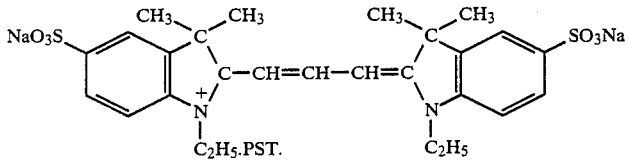

CR-(20)

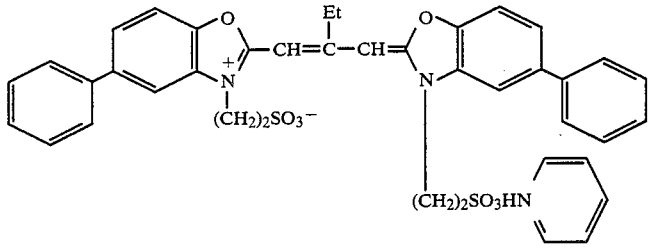

CR-(21)

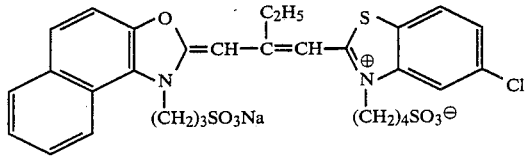

CR-(22)

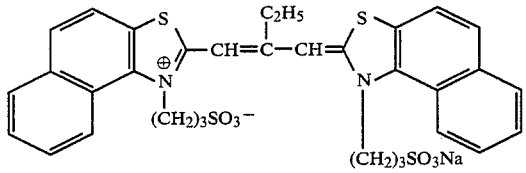

CR-(23)

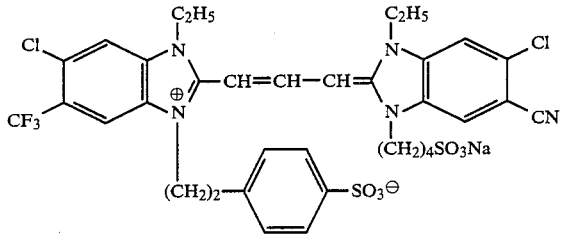

CR-(24)

The particularly preferred CR compounds for (111) faces in this invention are the compounds represented by following formulae (IV) and (V).

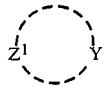

(IV)

wherein Y represents a sulfur atom or an oxygen atom, and $Z^1$ represents an atomic group necessary for forming a saturated or unsaturated heterocyclic ring with a sulfur atom or an oxygen atom.

In this case, the atomic group shown by $Z^1$ is composed of carbon atoms, nitrogen atom(s), an oxygen atom, and/or a sulfur atom and the heterocyclic ring form by $Z^1$ and Y is a 3- to 8-membered heterocyclic ring, which may be condensed with other ring to form a condensed ring.

Practical examples thereof are thiirane, thiethane, thiane, thiepine, thiosine, dihydrothiorane, thiophene, dihydrothiopyrane, 4H-thiopyrane, 2H-thiopyrane, 1,3-thiazylidine, 1,3-oxazolidine, oxazole, thiazole, 1,3-oxathiorane, 1,3-dithiorane, 1,3-dithiorane, 1,3-dithiorene, 1,4-oxathiane, 1,4-thiazane, 1,3-thiazane, benzothiorane, benzothiane, benzothiaziridine, and benzoxathiane.

Practical examples of the substituent for the heterocyclic ring formed by $Z^1$ and Y are a halogen atom, an alkyl group (preferably having from 1 to 20 carbon atoms), an aryl group (preferably having from 6 to 20 carbon atoms, an alkoxy group (preferably having from 6 to 20 carbon atoms), an aryloxy group, an alkylthio group, an arylthio group, an acyloxy group, an amino group, a carbonamido group, a ureido group, a carboxy group, a carbonic acid ester group, an oxycarbonyl group, a carbamoyl group, an acyl group, a sulfo group, a sulfonyl group, a sulfinyl group, a sulfonamido group, a sulfamoyl group, a cyano group, a hydroxy group, a nitro group, an oxo group, a thioxo group, an imino group, and a selenoxo group.

When two or more substituents exist, they may be the same or different.

Furthermore, in the compounds shown by formula (IV) described above, the compounds shown by (IV′) or (IV″) are particularly preferred.

(IV')

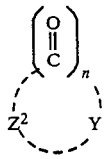

(IV'')

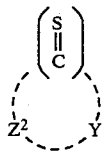

wherein $Z^2$ represents an atomic group necessary for forming a 5- or 6-membered saturated or unsaturated heterocyclic ring together with the atom shown by Y and the carbonyl group and the heterocyclic ring may have substituent(s). In this case, the atomic group shown by $Z^2$ has the same significance as that shown by $Z^1$ and also the substituent(s) for the heterocyclic ring formed by $Z^2$, Y, and the carbonyl group have the same significance as the substituent(s) for the heterocyclic ring formed by $Z^1$ and Y described above.

In formula (IV'), n represents 1, 2, or 3 and when n is 2 or 3, the carbonyl groups may or may not be adjacent to each other.

The 5- or 6-membered saturated or unsaturated heterocyclic rings shown by formula (IV') are practically as follows. Specific compounds thereof are described in Japanese Patent Application Nos. 169498/86 (pages 9 to 16) and 47225/87 (pages 20 to 29).

For example, there are

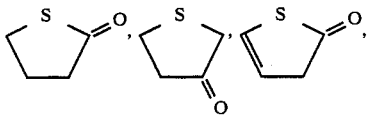

and

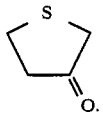

Also, in the compounds shown by formula (IV'), the compounds wherein the carbonyl group is bonded to the sulfur atom, are particularly preferred, in which the heterocyclic ring is saturated.

Specific examples of the compound shown by formula (IV') or (IV'') in this invention are illustrated below.

CR-(25)

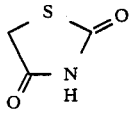

CR-(26)

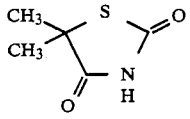

-continued

CR-(27)

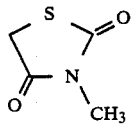

CR-(28)

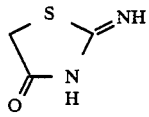

Furthermore, about the tabular silver halide grains of the EDG emulsion, the same phenomenon as above occurs for the edges. That is, about multiple structure grains using the CR compound for (111) faces thereof, the development ceters are concentrated to the edges or the vicinity of the edges by the use of the CR compound during the formation of the grains, whereby the development can be quickened. In this case, the particularly preferred CR compounds are the compounds shown by formula (V):

$$R_1—S—(X)_m—Y'—R_2 \qquad (V)$$

wherein X represents a divalent organic group such as an alkylene group, an arylene group, an alkenylene group, $—SO_2—$, —SO—, —O—, —S—,

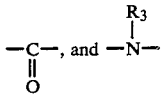

or a combination thereof. The alkeylene group, arylene group or alkenylene group may have a substituent such as the substitutent described above about $R_1$.

$R_3$ represents a hydrogen atom, an alkyl group, or an aryl group, m represents 0 or 1, and $R_1$ represents a hydrogen atom, an alkali metal, an alkaline earth metal, a substituted or unsubstituted alkyl group, a substituted or unsubstituted aryl group, or a substituted or unsubstituted heterocyclic group.

Preferred examples of $R_1$ are a hydrogen atom and a substituted or unsubstituted alkyl group. As the substituent, there are a halogen atom, an alkyl group, an aryl group, an alkoxy group, an aryloxy group, a sulfonyl group, a sulfonamido group, an amido group, an acyl group, a sulfamoyl group, a carbamoyl group, a ureido group, an alkoxycarbonylamino group, an allyloxycarbonylamino group, an alkoxycarbonyl group, an aryloxycarbonyl group, an aminocarbonylthio group, an alkylcarbonylthio group, an arylcarbonylthio group, a cyano group, a hydroxy group, a mercapto group, a carboxy group, a sulfo group, a nitro group, an amino group, an alkylthio group, an arylthio group, and a heterocyclic group.

In formula (V), $R_2$ represents a hydroxy group, a substituted or unsubstituted alkyl group, a substituted or unsubstituted aryl group, a substituted or unsubstituted heterocyclic group, a substituted or unsubstituted amino group, an alkoxy group, or an aryloxy group. As the substituents, those described above about $R_1$ can be used. Preferred examples as $R_2$ are a hydroxy group, a substituted or unsubstituted alkyl group, and a substituted or unsubstituted amino group.

In formula (V), Y' represents —CO— or —$SO_2$—, and is preferably —CO—.

Also, the total carbon atom numbers of the organic group shown by X, $R^1$, $R^2$ or $R^3$ including the substituent moiety, if any, is preferably not more than 20.

Then, specific examples of the compound shown by formula (V) for use in this invention are illustrated below but the invention is not limited to them. The examples of the CR compound shown below are described in Japanese Patent Application Nos. 186481/86 (pages 10 to 14) and 47225/87 (pages 32 to 36).

CR-(29)

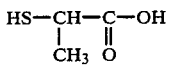

CR-(30)

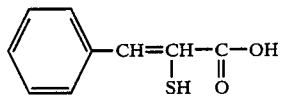

CR-(31)

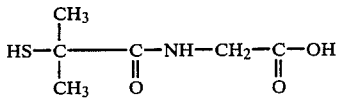

CR-(32)

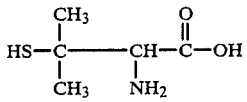

CR-(33)

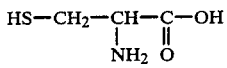

CR-(34)

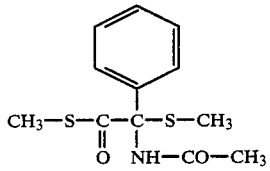

These compounds shown by formula (IV) or (IV') described above may be added in any optional step before finishing the formation of silver halide grains but it is preferred that the compound exists at least partially in the system from the beginning of the formation of the grains.

The CR compound shown by formulae (I) to (III) can be used, in the existence of the compound shown by formula (IV) or (V), during the conversion or the formation of the grains or before the chemical sensitization of the grains together therewith.

The CR compound shown by formulae (I) to (III) for use in this invention is added to the aforesaid host silver halide emulsion as a solution in a water-miscible organic solvent such as methanol, ethyl acetate, etc. The compound may be dispersed in an aqueous gelatin solution or an aqueous solution of a surface active agent. The addition amount of the compound is preferably from $10^{-6}$ to $10^{-2}$ mole, and more preferably from $10^{-5}$ to $10^{-3}$ mole per mole of the host silver halide. Furthermore, the host silver halide emulsion is mixed with fine grain silver halide grains as described above and the resultant emulsion can be ripened while properly controlling in the temperature range of from 30° C. to 80° C. and in the silver ion range of 5 to 10 pAg to complete the conversion.

The compound shown by formula (IV) or (V) in this invention is similarly used in an amount of from $2\times10^{-5}$ to $3\times10^{-1}$ mole, and in particular from $2\times10^{-4}$ to $1\times10^{-1}$ mole per mole of silver halide.

The hydroxytetraazaindene compounds which are used as the CR compounds in this invention are preferably the compounds shown by formula (VI) or (VII):

(VI)

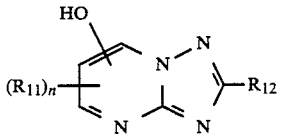

(VII)

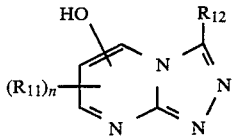

wherein $R_{11}$ and $R_{12}$, which may be the same or different, each represents a hydrogen atom, an aliphatic residue such as an alkyl group (e.g., methyl group, ethyl group, propyl group, pentyl group, hexyl group, octyl group, isopropyl group, sec-butyl group, t-butyl group, cyclohexyl group, cyclopentylmethyl group, 2-norbornyl group, etc.), an alkyl group substituted by an aromatic residue (e.g., benzyl group, phenethyl group, benzhydryl group, 1-naphthylmethyl group, 3-phenylbutyl group, etc.), an alkyl group substituted by an alkoxy group (e.g., methoxymethyl group, 2-methoxyethyl group, 3-ethoxypropyl group, 4-methoxybutyl group, etc.), and an alkyl group substituted by a hydroxy group, a carbonyl group, or an alkoxycarbonyl group (e.g., a hydroxymethyl group, 2-hydroxymethyl group, 3-hydroxybutyl group, carboxymethyl group, 2-carboxyethyl group, 2-(methoxycarbonyl)ethyl group, etc.; or an aromatic residue such as an aryl group (e.g., phenyl group, 1-naphthyl group, etc.), a substituted aryl group (e.g., p-tolyl group, m-ethylphenyl group, m-cumenyl group, mesityl group, 2,3-xylyl group, p-chlorophenyl group, o-bromophenyl group, p-hydroxyphenyl group, 1-hydroxy-2-naphthyl group, m-methoxyphenyl group, p-ethoxyphenyl group, p-carboxyphenyl group, o-(methoxycarbonyl)phenyl group, m-(ethoxycarbonyl)phenyl group, 4-carboxy-1-naphthyl group, etc.). The number of the total carbon atoms of $R_{11}$ and $R_{12}$ is preferably not more than 12.

In formulae (VI) and (VII), n represents 1 or 2.

Then, specific examples of the hydroxytetraazaindene compound shown by formula (VI) or (VII) described above are illustrated below but the compounds for use in this invention are not limited to these compounds only.

CR-(35): 4-Hydroxy-6-methy-1,3,3a,7-tetraazaindene
CR-(36): 4-Hydroxy-1,3,3a,7-tetraazaindene
CR-(37): 4-Hydroxy-6-methyl-1,2,3a,7-tetraazaindene
CR-(38): 4-Hydroxy-6-phenyl-1,3,3a,7-tetraazaindene
CR-(39): 4-Methyl-6-hydroxy-1,3,3a,7-tetraazaindene
CR-(40): 2,6-Dimethyl-4-hydroxy-1,3,3a,7-tetraazaindene
CR-(41): 4-Hydroxy-5-ethyl-6-methyl-1,3,3a,7-tetraazaindene
CR-(42): 2,6-Dimethyl-4-hydroxy-5-ethyl-1,3,3a,7-tetraazaindene
CR-(43): 4-Hydroxy-5,6-dimethyl-1,3,3a,7-tetraazaindene CR-(44): 2,5,6-Trimethyl-4-hydroxy-1,3,3a,7-tetraazaindene
CR-(45): 2-Methyl-4-hydroxy-6-phenyl-1,3,3a,7-tetraazaindene
CR-(46): 4-Hydroxy-6-ethyl-1,2,3a,7-tetraazaindene
CR-(47): 4-Hydroxy-6-phenyl-1,2,3a,7-tetraazaindene
CR-(48): 4-Hydroxy-1,2,3a,7-tetraazaindene
CR-(49): 4-Methyl-6-hydroxy-1,2,7-tetraazaindene
CR-(50): 5,6-Trimethylene-4-hydroxy-1,3,3a,7-tetraazaindene Also, as the benzotriazole compounds which are used as the CR compound in this invention, there are the compounds represented by formula (VIII)

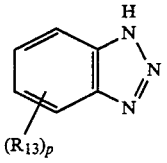

(VIII)

wherein p represents an integer of from 1 to 4 and $R_{13}$ represents a halogen atom (e.g., chlorine atom, bromine atom and iodine atom) or an aliphatic group (including saturated aliphatic groups and unsaturated aliphatic groups), such as an unsubstituted alkyl group having, preferably from 1 to 8 carbon atoms (e.g., methyl group, ethyl group, n-propyl group, hexyl group, etc.); a substituted alkyl group (the alkyl moiety thereof having preferably from 1 to 4 carbon atoms, such as a vinylmethyl group, an aralkyl group (e.g., benzyl group, phenethyl group, etc.), a hydroxyalkyl group (e.g., 2-hydroxyethyl group, 3-hydroxypropyl group, 4-hydroxybutyl group, etc.), an acetoxyalkyl group (e.g., 2-acetoxyethyl group, 3-acetoxypropyl group, etc.), and an alkoxyalkyl group (e.g., 2-methoxyethyl group, 4-methoxybutyl group, etc.)); and an aryl group (e.g., phenyl group, etc.).

$R_{13}$ is preferably a halogen atoms (chlorine atom or iodine atom) or an alkyl group having from 1 to 3 carbon atoms (methyl group, ethyl group, or propyl group).

Then, specific examples of the benzotriazole compounds for use in this invention are illustrated below but the benzotriazole compounds in this invention are not limited to these compounds.

CR-(51): Benzotriazole
CR-(52): 5-Methylbenzotriazole
CR-(53): 5,6-Dimethylbenzotriazole
CR-(54): 5-Bromobenzotriazole
CR-(55): 5-Chlorobenzotriazole
CR-(56): 5-Nitrobenzotriazole
CR-(57): 4-Nitro-6-chlorobenzotriazole
CR-(58): 5-Nitro-6-chlorobenzotriazole Other CR-compounds illustrated below can be also used in this invention.

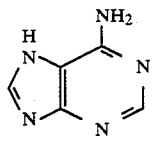

RNA
DNA

-continued

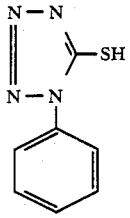

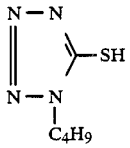

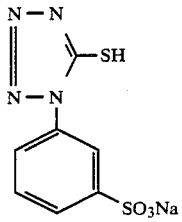

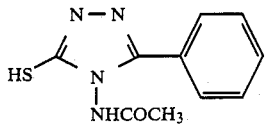

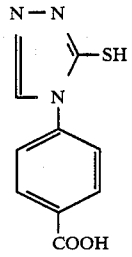

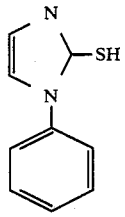

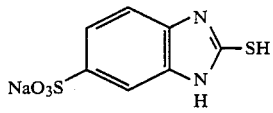

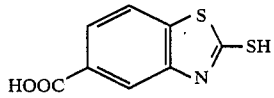

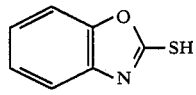

-continued

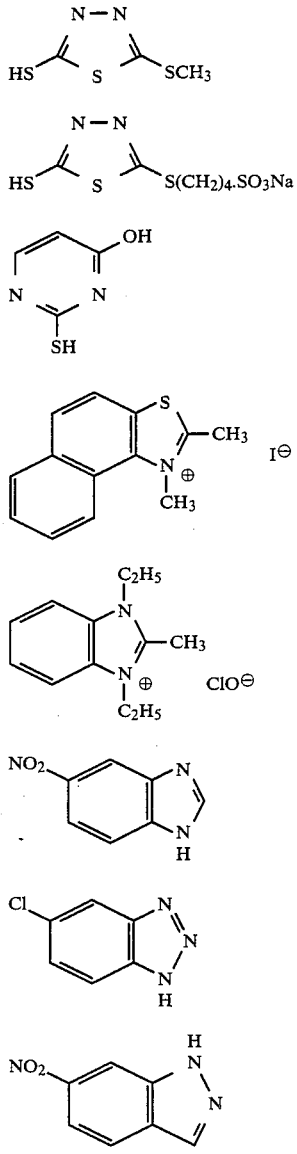

The CR compound shown by formulae (VI), (VII) and (VIII) and the like are used in an amount of preferably from $10^{-7}$ mole to $10^{-2}$ mole, and more preferably from $10^{-5}$ mole to $10^{-2}$ mole per mole of silver halide.

The CR compound for use in this invention is a compound capable of controlling the development initiating sites and the number thereof by existing on the surfaces of silver halide grains by adsorption during the formation (including physical ripening) of the silver halide grains or during the halogen conversion of the surfaces of the silver halide grains, or before the chemical sensitization of the silver halide grains, and the adsorbed amount thereof on (111) faces is important. The proper amount thereof is more than 10%, and preferably more than 20% of a saturated amount in monomolecular adsorption and it is better to use the compound in an amount of not causing the reduction of sensitivity by the inhibition of the development and by desensitization and other disadvantages such as the reduction in development progress.

The CR compounds for use in this invention cause less other disadvantages and the amount of the compound shown by formula (I), (III), (VI), (VII) or (VIII) is preferably from 50% to 100% of the saturation amount thereof adsorbed on the silver halide grain.

When the CR compound is added to the system during the formation or halogen conversion of silver halide grains, and in particular, when the compound is added during the halogen conversion, if iodide ions or bromide ions are supplied to the system at a too high concentration, the effect of the CR compound in this invention is liable to be reduced. Accordingly, it is preferred that iodide ions or bromide ions are slowly added at a relatively low concentration.

As a halogen ion donator capable of controlling the supplying speed of halogen ions, an organic halogen compound, an inorganic halogen compound having a proper solubility in water, and a halogen compound excapsulated by a semipermeable membrane can be used. Practically, silver halide grains having finer grain sizes than the host grains and having higher silver iodide or silver bromide content than the host grains are preferably used.

For example, when a silver halide emulsion containing host silver chloride grains having adsorbed thereto the aforesaid CR compound is mixed with a silver halide emulsion containing fine silver bromide grains having a mean grain size of about 0.1 μm in an amount of about 1 mole % of the host silver chloride grains and is ripened by causing conversion, the silver bromide grains are dissolved away and after reaching an equilibrium, a layer of new halogen composition is formed on the surfaces of the host grains and the reaction is stopped. In this case, as the result of causing the homogenization of halogen composition with the deposition of the phase enriched with silver bromide thus formed, the content of silver bromide of the surfaces of the grains reaches about 3% only and thus shells having stable composition can be formed.

Also, in the case of quickly adding iodide ions or bromide ions, it is preferred that aforesaid homogenization of the halogen composition is performed in the co-existence of a silver halide solvent with the CR compound.

In this case, it is considered that during the conversion, at least silver chloride and silver bromide are mixed by repeating the dissolution and recrystallization and thus silver bromide diffused in the inside of the host grains to some extent.

In the case of the formation of silver halide grains, the effect of the CR compound can be increased by controlling the supplying rates of silver ions and halogen ions or by the existence of a silver halide solvent.

Also, it is important to select a chemical sensitizer and the amount thereof so as to control the reaction of the chemical sensitization by the adsorption of the CR compound.

In the case of producing the silver halide grains in this invention, a silver halide solvent may be used during the growth or physical ripening of the grains.

As a silver halide solvent, there are thiocyanates, thioethers, thioureas, etc., and also ammonia can be used together in the range of not giving bad influences.

For example, thiocyanates described in U.S. Pat. Nos. 2,222,264, 2,448,534, 3,320,069, etc.), thioether compounds described in U.S. Pat. Nos. 3,271,157, 3,574,628, 3,704,130, 4,297,439, 4,276,347, etc.), thion compounds described in Japanese Patent Application (OPI) Nos. 144319/78, 82408/78, 77737/80, etc.), and amine compounds described in Japanese Patent Application No. 100717/79, etc., can be used.

During the formation and physical ripening of silver halide grains, a cadmium salt, a zinc salt, a lead salt, a thallium salt, an iridium salt or a complex salt thereof, a rhodium salt or a complex salt thereof, or an iron salt or a complex salt thereof may exist in the system. In particular, an iridium salt or a rhodium salt is preferred.

At the production of the silver halide grains in this invention, a method of increasing the addition rates, addition amounts of addition concentrations of a silver salt solution (e.g., an aqueous silver nitrate solution) and a halide solution (e.g., an aqueous sodium chloride solution) which are added for accelerating the growth of the silver halide grains is preferably used.

As the aforesaid method, the description of British Patent No. 1,335,925, U.S. Pat. Nos. 3,672,900, 3,650,757, and 4,242,445, Japanese Patent Application (OPI) Nos. 142329/80, 158124/80, 113927/83, 113928/83, 111934/83, 111936/83, etc., can be referred to.

Then, the production method of the tabular grain silver iodobromide emulsion of this invention is explained in more detail.

Tabular silver halide emulsions are described, for example, in Cugnac and Chateau, *Evolution of the Morphology of Silver Bromide Crystals During Physical Ripening, Science et Industrie Photography,* vol. 33, No. 2, 121–125 (1962), Duffin, *Photographic Emulsion Chemistry,* pages 66–72, published by Focal Press, 1966, A. P. H. Trivclli, *Photographic Journal,* Vol. 80, 285 (1970), etc. Also, tabular silver halide emulsions can be easily prepared by referring to the methods described in Japanese Patent Application (OPI) Nos. 127921/83, 113927/83, and 113928/83 and U.S. Pat. No. 4,439,520.

Also, a tabular grain silver halide emulsion is obtained by forming seed crystals existing therein more than 40% by weight of tabular silver halide grains in an atmosphere of a relatively low pBr value of lower than 1.3 and growing the seed crystals by simultaneously adding thereto an aqueous solution of silver salt and an aqueous solution of a halide.

In this case, it is preferred to add an aqueous silver salt solution and an aqueous halide solution in the process of growing silver halide grains so as not to generate new crystal nuclei.

The sizes of tabular silver halide grains can be controlled by controlling the temperature of the system, selecting the kind and amount of solvent, and controlling the addition rates of the silver salt and the halide which are used at growing the silver halide grains.

Furthermore, in the tabular silver halide grains, monodispersed hexagonal tabular grains are particularly useful.

Details of the structure and the production method of the monodispersed hexagonal tabular silver halide grains in this invention are described in Japanese Patent Application No. 299155/86 but they are briefly described below. The emulsion of a silver halide emulsion composed of a dispersion medium and silver halide grains and hexagonal tabular silver halide grains having a ratio of the edge of the longest length to the edge of the shortest length of less than 2 and having two parallel faces as the outer surfaces account for at least 70% of the total projected area of the silver halide grains. Furthermore, the tabular silver halide emulsion has a monodispersibility of less than 20% in the variation coefficient (the value of the dispersion of grain sizes shown by the diameters of circles corresponding to the projected areas of grains (standard deviation) devied by the mean grain size) of the grain size distribution of the hexagonal tabular silver halide grains. The crystals structure thereof may be uniform but the crystal structure wherein the halogen composition of the inside differs from that of the surface portion and further the silver halide grains may have a layer structure. Also, it is preferred that the silver halide grains contain reduction sensitizing silver nuclei.

The silver halide grains can be formed through nucleus formation-Ostwald ripening and growth of grains, and the details are described in Japanese Patent Application No. 299155/86.

Also, the silver halide emulsion of this invention may be a core/shell type internal latent image silver halide emulsion containing silver halide grains having the aforesaid hexagonal tabular grains as the cores. In this case, in regard to the chemical sensitization method for the cores, the method of forming shells, and the development by a developer containing a silver halide solvent, the descriptions of Japanese Patent Application (OPI) No. 133542/84 and U.S. Pat. Nos. 3,206,313 and 3,317,322 can be referred to. In this case, the thickness of the shells is from 1 to 100 lattices, and preferably from 5 to 50 lattices.

The hexagonal tabular silver halide grains in this invention may have transition lines in the inside thereof. Whether or not grains contain transition lines therein and the number of the transition lines can be determined by observing by a low temperature (liquid Hc temperature) transmission type electron microscope.

The hexagonal tabular silver halide grains containing transition lines can be formed by adding an iodide to hexagonal tabular silver halide grains at the crystal growth of the hexagonal tabular grains or at a period of growing crystals using the hexagonal tabular grains as the seed crystals. In this case, the term "a period" means from instance (about ½ second) to the whole crystal growing period. In regard to the addition rate of the iodide being added, when the difference between the iodine content of silver iodobromide deposited by the addition of the iodide and the iodine content of silver iodobromide as substrate is at least 5 mole %, the hexagonal tabular grains are formed.

In this invention, so-called halogen conversion type grains as described in British Patent No. 635,841 and U.S. Pat. No. 3,622,318 can be particularly effectively utilized. The amount of the halogen conversion is from 0.2 mole % to 2 mole %, and particularly preferably from 0.2 mole % to 0.6 mole % to the silver amount.

In silver iodobromide, the structure having a high iodine layer in the inside and/or at the surface is particularly preferred.

By applying conversion to the surfaces of the tabular silver halide grains in this invention, a silver halide emulsion having higher speed is obtained.

As a method of halogen conversion, an aqueous halogen solution having a less solubility product for silver than the halogen composition of the surfaces of the silver halide grains before ordinary halogen conversion is added. For example, the conversion is caused by adding an aqueous solution of potassium bromide and/or potassium iodide to silver chloride or silver chlorobromide tabular grains or by adding an aqueous solution of potassium iodide to silver bromide or silver iodobromide tabular grains. The concentration of the aqueous solution being added is preferably as low as possible and is less than 30%, and preferably less than 10%. Furthermore, it is preferred that the halide solution for conversion is added at a rate of less than 1 mole % per minute per mole of silver halide before the halogen conversion. Moreover, in the case of performing the halogen conversion, a part or the whole amount of the silver halide adsorbing material in this invention may exist in the system or fine grains of silver bromide, silver iodobromide or silver iodide may be added to the system in place of the aqueous halide solution for conversion. In this case, the size of the silver halide fine grains being added is preferably less than 0.2 μm, more preferably less than 0.1 μm, and particularly preferably less than 0.05 μm. Also, the amount of the halogen conversion is preferably from 0.1 to 1 mole %, and more preferably from 0.2 to 0.6 mole % of silver halide before the conversion.

The method of halogen conversion in this invention is not limited to any one of the aforesaid methods but a combination of the methods can be used according to the purposes. For the silver halide composition of the surfaces of silver halide grains before halogen conversion, the iodine content is preferably less than 1 mole %, and particularly preferably less than 0.3 mole %.

At the application of halogen conversion in the aforesaid method, the method of existing a silver halide solvent is particularly effective. As the silver halide solvent being used in this case, thioether compounds, thiocyanates, and 4-substituted thioureas are preferred. In particular, thioether compounds and thiocyanates are particularly effective and it is preferred that the amount of a thiocyanate is from 0.5 to 5 g and the amount of a thioether is from 0.2 to 3 g per mole of silver halide.

The CDG or EDG emulsion containing silver halide grains having (111) faces in this invention is the silver halide emulsion obtained by performing the halogen conversion of the surfaces of silver halide grains and the growth and ripening of the silver halide in the existence of the CR-compound to control the sites of the chemical sensitization reaction and concentrate the development initiating sites. It has been discovered that in regard to the absorptive property, the reactivity and the relative absorptive power to the CR-compound of a chemical sensitizer being used the chemical sensitization of the silver halide grains, a particularly suitable chemical sensitizer exists, which is an important matter. In general, a gold sensitization method, a noble metal sensitization method, a sulfur sensitization method, a reduction sensitization method, etc., can be used solely or as a combination thereof.

As the chemical sensitization method, a gold sensitization method by so-called gold compounds (described, e.g., in U.S. Pat. Nos. 2,448,060 and 3,320,069), a sensitizing method by a noble metal such as iridium, platinum, rhodium, palladium, etc. (described, e.g., in U.S. Pat. Nos. 2,448,060, 2,566,245, and 2,566,263), a sulfur sensitization method using a sulfur-containing compound (described, e.g., in U.S. Pat. No. 2,222,264), and a selenium sensitization method using a selenium compound and a reduction sensitization method using a tin salt, thiourea dioxide, polyamine, etc. (described, e.g., in U.S. Pat. Nos. 2,487,850, 2,518,698, and 2,521,925) can be used solely or as a combination thereof.

For the silver halide grains of this invention, a gold sensitization or a combination of a gold sensitization and a sulfur sensitization or a reduction sensitization is preferred, and a combination of a gold sensitization and a sulfur sensitization is particularly preferred.

The amount of a gold sensitizer is preferably more than $5\times10^{-6}$ mole, and more preferably more than $1.5\times10^{-5}$ mole per mole of silver halide. The optimum amount of a sulfur sensitizer being used with the gold sensitizer can be selected according to the grain size of the silver halide grains, the temperature for the chemical sensitization, pAg, pH, etc., and is from $10^{-7}$ to $10^{-3}$, preferably from $5\times10^{-7}$ to $10^{-4}$ mole, and more preferably from $5\times10^{-7}$ to $10^{-5}$ mole.

Preferred examples of the gold sensitizer are chloroauric acid and the salt thereof. It is also useful to increase the gold sensitization by using a thiocyanate together with the gold sensitizer as described in the aforesaid book written by James, page 155.

Examples of the sulfur sensitizer which can be used together with a gold sensitizer are sodium thiosulfate, thiourea (e.g., tetramethylthiourea), and rhodium compounds.

The silver halide emulsion of this invention may be, if necessary, subjected to a treatment by an oxidizing agent after the formation of the silver halide grains. This method is described in European Patent No. 144990A2.

The CR compound shown by formula (I), (II) or (III) described above also functions as a spectral sensitizing dye but the silver halide emulsion containing the CR compound can, if necessary, spectrally sensitized by adding thereto sensitizing dye(s) after chemical sensitization.

Suitable dyes which can be employed include cyanine dyes, merocyanine dyes, complex cyanine dyes, complex merocyanine dyes, holopolar cyanine dyes, hemicyanine dyes, stylyl dyes, and hemioxonol dyes. Particularly preferred are cyanine dyes, merocyanine dyes and complex merocyanine dyes. Any conventionally utilized nucleus for cyanine dyes is applicable to these dyes as a basic heterocyclic nucleus. That is, a pyrroline nucleus, an oxazoline nucleus, a thiazoline nucleus, a selenazole nucleus, a pyrrole nucleus, an oxazole nucleus, a thiazole nucleus, an imidazole nucleus, a tetrazole nucleus, a pyridine nucleus, etc., and further nuclei formed by condensing an alicyclic hydrocarbon ring with these nuclei and nuclei formed by condensing an aromatic hydrocarbon ring with these nuclei, that is, an indolenine nucleus, a benzindolenine nucleus, an indole nucleus, a benzoxazole nucleus, a naphthoxazole nucleus, benzothiazole nucleus, a naphthothiazole nucleus, a benzoselenazole nucleus, a benzimidazole nucleus, a quinoline nucleus, etc., are applicable. The carbon atoms of these nuclei may also be substituted.

To merocyanine dyes and complex merocyanine dyes, as nuclei having a ketomethylene structure, 5- or 6-membered heterocyclic nuclei such as pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

For example, the compounds described in *Research Disclosure,* No. 17643, page 23, Paragraph IV (December, 1978) and the compounds described in the literatures cited therein can be used.

Furthermore, by adding a compound having a mercapto group to the silver halide emulsion of this invention, the formation of fog of the photographic light-sensitive material using the emulsion can be reduced and the shelf life thereof can be improved as well as the stability of the coating composition of the emulsion with the passage of time before the production of photographic light-sensitive materials can be improved.

For these purposes, tetraazaindenes are usually used and also a mercapto-containing compound is used in a limited small amount. If the amount thereof is less than an optimum addition range, the effect thereof is not obtained, while if the amount is over the range, injurious effects such as desensitization, etc., occur. For the aforesaid purpose, it is unexpectedly preferred for the silver halide emulsion of this invention to add mercapto compounds, in particular water-soluble mercapto compounds which are considered to have a strong inhibition effect with less injurious effects such as desensitization, development inhibition, etc.

For the color photographic light-sensitive materials using the silver halide emulsions of this invention, coupler couplers shown by following formulae (IX) to (XIII) are preferably used.

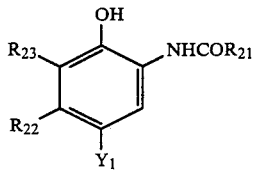

[IX]

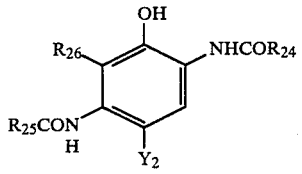

[X]

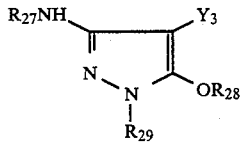

[XI]

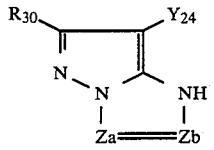

[XII]

-continued

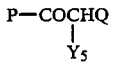

[XIII]

If the above formulae, P represents a substituted or unsubstituted t-butyl group, a substituted or unsubstituted phenyl group, or a substituted or unsubstituted anilino group; $R_{21}$, $R_{24}$ and $R_{25}$ each represents an aliphatic group, an aromatic group, a heterocyclic group, an aliphatic amino group, an aromatic amino group, or a heterocyclic amino group; $R_{22}$ represents an aliphatic group; $R_{23}$ and $R_{26}$ each represents a hydrogen atom, a halogen atom, an aliphatic group, an aliphatic oxy group, or an acylamino group; and $R_{22}$ and $R_{23}$ may combine with each other to form a ring; $R_{27}$ and $R_{29}$ each represents a substituted or unsubstituted phenyl group; $R_{28}$ represents a hydrogen atom, an aliphatic acyl group, an aromatic acyl group, an aliphatic sulfonyl group, or an aromatic sulfonyl group; $R_{30}$ represents a hydrogen atom or a substituent; Q represents a substituted or unsubstituted N-phenylcarbamoyl group; Za and Zb each represents methine, substituted methine, or =N—; $Y_1$, $Y_2$ and $Y_4$ each represents a halogen atom or a group capable of releasing at the coupling reaction with the oxidation product of a developing agent (hereinafter, such a group is referred to as releasable group); $Y_3$ represents a hydrogen atom or a releasable group; and $Y_5$ represents a releasable group.

In formulae (IX) and (X) described above, said $R_{22}$ and $R_{23}$ or said $R_{25}$ and $R_{26}$ may form a 5-, 6- or 7-membered ring.

Furthermore, the compound shown by the aforesaid formula may form a dimer or more polymer at $R_{21}$, $R_{22}$, $R_{23}$ or $Y_1$; $R_{24}$, $R_{25}$, $R_{26}$ or $Y_2$; $R_{27}$, $R_{28}$, $R_{29}$, or $Y_3$; $R_{30}$, Za, Zb or $Y_4$; or Q or $Y_5$.

Details of $R_{21}$, $R_{22}$, $R_{23}$, $R_{24}$, $R_{25}$, $R_{26}$, $R_{27}$, $R_{28}$, $R_{29}$, $R_{30}$, Za, Zb, Q, $Y_1$, $Y_2$, $Y_3$, $Y_4$ and $Y_5$ are same as those of formulae (I), (II), (III), (IV) and (V) described in Japanese Patent Application No. 175233/86 (page 17-3 to page 34).

Specific examples of these color couplers are the couplers (C-1) to (C-40), (M-1) to (M-42) and (Y-1) to (Y-46) described in aforesaid Japanese patent Application No. 175232/86 (page 36 to page 78-3).

More preferred examples of the color couplers are illustrated below.

C-(1)

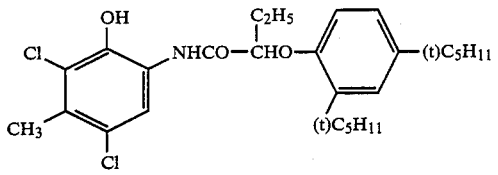

C-(2)

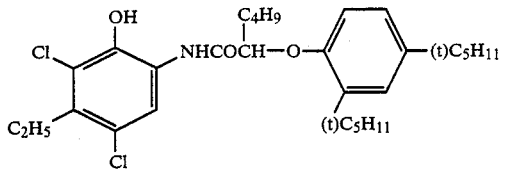

-continued
C-(3)
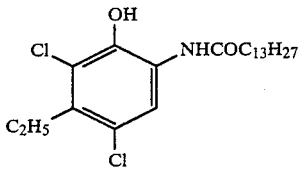
C-(4)
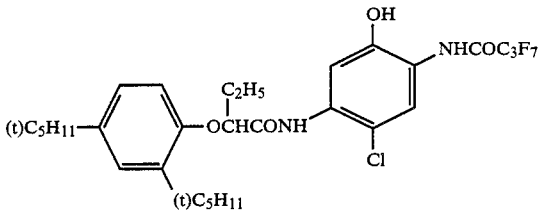
C-(5)
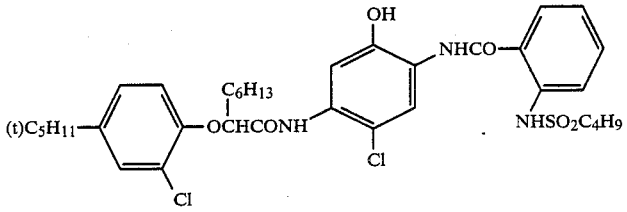
C-(6)
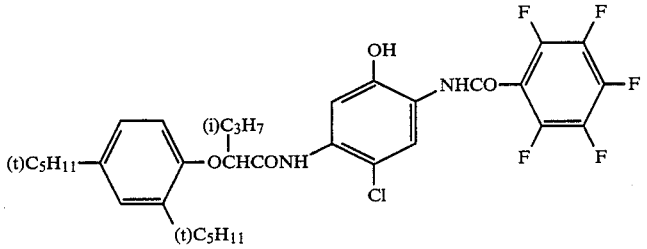
C-(7)
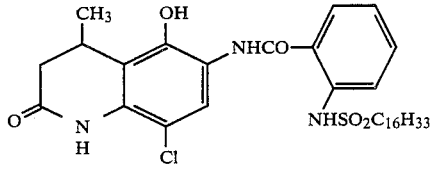
C-(8)
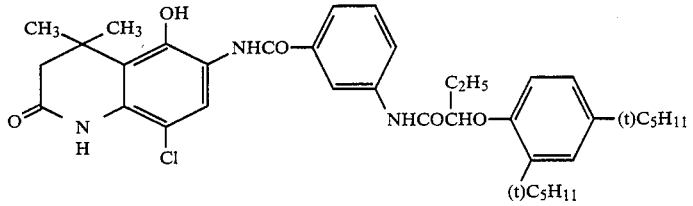
C-(9)
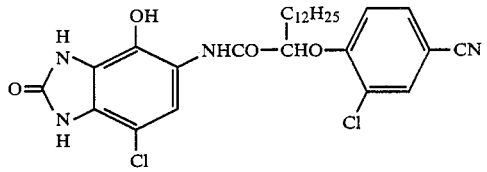

-continued
C-(10)
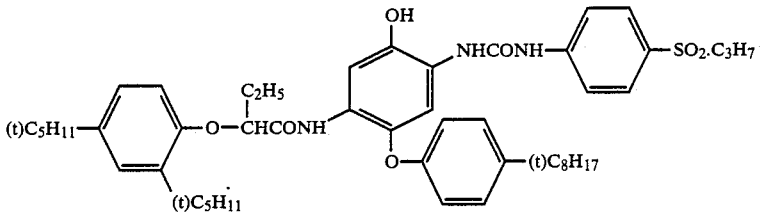
C-(11)
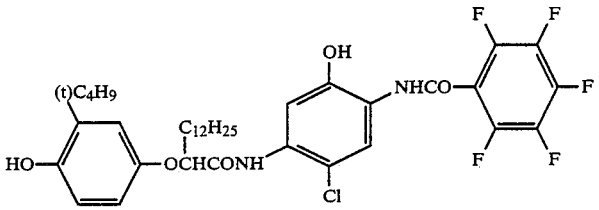
M-(1)
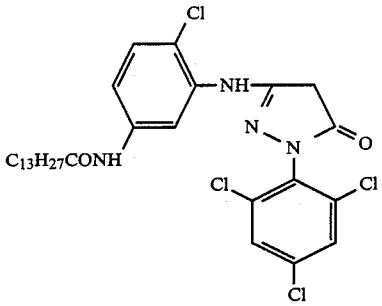
M-(2)
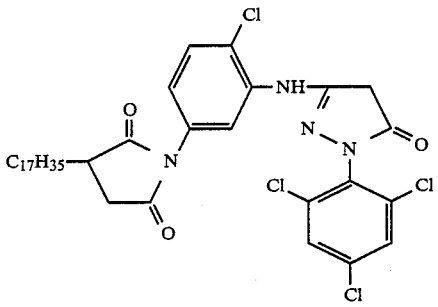
M-(3)
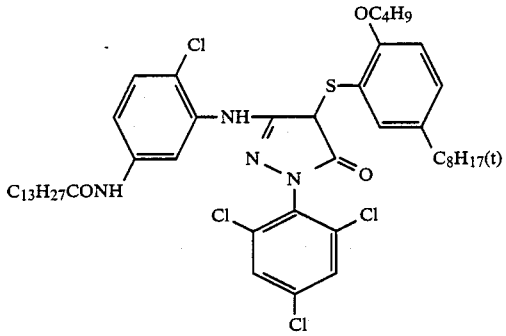

-continued
M-(4)
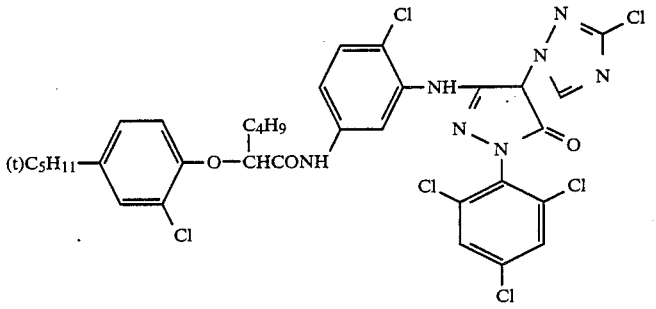
M-(5)
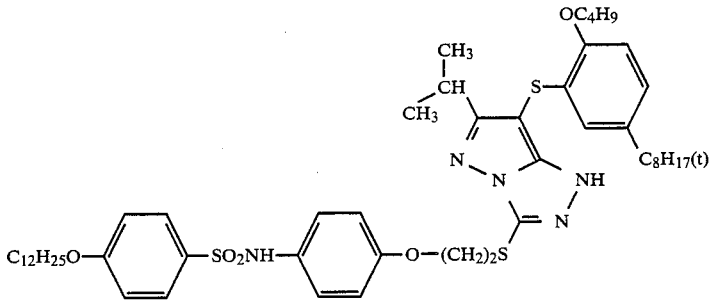
M-(6)
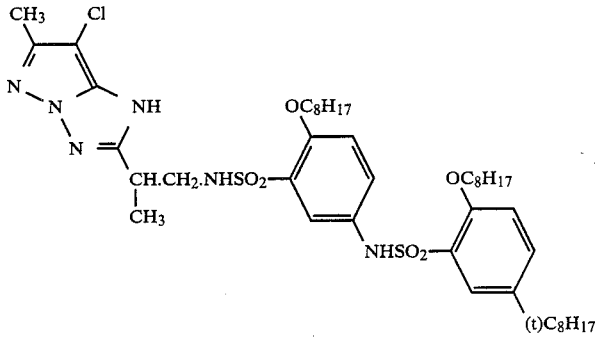
M-(7)
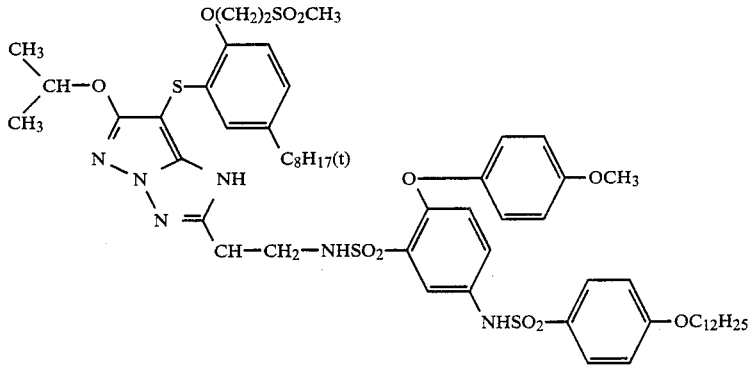
M-(8)
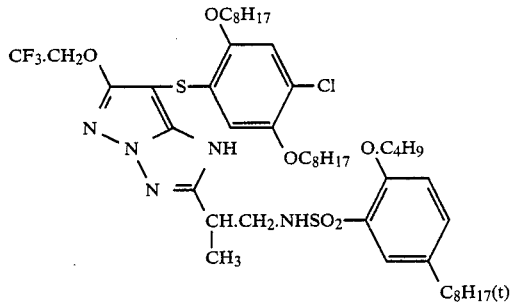

-continued
M-(9)
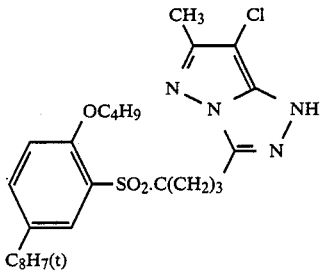
Y-(1)
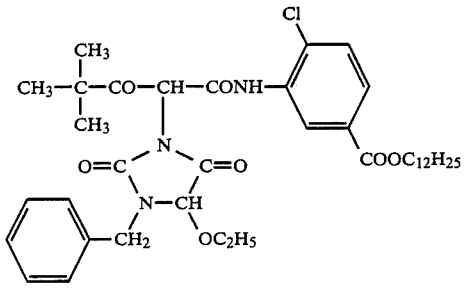
Y-(2)
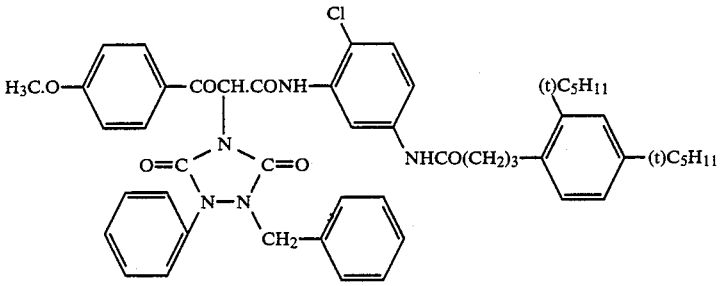
Y-(3)
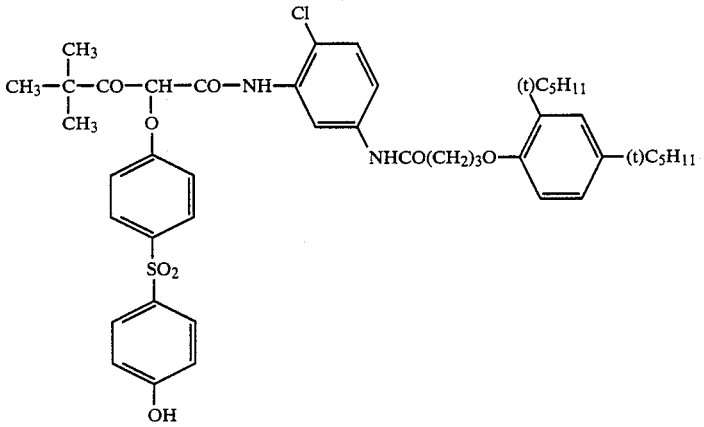
Y-(4)
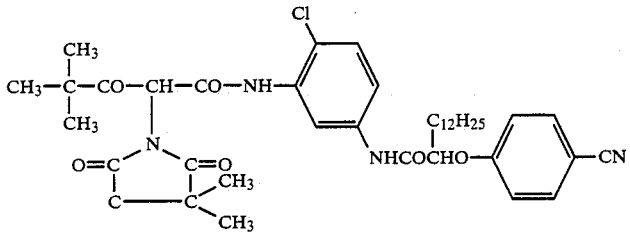

-continued

Y-(5)

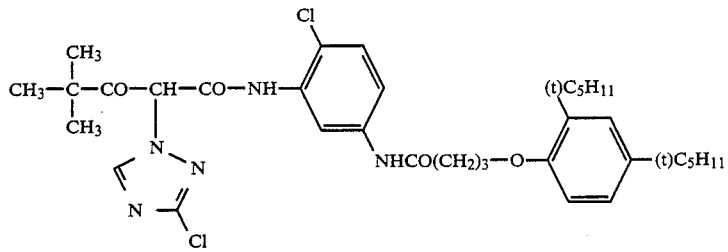

A standard amount of the color coupler is in the range of from 0.001 to 1 mole, preferably with from 0.01 to 0.5 mole for the yellow coupler, from 0.003 to 0.3 mole for the magenta coupler, and from 0.002 to 0.3 mole for the cyan coupler per mole of the light-sensitive silver halide.

In the light-sensitive materials using the color couplers shown by aforesaid formula (IX), (X), (XI), (XII) or (XIII), the preferred coating amount of silver halide is from 0.1 g/m$^2$ to 1.5 g/m$^2$ in the case of using a light-reflective support and from 0.2 g/m$^2$ to 7 g/m$^2$ in the case of using a transparent support.

In this invention, it is preferred to use so-called high-speed reaction couplers having a high coupling reactivity as the couplers.

The silver halide emulsions of this invention show particularly remarkable effect of this invention in the case of developing the color photographic light-sensitive materials using the so-called high-speed reaction couplers with a color developer using a developing agent shown by formula (XXI) described hereinafter. The reason of obtaining such a remarkable effect has not yet been clarified but is considered to be based on that other sites than the sites having the developing initiating points are covered by the CR compound adsorbed thereto.

The coupling reactivities of couplers can be determined as relative values by adding a mixture of two kinds of couplers M and N giving different dyes capable of being clearly separated to a silver halide emulsion followed by color development and measuring the amount of each dye in the color images formed.

If the maximum density of the color formed by coupler M is shown by (DM)max and the density thereof in an intermediate stage is shown by DM, and also if the maximum density and the density at intermediate stage of the color formed by coupler N are shown by (DN)max and DN, respectively, the ratio of the reactivities RM/RN of both the couplers is shown by the following equation:

$$RM/RN = \frac{\log\left(1 - \frac{DM}{(DM)\max}\right)}{\log\left(1 - \frac{DN}{(DN)\max}\right)}$$

That is, the ratio of coupling activities RM/RN is obtained from the slopes of straight lines obtained by plotting several DM points and DN points obtained by applying light exposures at various stages to the silver halide emulsion containing the mixed couplers and color developing the emulsion as log $$\left(1 - \frac{1}{D\max}\right)$$

in crossing two axes.

In this case, if the various RM/RN values are obtained as described above on various couplers using a definite coupler N, the coupling reactivities are relatively obtained.

The aforesaid values of RM/RN may be obtained using the following coupler as the aforesaid definite coupler N.

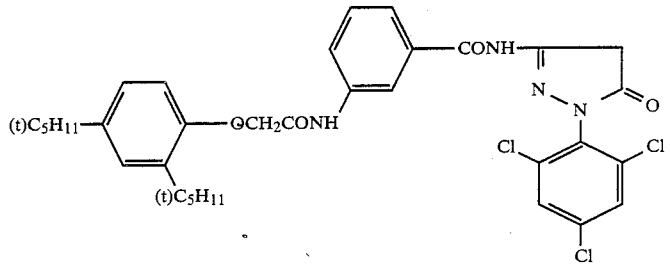

Also, the following coupler is used as the coupler N for magenta couplers and yellow couplers.

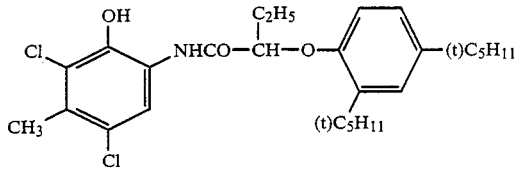

As the high-speed reaction couplers for use in this invention, it is preferred to use a cyan coupler of at least 1.5, a magenta coupler of at least 2.5, and a yellow coupler of at least 1 as the RM/RN value obtained by the aforesaid coupler N.

Preferred high-speed reaction couplers for use in this invention are couplers shown by formula (IX) described above, wherein $R_{22}$ and $R_{23}$ are an atomic group forming a 5-position substituted naphthol ring and $Y_1$ is a releasable group through an oxygen atom or a sulfur atom, more preferably those having a carboxy group or a sulfonic acid group; couplers shown by formula (X) described above, wherein $R_{25}$ and $R_{26}$ are an atomic group forming a condensed 5- to 7-membered ring; couplers shown by formula (XI) described above, wherein $Y_3$ is a releasable group through a sulfur atom or a nitrogen atom; couplers shown by formula (XII) described above, wherein, in particular, $Y_4$ is a halogen atom or a releasable group through a sulfur atom or a nitrogen atom; and couplers shown by formula (XIII) described above, wherein $Y_5$ is a releasable group through an oxygen atom or a nitrogen atom, or is, more preferably those having a hydroxy group or a carboxy group. It is preferred in this invention to use a combination of the aforesaid high-speed reaction couplers. In particular, in the case of using the couplers shown by formula (XII) described above, the effect of this invention becomes remarkable.

Then, specific examples of the high-speed reaction couplers for use in this invention are shown below but the invention is not limited to these couplers.

Cyan Coupler:

(CYAN-1)

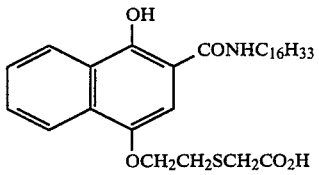

(2.9)

(CYAN-2)

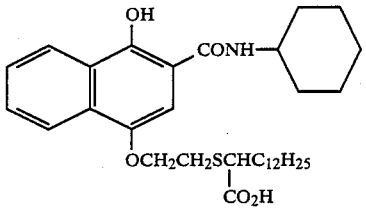

(2.8)

(CYAN-3)

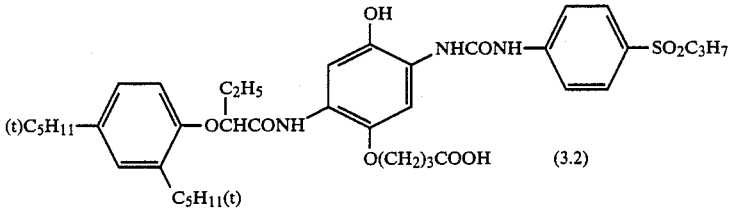

(3.2)

(CYAN-4)

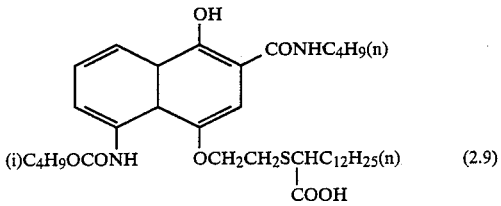

(2.9)

(CYAN-5)

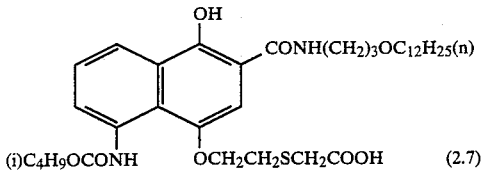

(2.7)

(CYAN-6)

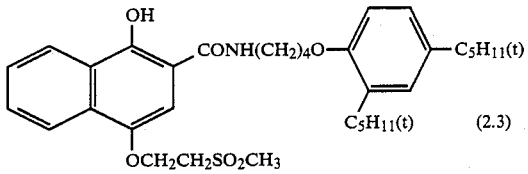

(2.3)

Magenta Couplers:

-continued
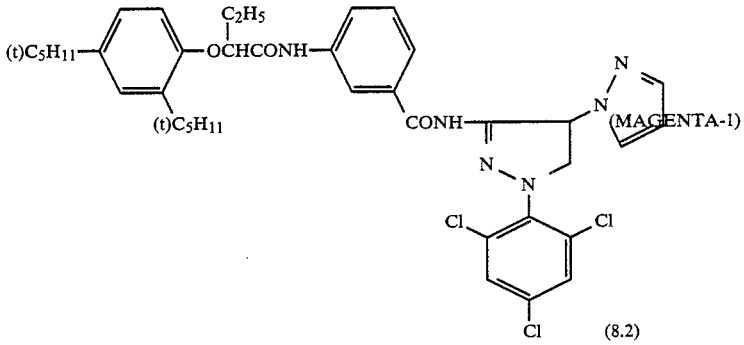
(8.2) (MAGENTA-1)
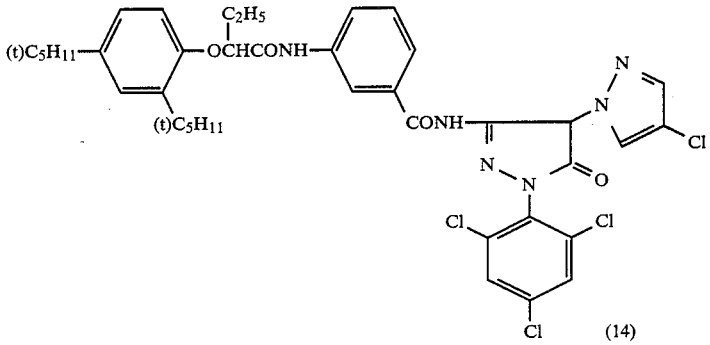
(14) (MAGENTA-2)
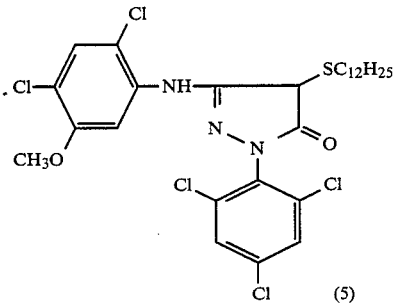
(5) (MAGENTA-3)
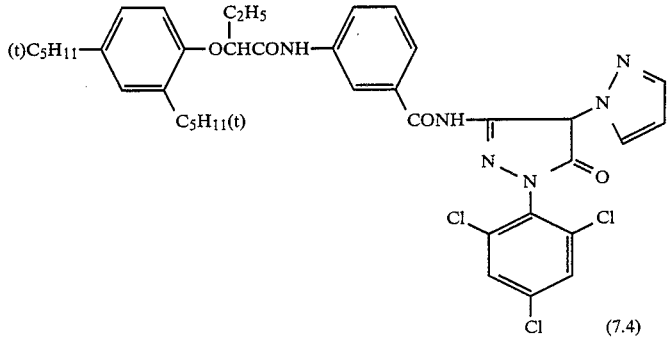
(7.4) (MAGENTA-4)
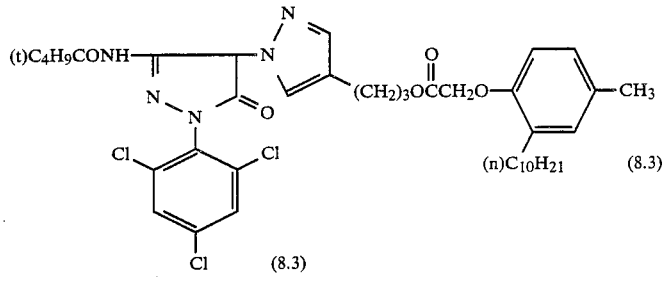
(8.3) (8.3) (MAGENTA-5)

-continued
(MAGENTA-6)
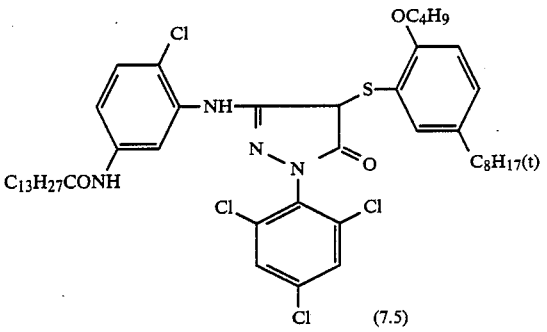
(7.5)
(MAGENTA-7)
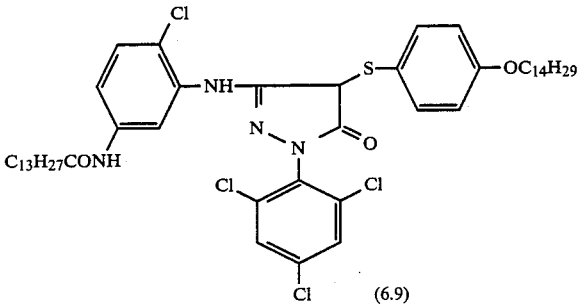
(6.9)
(MAGENTA-8)
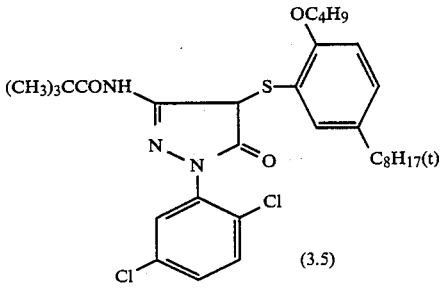
(3.5)
(MAGENTA-9)
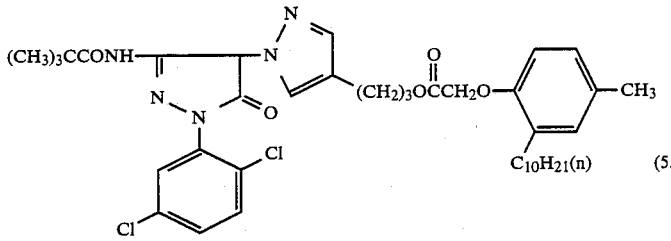
(5.5)
(MAGENTA-10)
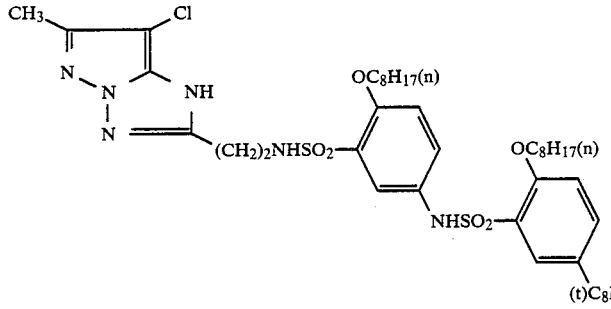
(6.7)

-continued
(MAGENTA-11)
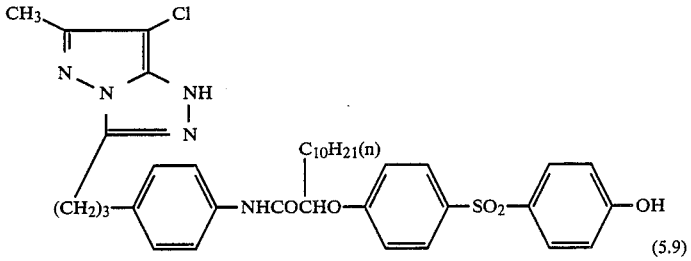
(5.9)
Yellow Couplers:
(YELLOW-1)
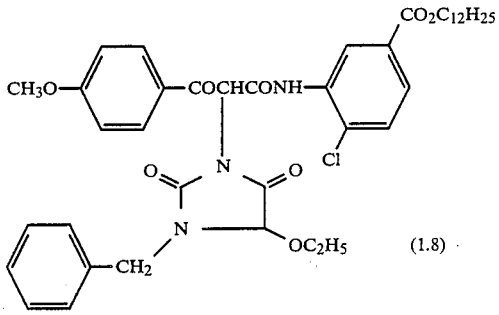
(1.8)
(YELLOW-2)
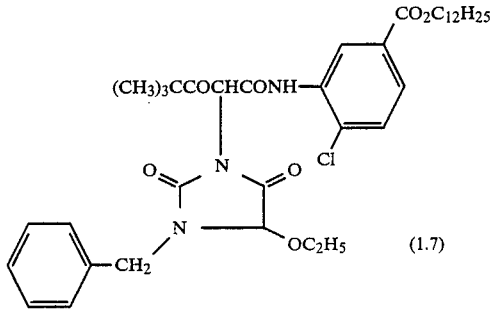
(1.7)
(YELLOW-3)
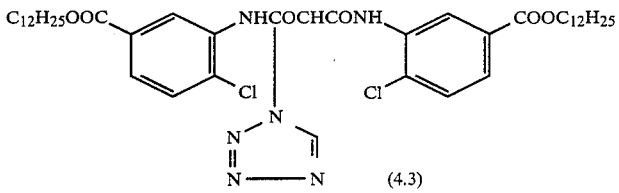
(4.3)
(YELLOW-4)
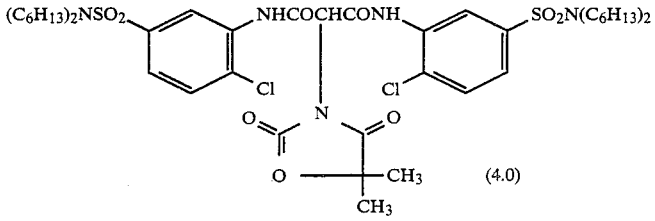
(4.0)

-continued (YELLOW-5)

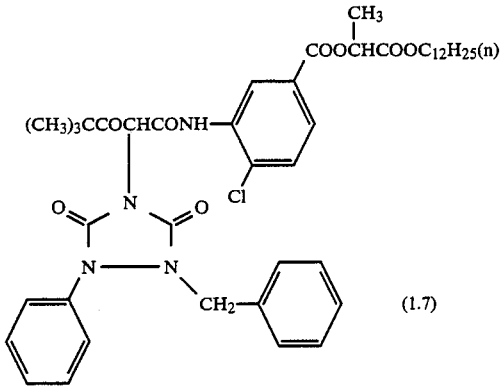

(1.7)

(YELLOW-6)

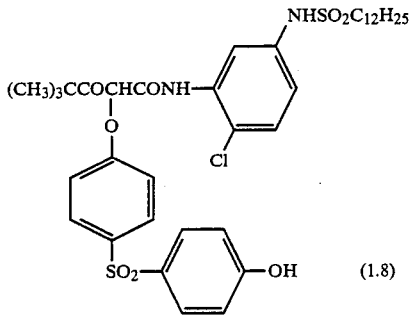

(1.8)

In this invention, it is preferred to incorporate such a high-speed reaction coupler in the silver halide emulsion of the highest speed in at least each color-sensitive emulsion layers. There is not particular restriction on the amount thereof but it is preferred that the amount of a cyan high-speed reaction coupler is from 0.005 to 0.1 mole, the amount of a magenta high-speed reaction coupler is from 0.005 to 0.1 mole, and the amount of a yellow high-speed reaction coupler is from 0.005 to 0.1 mole per mole of silver.

Also, in this invention, it is possible to increase the sensitivity of the silver halide emulsion by increasing the covering power and also to improve the graininess by using non-diffusible couplers forming dyes having a proper diffusibility as defined in U.S. Pat. No. 4,420,556, claim 1 and claims 3 to 8 and Japanese Patent Application (OPI) No. 191036/84. These non-diffusible couplers can be easily synthesized by the method described in the aforesaid patents as well as Japanese Patent Application (OPI) Nos. 1938/86, 3934/82, and 105226/78 and U.S. Pat. No. 4,264,723.

Specific examples of these couplers are described in Japanese Patent Application No. 201756/86 (pages 54–58).

In this invention, various functional couplers can be used. For example, DIR couplers shown by following formula (XIX) or (XX) and hydroquinone derivative-releasing couplers can be used.

These couplers are particularly useful for improving the graininess and sharpness of images and in the case of using these couplers, the color correction effect between emulsion layers and the effect of softening the gradation become remarkable.

In this invention, it is particularly preferred to use the DIR compounds selected from the compounds shown by following formula (XIX) or (XX):

$$A\text{-}(L_1)_a\text{-}S\text{-}\underset{\underset{X}{|}}{Z_4}\text{-}(L_2)_c\text{-}Y]_b \qquad \text{(XIX)}$$

$$A\text{-}(L_1)_a\text{-}\underset{\underset{X}{|}}{Z_5}\text{-}(L_2)_c\text{-}Y]_b \qquad \text{(XX)}$$

wherein A represents a color coupler residue or a coupler residue which is released by causing reaction with the oxidation product of a color developing agent and does not form a colored dye as described, for example, in U.S. Pat. Nos. 3,632,345 and 3,958,993 and Japanese Patent Application (OPI) Nos. 64927/76 and 16123/77.

As the color coupler residue, the following residues can be used.

As the preferred yellow color coupler residues shown by A, there are pivaloylacetanilide type, benzoylacetanilide type, malondiester type, malondiamine type, dibenzoylmethane type, benzothiazolylacetamide type, malonestermonoamide type, benzothiazolylacetate type, benzoxazolylacetamide type, benzoxazolylacetate type, benzimidazolylacetamide type and benzimidazolyl acetate type color coupler residues; coupler residues induced from the heterocyclic ring-substituted acetamides or heterocyclic ring-substituted acetates described in U.S. Pat. No. 3,841,880; couplers residues induced from the acylacetamides described in U.S. Pat. No. 3,770,446, British Patent No. 1,459,171, West German Patent Application (OLS) No. 2,503,099, Japanese Patent Application (OPI) No. 139738/75, and *Research Disclosure,* No. 15737; and heterocyclic ring-substituted coupler residues described in U.S. Pat. No. 4,046,574.

As the preferred magenta color coupler residues shown by A, there are cyanoacetophenone type coupler residues having a 5-oxo-2-pyrazoline nucleus or a pyrazolo-[1,5-a]benzimidazole nucleus and coupler residues having a pyrazolotriazole nucleus.

Also, the preferred cyan color coupler residues shown by A, there are coupler residues having a phenol nucleus or an α-naphthol nucleus.

Furthermore, the coupler residue shown by A may substantially not form a dye after releasing a development inhibitor by causing coupling with the oxidation product of a developing agent. Examples of the coupler residue of this type shown by A coupler residues described in U.S. Pat. Nos. 4,052,213, 4,088,491, 3,632,345, 3,958,993, and 3,961,959.

In conclusion, A represents a coupler residue releasing residue

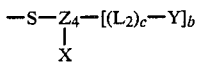

or residue

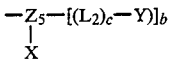

by causing a reaction with the oxidation product of a color developing agent.

In formulae (XIX) and (XX) described above, $L_1$ represents a timing group and a represents 0 or 1.

Examples of the linkage group shown by $L_1$ are as follow.

| | |
|---|---|
| $-OCH_2-$ | (the linkage group shown in U.S. Pat. No. 4,146,386) |
| $-SCH_2-$<br>$-OCO-$ | (the linkage group described in West German Patent Application (OLS) No. 2,626,315) |
| 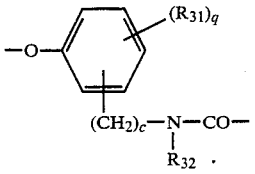 | (the linkage group described in West German Patent Application (OLS) No. 2,855,697, c represents an integer of 0 to 2), |
| 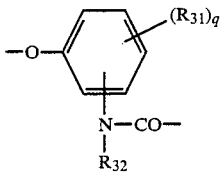 | |
| 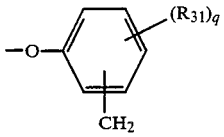 | |
| 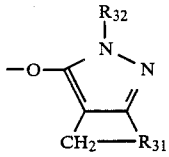 | |

-continued

| | |
|---|---|
| 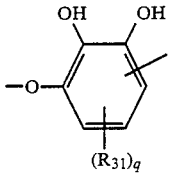 | |
| 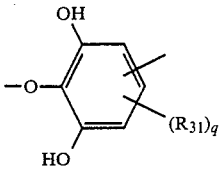 | |
| 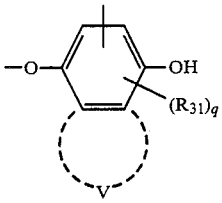 | |
| 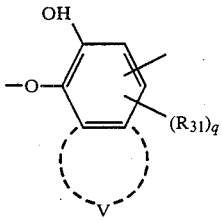 | |
| 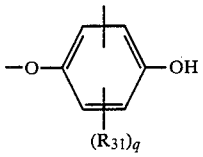 | |
| 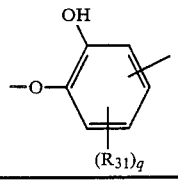 | (the linkage groups described in Japanese Patent Application (OPI) No. 72378.85). |

In the aforesaid formulae, $R_{31}$ represents a hydrogen atom, a halogen atom, an alkyl group, an alkenyl group, an aralkyl group, a hydroxy group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a cycloalkyl group, an alkanesulfonyl group, an arylsulfonyl group, or an acyl group.

$R_{32}$ represents a hydrogen atom, an alkyl group, an alkenyl group, an aralkyl group, a cycloalkyl group, or an aryl group.

V represents an atomic group forming a 5-membered or 6-membered ring.

Also, q represents 1 or 2 and when q is 2, $R_{31}$s may be the same or different.

In formula (XIX) described above, $Z_4$ represents a heterocyclic ring (e.g., a diazolyl group, a triazolyl group, a tetrazolyl group, a thiadiazolyl group, an oxadiazolyl group, and an oxazolyl group) or a divalent linkage group such as a substituted or unsubstituted allylene and a straight chain or branched alkylene.

In formula (XX), $Z_5$ represents a divalent heterocyclic residue.

In formulae (XIX) and (XX), $L_2$ represents a linkage group; X and Y each represents a hydrogen atom, an alkyl group, an alkenyl group, an aryl group or a heterocyclic ring residue, b represents 0, 1 or 2 and c represents 0 or 1.

In the photographic light-sensitive materials of this invention, when a coating amount of the DIR compound or the hydroquinone derivative-releasing type coupler described above is not more than $5\times10^{-4}$ mole, and preferably not more than $1\times10^{-4}$ mole per g of silver-calculated coating amount of light-sensitive silver halide and also the silver iodide content of the light-sensitive silver halide is not more than 2 mole %, and preferably not more than 1 mole %, the hindrance of desilvering is advantageously inhibited even when the time for blixing is shortened below 3 minutes.

For improving the sharpness, an ansharp masking method is frequently used in addition to the use of the aforesaid DIR coupler. For example, such a method is described in French Patent No. 2,260,124 and Japanese Patent Application (OPI) Nos. 201246/86 and 169843/86.

In this invention, as other functional couplers, following colored couplers, colored dye-releasing couplers, polymer couplers, couplers releasing photographically useful residues, etc., can be used.

For correcting unnecessary absorption of colored dyes, it is preferred to apply masking by using a colored coupler for camera-film type color photographic materials. Typical examples of the colored couplers are yellow-colored magenta couplers described in U.S. Pat. No. 4,163,670 and Japanese Patent Publication No. 39413/82 and magenta-colored cyan couplers, cyan-colored yellow couplers, and cyan-colored magenta couplers described in U.S. Pat. Nos. 4,004,929 and 4,138,258 and British Patent No. 1,146,368. Other colored couplers are described in *Research Disclosure,* No. 17643, Paragraph VII-G.

Masking agents having a ligand capable of forming a chelate dye as the releasable dye described in U.S. Pat. Nos. 4,553,477, 4,555,478, 4,557,998, and 4,568,633 are also preferably used in this invention.

The graininess can be improved by using couplers forming a colored dye having a proper diffusibility together with other color-forming couplers. Specific examples of such couplers are described in U.S. Pat. No. 4,366,237 and British Patent No. 2,125,570 for magenta couplers and European Patent No. 96,570 and West German Patent Application (OLS) No. 3,234,533 for yellow, magenta, and cyan couplers.

The color-forming couplers and the specific couplers described above may form a dimer or higher polymer. Typical examples of the polymerized dye-forming couplers are described in U.S. Pat. Nos. 3,451,820, 4,080,211, and 4,455,366. Also, specific examples of the polymerized magenta couplers are described in British Patent No. 2,102,173 and U.S. Pat. Nos. 4,367,282 and 3,926,436. Furthermore, polymer couplers which are rendered water soluble described in Japanese Patent Application (OPI) Nos. 218646/85 and 28744/83 and U.S. Pat. Nos. 4,207,109 and 4,215,195 are also preferably used in this invention.

Couplers releasing photographically useful residues with coupling can be also preferably used in this invention. DIR couplers releasing a development inhibitor described in the patents cited in *Research Disclosure,* No. 17643, Paragraph VII-F are useful.

For the photographic light-sensitive materials of this invention, couplers imagewise releasing a nucleating agent or a development accelerator or a precursor thereof at development can be used. Specific examples of these couplers are described in British Patent Nos. 2,097,140 and 2,131,188. Couplers releasing a nucleating agent having an adsorption action for silver halide are particularly preferred and the specific examples of these couplers are described in Japanese Patent Application (OPI) Nos. 157638/84 and 170840/84.

As other couplers which can be used for the photographic light-sensitive materials of this invention, there are competing couplers described, e.g., in U.S. Pat. No. 4,130,427, polyequivalent couplers described, e.g., in U.S. Pat. Nos. 4,283,472, 4,338,393, and 4,310,618, DIR redox compound releasing couplers described, e.g., in Japanese Patent Application (OPI) No. 185950/85, and dye-releasing couplers which are recolored after releasing described, e.g., in European Patent Application (OPI) No. 173,302.

Furthermore, the use of bleach accelerator-releasing couplers described in Japanese Patent Application (OPI) No. 201247/86, *Research Disclosure,* No. 11449 (October, 1973), and ibid., No. 24241 (June, 1984) is particularly preferred since the desilvering step is quickened.

As inhibitors or color mixing inhibitors which may be incorporated in the photographic silver halide emulsions of this invention, there are hydroquinone derivatives, aminphenol derivatives, amines, gallic acid derivatives, catechol derivatives, ascorbic acid derivatives, non-coloring couplers, sulfonamidophenol derivatives, etc., may be used.

In this invention, a scavenger of the oxidation product of a developing agent can be used and as such scavengers are preferably hydroquinone derivatives known in the art and the compounds described in U.S. Pat. Nos. 4,474,874, 4,525,451, 4,584,264, and 4,447,523, and Japanese Patent Application (OPI) No. 5247/84 are preferably used.

For the photographic light-sensitive material of this invention, various fading preventing agents can be used. Typical examples of organic fading preventing agents are hydroquinones, 6-hydroxychromans, 5-hydroxycoumarans, spirochromans, p-alkoxyphenols, hindered phenols (such as bisphenols), gallic acid derivatives, methylenedioxybenzenes, aminophenols, hindered amines, and the ether or ester derivatives of these compounds wherein the phenolic hydroxy group thereof is silylated or alkylated. Also, metal complexes such as (bissalicylaldoxymate) nickel complexes and (bis-N,N-dialkyldithiocarbamate) nickel complexes can be used.

For preventing the reduction of yellow dye images by heat, humidity and light, the compound having both moieties of hindered amine and hindered phenol as described in U.S. Pat. No. 4,268,593 gives good results. Also, for preventing the deterioration of magenta dye images by, in particular, the action of light, the use of spiroindanes described in Japanese Patent Application (OPI) No. 159644/81, chromans substituted by a hydroquinone diether or hydroquinone monoether described in Japanese Patent Application (OPI) No. 89835/80 give preferred results.

Also, the image stabilizers described in Japanese Patent Application (OPI) No. 125732/84 are particularly useful for the stabilization of magenta images formed using pyrazolotriazole type magenta couplers.

For improving the storage stability of cyan images, in particular, the light fastness of cyan images, the use of benzotriazole series ultraviolet absorbents is preferred. The ultraviolet absorbent may be co-emulsified with cyan coupler.

The coating amount of the ultraviolet absorbent may be one sufficient for imparting light stability to cyan dye images but since of the amount is too much, unexposed portions (background portions) of the color photographic light-sensitive material are sometimes yellowed, the amount is selected in the range of preferably from $1\times10^{-4}$ mole/m$^2$ to $2\times10^{-3}$ mole/m$^2$, and particularly preferably from $5\times10^{-4}$ mole/m$^2$ to $1.5\times10^{-3}$ mole/m$^2$.

The photographic light-sensitive materials of this invention may further contain, in addition to the aforesaid additive, various stabilizers, stain preventing agent, developing agents or the precursors thereof, development accelerators or the precursors thereof, lubricants, dye mordants, matting agents, antistatic agents, plasticizers, and other various photographically useful additives. Typical examples of these additives are described in *Research Disclosure,* No. 17643 (December, 1978) and ibid., No. 18716 (November, 1979).

The couplers and relating elements for use in this invention can be introduced into photographic light-sensitive materials by various dispersion methods, such as a solid dispersion method, an alkali dispersion method, preferably a latex dispersion method, and more preferably an oil-in-water drop dispersion method.

In the oil-in-water drop dispersion method, the additives are dissolved in a high-boiling organic solvent having a boiling point of higher than 175° C. and/or a so-called auxiliary solvent having low boiling point and then the solution is finely dispersed water or an aqueous medium such as an aqueous gelatin solution in the presence of a surface active agent. Examples of the high-boiling organic solvent are described in U.S. Pat. No. 2,322,027, etc. The dispersion may be accompanied by phase transfer and if necessary, the dispersion may be coated after removing or reducing the auxiliary solvent by noodle washing or ultrafiltration.

Specific examples of the process and effect of the latex dispersion method and latexes for use in the process are described in U.S. Pat. No. 4,199,363 and West German Patent Application (OLS) Nos. 2,541,274 and 2,541,230.

As a binder or a protective colloid which can be used for the emulsion layers and other layers such as interlayers of the photographic light-sensitive materials of this invention, gelatin is advantageously used but other hydrophilic colloids can be used.

For example, there are gelatin derivatives, graft polymers of gelatin and other polymers, albumin, casein and other proteins, cellulose derivatives such as hydroxyethyl cellulose, carboxymethyl cellulose, cellulose sulfuric acid esters, etc., saccharide derivatives such as sodium alginate, starch derivatives, etc., and synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, limed gelatin as well as acid-treated gelatin and enzyme-treated gelatin as described in *Bull. Soc. Sci. Phot. Japan,* No. 16, 30 (1966) may be used and the hydrolyzed products and enzyme decomposition products of gelatin can be also used.

The photographic light-sensitive materials in this invention may contain in the photographic emulsion layers or other hydrophilic colloid layers various surface active agents for various purposes such as coating aid, static preventing, improvement of slidability, improvement of emulsified dispersibility, sticking prevention and improvement photographic characteristics (e.g., development acceleration, contrast increasing, and sensitization).

Examples of the surface active agents for use in this invention are nonionic surface active agents such as saponin, polyoxyethylene series compounds, glycidol derivatives (e.g., alkenylsuccinic acid polyglyceride, etc.), fatty acid esters of polyhydric alcohols, alkylesters of starch, urethanes, and ethers; anionic surface active agents such as triterpenoid series saponin, alkalicarboxylates, alkylbenzenesulfonates, alkylsulfuric acid esters, alkylphosphoric acid esters, N-acyl-N-alkyltaurines, sulfosuccinic acid esters, sulfoalkylpolyoxyethylene alkylphenyl ethers, etc.; amphoteric surface active agents such as amino acids, aminoalkylsulfonic acids, aminoalkylsulfuric acid esters, aminoalkylphosphoric acid esters, alkylbetains, amineimides: amineoxidies, etc.; and cationic surface active agents such as alkylamine salts, aliphatic and aromatic quaternary ammonium salts, heterocyclic quaternary ammonium salts (such as pyridimiums, imidazoliums, etc.), and phosphonium salts or sulfonium salts containing aliphatic or heterocyclic ring(s).

For the purpose of static prevention, fluorine-containing surface active agents are preferably used.

The photographic light-sensitive materials of this invention can further contain in the photographic emulsion layers and other hydrophilic colloid layers a dispersion of water insoluble or sparingly soluble synthetic polymer for improving the dimensional stability. For example, polymers composed of alkyl (meth)acrylates, glycidyl (meth)acrylates, etc., solely or as a combination thereof, or as a combination of the monomer and acrylic acid, methacrylic acid, etc., as monomer components can be used as the synthetic polymer.

The photographic light-sensitive materials of this invention may further contain in the photographic emulsion layers and other hydrophilic colloid layers an inorganic or organic hardening agent. For example, chromium salts, aldehydes (such as formaldehyde, glutaraldehyde, etc.), N-methylol compounds, active vinyl compounds (such as 1,3,5-triacryloyl-hexahydro-s-triazine, bis(vinylsulfonyl)methyl ether, etc.), active halogen compounds (e.g., 2,4-dichloro-6-hydroxy-s-triazine, etc.), and mucohalogenic acids can be used solely or as a combination thereof.

The silver halide emulsions of this invention can be used as described in Research Disclosures, Nos. 15162, 16345, 17643, and 18716.

The silver halide photographic emulsions of this invention are used for color photographic materials and black-and-white photographic materials. When the emulsion is used for, particularly high-speed photographic light-sensitive materials, and more particularly camera-film type photographic light-sensitive materials, the effect thereof is more effectively utilized.

A color photographic light-sensitive material is usually composed of a support having formed thereon a red-sensitive emulsion layer containing a cyan coupler, a green-sensitive emulsion layer containing a magenta coupler, a blue-sensitive emulsion layer containing a yellow coupler, a filter layer, an antihalation layer, interlayers, protective layers, etc.

For example, it is better to employ the functional photographic emulsion layers and layer structures as described in Japanese Patent Publication No. 34932/80 and Japanese Patent Application No. 25287/87. Also, by properly combining the kinds of couplers and spectral sensitivity distributions, the silver halide emulsions of this invention can be used for color print photographic materials, False color photographic materials, and color recording materials using digital type scanning exposure Furthermore, the photographic light-sensitive materials in this invention can be used in the layer structures described in Japanese Patent Application (OPI) No. 35352/87 and Japanese Patent Application Nos. 127437/87 and 37797/87.

Black-and-white photographic materials in this invention are useful as black-and-white photographic papers, camera film type photographic light-sensitive materials, restraining light-sensitive materials, etc. In these cases, one or plural light-sensitive emulsion layers may be formed on a support as described in Japanese Patent Application No. 202549/86 and also a protective layer, an interlayer, an antihalation layer, a filter layer, etc., may be formed.

In the silver halide photographic materials in this invention, the photographic emulsion layers or other layers may be colored by dyes for absorbing light of a specific wavelength region, that is for preventing halation and irradiation and for controlling the spectral composition of light entering the photographic emulsion layer by forming thereto a filter layer. In a both-surface coated film such as direct medical X-ray film, a layer for crossover cutting may be formed under each emulsion layer.

Examples of such dyes are oxonol dyes having a pyrazolone nucleus or a barbituric acid nucleus, azo dyes, azomethine dyes, anthraquinone dyes, arylidene dyes, styryl dyes, triarylmethane dyes, merocyanine dyes, and cyanine dyes.

Specific examples of the dyes which are used for the aforesaid purposes are illustrated below but the invention is not limited to them.

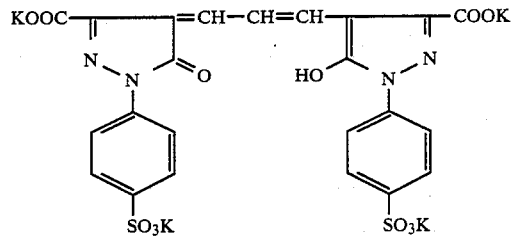

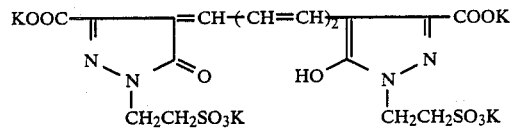

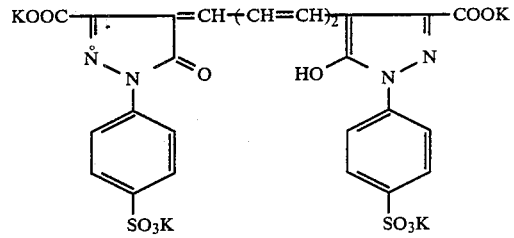

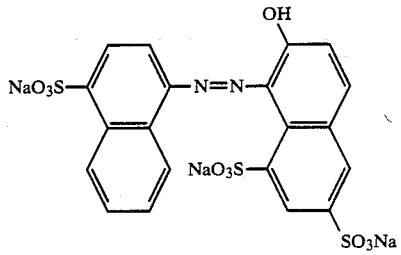

It is an effective technique in the case of using dyes to mordant a specific layer in a photographic material with an anion dye using a polymer having a cation site.

As a polymer providing a cation site, an anion-conversion polymer is preferred. As the anion conversion polymer, various quaternary ammonium salt (or phosphonium salt) polymers can be used. Such quaternary ammonium salt (or phosphonium salt)polymers are widely used as mordant polymers and antistatic polymers.

Furthermore, for preventing the aforesaid polymer from moving from a definite layer to other layer(s) or processing liquid to give photographically undesirable effects thereto, the polymer is copolymerized with a monomer having at least 2 (preferably 2 to 4) of ethylenically unsaturated groups and the polymer is preferably used as an aqueous crosslinked polymer latex.

Specific examples of the polymers are as follows.

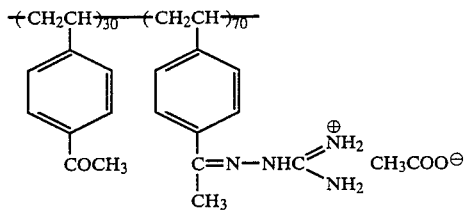

(1)

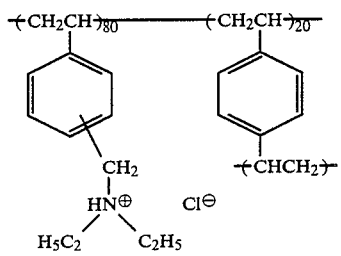

(2)

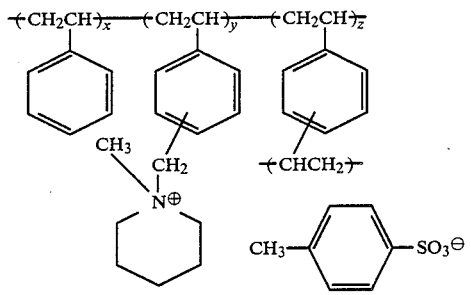

(3)

x:y:z = 47.5:47.5:5

For exposing the photographic light-sensitive materials using the silver halide emulsions of this invention, various exposure means which are used for other light-sensitive materials can be used. However, as compared to conventional photographic light-sensitive materials, the photographic materials of this invention have less deviation of development progress and gradation obtained according to the light exposure condition and can provide excellent finished image quality.

For the photographic light-sensitive materials, an optional light source emitting a radiation corresponding to the sensitive wavelengths of the light-sensitive materials can be used as a light source of light exposure or for writing. Natural light (sun light), an incandescent lamp, a halogen lamp, a mercury lamp, a fluorescent lamp, and a flask light source such as an electronic flash and metal combustion flash bulb are general. Gas, dye solution or semiconductor laser emitting light in the wavelength regions from ultraviolet region to infrared region, a light emitting diode, and a plasma light source can be used as a light source for recording.

Also, a light exposure means composed of a combination of a line or plane light source and a microshatter array utilizing a fluorescent plane (CRT, etc.) emitted from fluorescent substances excited by electron beams, a liquid crystal (LCD), or lanthanum-doped lead titanzirconate (PLZT) can be used. If necessary, the spectral distribution of light for exposure can be controlled by using a color filter.

The silver halide photographic emulsion of this invention is a photographic emulsion containing silver halide grains wherein not only the development initiating sites and the number of the sites are controlled but also the development initiating times are controlled. Thus, by constituting one image-forming layer with plural layers, for example, constituting a green-sensitive emulsion layer of a color negative photographic material with 2 to 4 layers using the silver halide photographic emulsions each having a different sensitivity, the utilization efficiency of silver halide, such as the reduction of silver amount, etc., as well as the graininess and image sharpness can be improved.

Then, processing of the color photographic materials or black-and-white photographic materials using the silver halide photographic emulsions of this invention is explained.

A color developer which is used for developing the color photographic material of this invention is an alkaline solution containing an aromatic primary am oping agent as the main component.

As the aromatic primary amine color developing agent, aminophenolic compounds are useful but usually p-phenylenediamine series compounds are suitable and examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and the sulfates, hydrochlorides, phosphates, p-toluenesulfonates, tetraphenylborates, and p-(t-octyl)benzenesulfonates of them.

From the view point of quick processing which is an object of this invention, a developing agent showing particularly high developing speed for the silver halide emulsions of this invention and causing less deviation of development activity in low-replenisher processing is preferably used.

Practical examples of such a developing agent are those shown by formula (XXI), such as 3-methyl-4-amino-N-ethyl-N-β-hydroxyethylaniline.

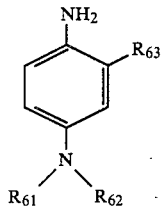

(XXI)

wherein $R_{61}$ represents a hydrogen atom, an alkyl group having, preferably from 1 to 6 carbon atoms, or $R_{62}$; $R_{62}$ represents $-(R_{64}O)_m-(R_{65}O)_n-R_{66}$ (wherein $R_{64}$ and $R_{65}$, which may be the same or different, each represents an alkylene group having, preferably 1 to 4 carbon atoms); m and n each represents an integer of 0 to 4 with the exclusion that m and n are simultaneously 0; and $R_{66}$ represents a hydrogen atom, an aryl group having, preferably 6 to 8 carbon atoms, or an alkyl group having, preferably 1 to 6 carbon atoms; and $R_{63}$ represents a hydrogen atom, a halogen atom, an alkyl group, a hydroxy group, an alkoxy group, an alkylsulfonamido group, an acylamido group, or an amino group. The groups shown by $R_{63}$ preferably have from 1 to 4 carbon atoms.

The color developing agent is used in the range of from 1 g to 30 g, preferably from 2 g to 20 g, and particularly preferably from 3 g to 10 g per liter of the color developer.

The color developing agents shown by formula (XXI) described above are usually used solely but, if necessary, can be used as a combination of them or a combination thereof and other developing agents. For example, there are a combination of 3-methyl-4-amino-N-ethyl-N-β-hydroxyethylaniline and 3-ethyl-4-amino-N-β-methanesulfonamidoethylaniline and a combination of 3-methyl-4-amino-N-ethyl-N-β-methoxyethylaniline and 3-methyl-4-amino-N-ethyl-N-β-methanesulfonamidoethylaniline.

The color developer preferably contains a pH buffer such as carbonates, borates, or phosphates of an alkali metal; a development inhibitor or an antifoggant such as chlorides, bromides, iodides, benzimidazoles, benzothiazoles, and mercapto compounds; a preservative such as hydroxyamine, diethylhydroxylamine, triethanolamine, the compounds described in West German Patent Application (OLS) No. 2,622,950, the compounds described in Japanese Patent Application No. 265149/86, sulfites and hydrogensulfites; and/or a restoring agent or a capturing agent of the oxidation product of the color developing agent described in Japanese Patent Application No. 259799/86.

The color developers for use in this invention may further contain an organic solvent such as diethylene glycol; a development accelerator such as benzyl alcohol, polyethylene glycol, quaternary ammonium salts, amines, thiocyanates, 3,6-thiaoctane-1,8-diol, etc.; competing couplers, an auxiliary developing agent such as 1-phenyl-3-pyrazolidone; tackifiers; and chelating agents such as aminopolycarboxylic acids (e.g., ethylenediaminetetraacetic acid, nitrilotriacetic acid, cyclohexanediaminetetraacetic acid, iminodiacetic acid, hydroxyethyliminodiacetic acid, N-hydroxymethylethylenediaminetriacetic acid, diethylenetriaminepentaacetic acid, triethylenetetraminehexaacetic acid, and the compounds described in Japanese Patent Application (OPI) No. 195845/83), 1-hydroxyethylidene-1,1'-diphosphonic acid, the organic phosphonic acids described in *Research Disclosure,* No. 18170 (May, 1979), aminophosphonic acids such as aminotris(methylenephosphonic acid)ethylenediamine-N,N,N',N'-tetramethylenephosphonic acid, etc., and the phosphonocarboxylic acids described in Japanese Patent Application (OPI) Nos. 102726/77, 42730/78, 121127/79, 4024/80, 4025/80, 126241/80, 65955/80, and 65956/80, and *Research Disclosure,* No. 18710 (May, 1979).

The pH of the color developer is in the range of from 8 to 13, preferably from 9 to 12, and particularly preferably from 9.5 to 11.5. Also, the processing temperature is usually in the range of from 25° C. to 50° C., preferably for quick processing from 30° C. to 50° C., and particularly preferably from 35° C. to 45° C.

At the processing of the photographic light-sensitive materials of this invention, the color developer contains preferably from $1\times10^{-3}$ mole/liter to $2\times10^{-1}$ mole/liter, and particularly preferably from $5\times10^{-3}$ mole/liter to $5\times10^{-2}$ mole/liter of a water-soluble chloride. As the water-soluble chloride, potassium chloride, and sodium chloride each can be preferably used.

In the case of continuously processing the photographic light-sensitive materials of this invention, the color developer may be continuously used while supplying replenisher and in this case, the amount of the replenisher is preferably from 1 ml to 10 ml per 100 $cm^2$ of the light-sensitive material. Also, for preventing the formation of fog, the color developer preferably contains a water-soluble bromide in an amount of from $3\times10^{-3}$ mole/liter to $3\times10^{-2}$ mole/liter and as such a water soluble bromide, potassium bromide or sodium bromide is preferably used.

In the development process in this invention, it is preferred that a color developer substantially not containing iodide ions is preferred. The term "substantially not containing" means an iodide ion content of less than 1.0 mg/liter.

Also, in this invention, it is preferred that the color developer does not contain a sulfite if the color developer can prevent air oxidation and keep the preservability. The content of an anhydrous sulfite is preferably less than 4 g per liter of the color developer and more preferably less than 2 g per liter. By reducing the content of the sulfite less than 1 g, the increase of the colored dye density is obtained.

The processing time by the color developer is from 10 seconds to 3 minutes, preferably from 10 seconds to 2 minutes, and particularly preferably from 20 seconds to 90 seconds.

The photographic light-sensitive materials of this invention are subjected to desilvering processing after color development.

The desilvering process can be performed by a process of using a bleach solution and fix solution in two baths, a process of using a bleach solution and a blix solution in two baths are described in Japanese Patent Application (OPI) No. 75352/86, a process of using a fix solution and a blix solution in two baths as described in Japanese Patent Application (OPI) No. 51143/86, and a process of performing by a one bath of blix solution. In this case, however, it is preferred that the photographic materials of this invention are processed by a blix solution in a single tank or plural tanks in regard to the blix process for simple and quick processing.

As the bleaching agent which is used for the bleach solution or the blix solution, ferric salts, persulfates, bichromates, bromates, ferricyanates, aminopolycarboxylic acid ferric complex salts, etc., can be used and in regard to the photographic light-sensitive materials of this invention, it is preferred to use aminopolycarboxylic acid ferric complex salts.

Then, preferred examples of an aminopolycarboxylic acid ferric complex salts are illustrated below:

(1) Ethylenediaminetetraacetic acid ferric complex salt
(2) Diethylenetriaminepentaacetic acid ferric complex salt
(3) Cyclohexanediaminetetraacetic acid ferric complex salt
(4) Iminodiacetic acid ferric complex salt
(5) Methyliminodiacetic acid ferric complex salt
(6) 1,3-Diaminopropanetetraacetic acid ferric complex salt
(7) Glycol ether diaminetetraacetic acid ferric complex salt.

The aforesaid aminopolycarboxylic acid ferric complex salts are usually used in the form of the sodium salt, potassium salt, and ammonium salt thereof and it is particularly preferred to use in the form of the ammonium salt.

The concentration of the aminopolycarboxylic acid ferric salt in the bleach solution or blix solution is preferably from 0.05 to 1 mole/liter, preferably from 0.1 to 1 mole/liter, and particularly preferably from 0.1 to 0.5 mole/liter.

Also, for the bleach solution or blix solution, a bleach accelerator can be used if necessary. Specific examples of the useful bleach accelerator are the rehalogenating agents such as the compounds having a mercapto group or a disulfide group described in U.S. Pat. No. 3,893,858, West German Patent No. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78, 28426/78, and *Research Disclosure,* No. 17129 (July, 1978), chlorides (e.g., potassium chloride, sodium chloride, ammonium chloride, etc.), or iodides (e.g., ammonium iodide).

If necessary, a corrosion inhibitor such as one or more inorganic or organic acids having a pH buffer action, such as boric acid, borax, sodium metaborate, acetic acid, sodium acetate, sodium carbonate, potassium carbonate, phoshosphate, citric phorous acid, phosphoric acid, sodium phosphate, citric acid, sodium citrate, tartaric acid, etc., or the alkali metal salts or ammonium salts thereof, or ammonium nitrate, guanidine, etc., can be added to the bleach solution or blix solution.

As a fixing agent which is used for the blix solution or a fix solution, there are thiosulfates such as sodium thiosulfate, ammonium thiosulfate, etc.; thiocyanates such as sodium thiocyanate, ammonium thiocyanate, etc.; water-soluble silver halide solvents such as thioether compounds (e.g., ethylenebisthioglycolic acid, 3,6-dithia-1,8-octanediol, etc., and thioureas; thiazolidine derivatives described in Japanese Patent Application (OPI) No. 140129/85; thiourea derivatives described in Japanese Patent Publication No. 8506/70 and Japanese Patent Application (OPI) Nos. 20832/77 and 32735/78, and U.S. Pat. No. 3,706,561; iodides described in West German Patent No. 1,127,715 and Japanese Patent Application (OPI) No. 16235/83; polyethylene oxides described in West German Patent Nos. 966,410 and 2,748,430; polyamine compounds described in Japanese Patent Publication No. 8836/70, the compounds described in Japanese Patent Application (OPI) Nos. 42434/74, 59644/74, 94927/78, 35727/79, 26506/80, and 163940/83, and iodide ions and bromide ions. In these compounds, the compounds having a mercapto group or a disulfide group are preferred from the view point of giving large acceleration effect and the compounds described in U.S. Pat. No. 3,893,858, West German Patent No. 1,290,812, and Japanese Patent Application (OPI) No. 95630/78 are particularly preferred.

Furthermore, the bleach solution or blix solution can contain bromides such as potassium bromide and sodium bromide solely or as a mixture thereof.

In this invention, the use of thiosulfates, in particular, ammonium thiosulfate is preferred.

The amount of the fixing agent is preferably from 0.3 mole/liter to 2 mole/liter, and particularly preferably from 0.8 mole/liter to 1.5 mole/liter.

The pH range of the blix solution or fix solution is preferably from 3 to 10, and more preferably from 5 to 9. If the pH range is lower than the aforesaid value, the desilvering property is improved but the deterioration of the liquid and the leuco formation of cyan dyes is accelerated. On the other hand, if the pH value is higher than the aforesaid value, the desilvering is delayed and stains are liable to form. Also, the pH value of the bleach solution is from 4 to 7, and preferably from 4.5 to 6.5. If the pH of the bleach solution is less than 4, the leuco formation of cyan dyes is accelerated and if the pH is higher than 7, desilvering begins to delay.

If necessary, for controlling pH of the aforesaid solutions, hydrochloric acid, sulfuric acid, nitric acid, acetic acid, hydrogencarbonates, ammonia, potassium hydroxide, sodium hydroxide, sodium carbonate, potassium carbonate, etc., may be added thereto.

The blix solution or the fix solution contains a sulfite ion releasing compound such as sulfites (e.g., sodium sulfite, potassium sulfite, ammonium sulfite, etc.), hydrogensulfites (e.g., ammonium hydrogensulfite, sodium hydrogensulfite, potassium hydrogensulfite, etc.), and metahydrogensulfites (e.g., potassium metahydrogensulfite, sodium metahydrogensulfite, ammonium metahydrogensulfite, etc.). Such a compound is contained in an amount (calculated as sulfite ions) of preferably from about 0.02 to 0.50 mole/liter, and more preferably from 0.04 to 0.40 mole/liter.

As the preservative, the use of a sulfite is general but other compounds such as ascorbic acid, carbonylhydrogensulfite addition products, and carbonyl compounds can be used.

The temperature of the desilvering process is preferably high as long as excessive softening of gelatin layers and the deterioration of the processing solution do not occur. The practical temperature thereof is usually in the range of from 30° C. to 50° C. Also, the time for the desilvering process may be differ to some extent according to the desilvering process employed but is usually not longer than 4 minutes, and preferably from 30 seconds to 3 minutes.

After the desilvering process such as fixing or blixing, the photographic light-sensitive materials of this invention are generally subjected wash and/or stabilization.

The amount of wash water in the washing step can be selected in a wide range according to the characteristics of the photographic light-sensitive materials (e.g., by the elements used therein, such as couplers, etc.), uses thereof, the temperature of wash water, the number (stage number) of washing tanks, the replenishing system such as countercurrent system, normal current system, etc., and other various conditions.

Among them, the relation between the number of washing tanks and the amount of wash water in a multistage countercurrent system can be obtained by the method described in *Journal of the Society of Motion Picture Television Engineers,* Vol. 64, 248–253 (May, 1955). Usually, the stage number in a multistage countercurrent system is from 2 to 6, and preferably from 2 to 4.

According to the multistage countercurrent system, the amount of wash water can be greatly reduced and, for example, the amount may be from 0.5 liter to 1 liter per square meter of light-sensitive material.

By the increase of the residence time of water in tank, there occur problems such as the growth of bacteria and attaching of floating matters formed to the light-sensitive materials. In processing of the color photographic materials of this invention, a method of reducing calcium and magnesium as described in Japanese Patent Application No. 131632/86 can be very effectively used as a means for solving the aforesaid problems.

Also, isothiazolone compounds described in Japanese Patent Application (OPI) No. 8542/82, thiabenzazoles, chlorine series sterilizers such as chlorinated sodium isocyanurate described in Japanese Patent Application (OPI) No. 120145/86, benzotriazole described in Japanese Patent Application No. 105487/85, and other sterilizers described in Hiroshi Horiguchi, *Bokin Bobai no Kagaku* (*Antibacterial and Antifungal Chemistry*), *Biseibutsu no Mekkin, Sakkin, Bobai Gijutsu* (*Sterilizing, Antibacterial and Antifungal Technique of Microorganisms*), edited by Eisei Gijutsu Kai, and *Bokin Bobai Zai Jiten* (*Handbook of Antibacterial and Antifungal Agents*), edited by Nippon Bokin Bobai Gakkai.

Furthermore, wash water can further contain a surface active agent as photo-wetting agent and a chelating agent such as EDTA as water softener.

The pH of wash water in processing of the photographic light-sensitive materials of this invention is from 4 to 9, and preferably from 5 to 8. The washing temperature and washing time can be variously selected according to the characteristics and uses of the photographic materials but are generally at from 15° to 45° C. and for from 20 seconds to 10 minutes, and preferably at from 25° C. to 40° C. and for from 30 seconds to 5 minutes.

The photographic light-sensitive materials can be processed by a stabilizer after aforesaid washing step or without applying with the washing step. The stabilizer for use contains a compound having an image stabilizing function and examples of the compound are aldehyde compounds such as formalin, etc., buffers for controlling the layer pH suitable for dye stabilization, and ammonium compounds. Also, for preventing the growing bacteria in the stabilizer and for imparting antifungal property to the photographic materials after processing, the aforesaid various antibacterial of antifungal agents can be used.

Moreover, the stabilizers in this invention can contain surface active agents, optical whitening agents, and hardening agents.

In the case of performing the stabilization step in processing of the photographic materials of this invention without applying washing step, any known methods described in Japanese Patent Application (OPI) Nos. 8543/82, 14834/83, 184343/84, 220345/85, 238823/85, 239784/85, 239749/85, 4054/86, and 118749/86 can be used.

In other preferred embodiment, 1-hydroxyethylene-1,1-disulfonic acid, ethylenediaminetetramethylenephosphonic acid, or other chelating agents, and bismuth compounds can be used for the stabilizer.

The solution used for washing step and/or the stabilization step can be used for the previous step. In an example, the overflow solution of wash water that amount of which was reduced by a multistage countercurrent system is introduced into a blix bath which is a pre-bath and a concentrated replenisher is supplied to the blix bath, wherein the amount of waste solution can be reduced.

In the case of processing a large amount of photographic light-sensitive materials of this invention, it is preferred to applying continuous processing. In the case of disk-form films, the exposed photographic materials are placed in a definite bath, wherein a color development, blix, washing and stabilization can be successively applied but in the case of roll-form photographic films and color photographic papers, it is preferred to employ a system of successively transferring the light-sensitive material through these processing baths. For the transferring system, there are a guide film system, a roller transferring system and rack-introducing system, etc.

In the case of continuously processing a long photographic light-sensitive material, a processing solution is supplied to a processing bath, a consumed components by the processing are replenished, and harmful matters accumulated in the processing solution by the dissolved components from the photographic materials are removed. Also, it is preferred to correct the change of the composition of the developer by air oxidation.

It has been attempted to reduce the amount of the waste solution by reducing the amount of the replenisher. In particular, the overflow liquids of wash water and the stabilizer are utilized as described above and further the overflow liquid from a developer can be utilized in a blix solution.

The processing time from the initiation of the development to the finish of drying in this invention can be reduced to from about 1 minutes to 5 minutes, preferably from 1 minutes to 3.5 minutes, and more preferably within 120 seconds.

For photographic processing of the black-and-white photographic materials of this invention, any known process can be used. The processing solution having any known composition can be used. The processing temperature is usually selected from 18° C. to 50° C. but may be lower than 18° C. or may be over 50° C. as the case may be.

More practically, the black-and-white photographic light-sensitive materials of this invention can be processed by the processes described in *Research Disclosure,* Vol. 176, No. 17643, pages 28–29, and ibid., Vol. 187, No. 18716, page 651, left and right columns.

For the black-and-white developer, dihydroxybenzenes (e.g., hydroquinone), 3-pyrazolidones (e.g., 1-phenyl-3-pyrazolidone), aminophenols (e.g., N-methyl-p-aminophenol), etc., can be used solely or as a combination thereof.

Then, the invention is described more practically by the following examples but the invention is not limited to them.

EXAMPLE 1

The preparation methods for silver halide emulsions A and C of this invention are explained in the comparison with silver halide emulsions B, D, and E (comparison examples) and the features such as the sensitivity, the development progressing property, etc., of the emulsions of this invention are explained.

Preparation of Emulsion A

To 1 liter of water were added 0.05 g of potassium iodide, 30 g of gelatin and 2.5 ml of an aqueous solution of 5% thioether, $HO(CH_2)_2S(CH_2)_2S(CH_2)_2OH$ and while keeping the mixture at 75° C., an aqueous solution of 8.33 g of silver nitrate and an aqueous solution containing 5.94 g of potassium bromide and 0.726 g of potassium iodide were added to the mixture by a double jet method with stirring over a period of 45 seconds. Then, after adding thereto 2.5 g of potassium bromide, an aqueous solution of 8.33 g of silver nitrate was added to the mixture over a period of 7 minutes and 30 seconds so that the flow rate at the end of the addition became twice that at the beginning of the addition. Then, an aqueous solution of 153.34 g of silver nitrate and an aqueous solution of potassium bromide were added thereto by a controlled double jet method while keeping the potential at pAg 8.1 over a period of 25 minutes. In this case, the flow rate was accelerated to that the flow rate at the end of the addition became 8 times the flow rate at the initiation of the addition. After finishing the addition, 15 ml of an aqueous solution of 2N potassium thiocyanate was added thereto and further 50 ml of an aqueous solution of 1% potassium iodide was added to the mixture. Thereafter, the temperature of the system was lowered to 35° C., after removing soluble salts by sedimentation, the temperature was raised to 40° C., 68 g of gelatin, 2 g of phenol, and 7.5 g of trimethylolpropane were added to the mixture, and the pH and pAg were adjusted to 6.40 and 8.45, respectively, with sodium hydroxide and potassium bromide. Then, after raising the temperature thereof to 56° C., 735 mg (corresponding to 120% of the saturated adsorption amount for the (111) faces) of CR-compound (8) in this invention was added to the mixture. After 10 minutes since then, 8.2 mg of sodium thiosulfate, 163 mg of potassium thiocyanate, and 5.4 mg of chloroauric acid were added to the mixture and after 5 minutes, the mixture was quickly cooled to be caked.

The silver halide emulsion thus obtained contained silver halide grains wherein 93% of the total sum of the projected areas of the whole grains were composed of silver halide grains having an aspect ratio of at least 3 and also on all the silver halide grains having an aspect ratio of at least 2, the diameter of the mean projected area was 0.83 μm, the mean thickness was 0.161 μm, and the mean aspect ratio was 6.15.

Preparation of Emulsion B

By following the same procedure as the case of preparing Emulsion A except that the addition amount of CR-compound of this invention before the chemical sensitization was changed to 200 mg and 535 mg of CR-compound (8) was added as sensitizing dye after the chemical sensitization, Emulsion B was prepared.

Preparation of Emulsion C

By following the same procedure as the case of preparing Emulsion A except that the addition of an aqueous solution of potassium thiocyanate after finishing the addition of the aqueous silver salt solution and the aqueous halide solution by controlled double jet method was omitted, Emulsion C was prepared.

Preparation of Emulsion D

The same procedure as the case of preparing Emulsion A was followed until the step of adjusting pH and pAg to 6.4 and 8.45, respectively. Thereafter, the temperature of the mixture was raised to 56° C. and then sodium thiosulfate and chloroauric acid were added thereto in the amounts same as the case of preparing Emulsion A. Since after 5 minutes, the sensitivity was scarcely increased, the emulsion obtained was kept at 56° C. for 100 minutes so that the ratio of sensitivity/fog became optimum. Thereafter, 735 mg of the sensitizing dye as used in Emulsion A (i.e., having the same chemical structure as CR-compound (8)) was added to the emulsion at 56° C. and after 10 minutes since then, the emulsion was quickly cooled to be caked.

Preparation of Emulsion E

By following the same procedure as the case of preparing Emulsion 3 in the example showing the characteristics of the tabular silver halide grains described in Japanese Patent Application (OPI) No. 113926/83 (page 39), the silver halide emulsion same as Emulsion 3 was prepared. The emulsion obtained had a diameter of the mean projected area of 1.35 μm, a thickness of 0.08 μm, and a mean aspect ratio of 16.9. To the emulsion was applied the chemical sensitization for Emulsion 3 described in Table XIX of the aforesaid patent application (OPI).

Preparation of Coating Composition of Emulsion

By adding the following chemicals to each of Emulsions A to E prepared above per mole of silver halide, each coating composition of emulsion was prepared.

| | |
|---|---|
| 4-Hydroxy-6-methyl-1,3,3a,7-tetraazaindene | 1.94 g |
| 2,6-Bis(hydroxylamino)-4-diethylamino-1,3,5-triazine | 80 mg |
| Sodium polyacrylate (mean molecular weight: 41,000) | 4.0 g |

Preparation of Coating Composition for Surface Protective Layer

For forming a surface protective layer, an aqueous solution of gelatin containing, further, dextran having a mean molecular weight of 40,000, fine particles of polymethyl methacrylate (mean particle size of 3.0 μm), polyethylene oxide, and sodium polyacrylate having a mean molecular weight of 41,000 was used.

Preparation of Samples 1 to 5

Each coating composition of Emulsions A to E and the aforesaid coating composition for surface protective layer were coated on one surface of a polyethylene terephthalate film support by a simultaneously coating method and dried to provide each of Samples 1 to 5.

The coating amount of silver in each sample was 3.3 g/m$^2$, and the coating amounts of gelatin and dextran in the surface protective layer were 0.8 g/m$^2$ and 0.8 g/m$^2$, respectively. At coating, 8 millimoles/100 g-gelatin of 1,2-bis(sulfonylacetamido)ethane was added to each emulsion layer as a hardening agent.

Confirmation of Development Initiation Points

After applying sufficient light exposure to each of Samples 1 to 5, the same was dipped in developer (I) having the composition shown below at 35° C., was immediately taken out therefrom, and after one second, was dipped in an aqueous acetic acid solution.

| Developer (I) | |
|---|---|
| 1-Phenol-3-pyrazolidine | 1.5 g |
| Hydroquinone | 30 g |
| 5-Nitroindazole | 0.25 g |
| Potassium Bromide | 3.0 g |
| Anhydrous Sodium Sulfite | 50 g |
| Potassium Hydroxide | 30 g |
| Boric Acid | 10 g |
| Glutaraldehyde | 5 g |
| Water to make (pH adjusted to 10.2) | 1 liter |

Figure 2:
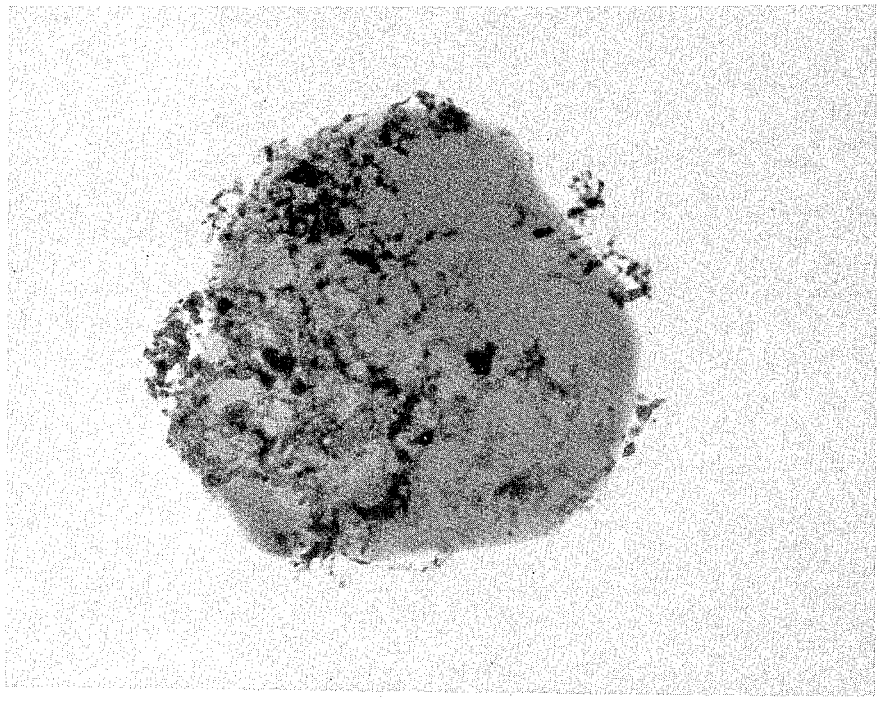
Figure 3:
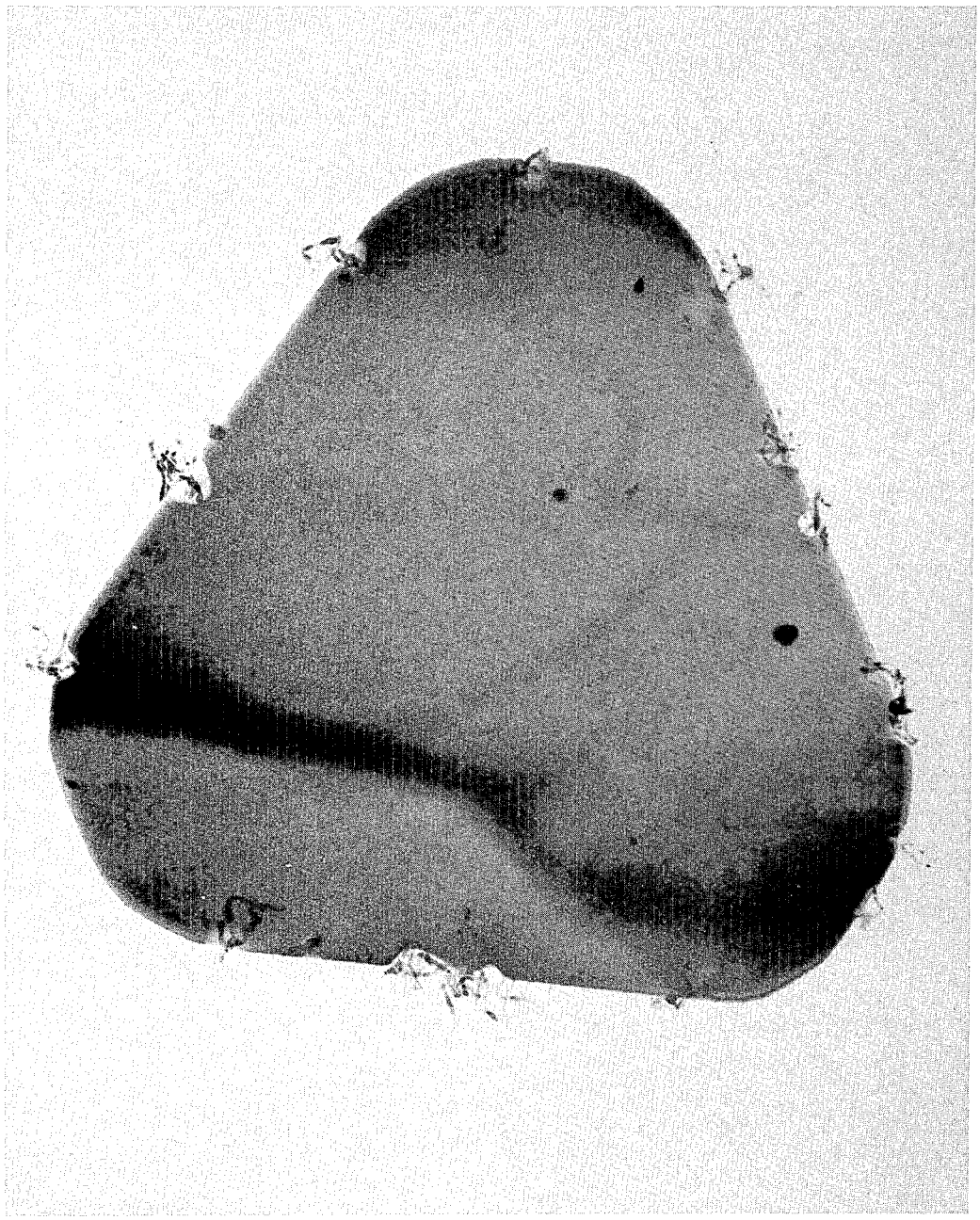

After drying each sample in the dark, the silver halide grains were isolated with a solution of a gelatin decomposition enzyme and subjected to a centrifugal separation treatment to provide each sample for electromicroscopic observation. Each sample was directly observed by a transmission type electron microscope of 200 KV at −160° C. Electron microphotographs of the silver halide grains in the thus processed Samples 1, 4, and 5 are shown in FIGS. 1, 2, and 3, respectively.

The observation results are shown in Table 1 below.

TABLE 1

| Sample | Emulsion | Mean Grain Size (μm) | Thickness (μm) | Ratio (by number) of (CDG + EDG) to the total silver halide grains in the emulsion | Ratio (by number) of CDG to the total silver halide grains in the emulsion | Ratio (by projected area) of (CDG + EDG) to the total silver halide grains in the emulsion |
|---|---|---|---|---|---|---|
| 1 | A | 0.83 | 0.161 | >90% | 16% | >90% |
| 2* | B | " | " | 35% | <1% | 35% |
| 3 | C | " | " | 65% | 7% | 65% |
| 4* | D | " | " | 32% | <1% | 30% |
| 5* | E | 1.35 | 0.08 | 48% | 2% | 45% |

*Comparison

Evaluation of Photographic Properties and Development Progressing Property

After applying a light exposure of 1/10 second to each of Photographic Materials 1 to 5 by green light, each sample was developed by Developer (I) for 8 seconds, 16 seconds, or 24 seconds at 35° C., fixed, washed and then dried.

The sensitivity is shown by the reciprocal of the exposure amount giving a density of fog+1.0 and the gradation is shown by the inclination of a straight line connecting a density point of fog+0.25 and a density point of fog+2.0 in the case of taking the exposure amount on abscissa in logarithmic scale. As the standard sensitivity, the sensitivity of Sample 5 developed for 24 seconds was defined as 100.

The evaluation results obtained are shown in Table 2 below.

TABLE 2

| | | Sample 1 | 2 | 3 | 4 | 5 |
|---|---|---|---|---|---|---|
| Sensitivity | 8" | 75 | 28 | 55 | 21 | 52 |
| | 16" | 94 | 50 | 78 | 38 | 83 |
| | 24" | 105 | 67 | 90 | 48 | 100 |
| Contrast | 8" | 2.80 | 2.0 | 2.75 | 1.8 | 2.2 |
| | 16" | 2.85 | 2.45 | 2.83 | 2.46 | 2.55 |
| | 24" | 2.85 | 2.7 | 2.85 | 2.68 | 2.60 |
| Covering power at Dm part upon 24"-development | | 1.06 | 0.95 | 1.02 | 0.88 | 0.97 |

From the results shown in Table 1 and Table 2 above, it can be seen that when the development initiation points are disposed near the corners and the edges of silver halide grains (Samples 1 and 3), the development progressing rate is remarkably high and the gradation is quickly completed as compared to comparison samples 2, 3, and 5 as well as the samples 1 and 3 of this invention having very fine silver halide grain sizes show high sensitivity (high speed) as compared with comparison samples 2 and 4 having the same fine particle sizes and also almost similar high sensitivity to that of comparison sample 5 having large silver halide grain sizes.

Also, it can be seen from the comparison of Samples 1 to 4 containing the emulsions having a same aspect ratio that Samples 1 and 3 of this invention have high covering power as compared with Comparison Samples 2 and 4.

EXAMPLE 2

Preparation of Emulsions F and G

After adding ammonia to an aqueous gelatin solution kept at 60° C. with stirring, an aqueous solution of silver nitrate and an aqueous solution of potassium bromide were simultaneously added thereto while keeping pAg at 8.9.

The emulsion obtained was a monodispersed pure silver bromide emulsion having octahedral tabular grains of about 0.85 μm.

Then, the emulsion was washed and desalted by a flocculation method according to an ordinary manner and thereafter, pH and pAg thereof were adjusted to 6.5 and 8.7, respectively.

The emulsion was divided into two portions.

One of them was heated to 60° C., 2.0 mg of sodium thiosulfate, 3.6 mg of chloroauric acid, and 80 mg of potassium thiocyanate were successively added to the emulsion per mole of silver halide followed by ripening for 40 minutes, and after adding thereto 350 mg of ribonucleic acid, the temperature was lowered to 40° C. (Emulsion F)

The other emulsion was heated to 60° C., 250 mg of ribonucleic acid was added to the emulsion per mole of silver halide, and then 8.0 mg of sodium thiosulfate was added thereto. After 5 minutes since then, 3.6 mg of chloroauric acid and 80 mg of potassium thiocyanate were added to the emulsion followed by ripening for 5 minutes, and the 100 mg of ribonucleic acid was added thereto followed by lowering the temperature to 40° C. (Emulsion G)

After adding a stabilizer (4-hydroxy-6-methyl(1,3-,3a,7)tetraazaindene), a coating aid (sodium dodecylbenzenesulfonate), and a gelatin hardening agent (2,4-dichloro-6-hydroxy-s-triazine sodium) to each of the emulsions and the emulsion was coated on a cellulose acetate film support together with a surface protective layer by a simultaneous extrusion method to provide Samples 6 and 7.

Each of the samples was light-exposed through an optical wedge for 1/100 second, developed of developer D-19 (trade name, made by Eastman Kodak Company) for 10 minutes at 20° C., stopped and fixed.

The photographic properties of each sample were measured and the results obtained are shown in Table 3.

In addition, the relative sensitivity was shown by the relative value of the reciprocal of the exposure amount required for obtaining an optical density of fog +0.5, that of Sample 6 being defined as 100.

TABLE 3

| Sample | Emulsion | Mean Grain Size (μm) | Ratio (by number) of (CDG + EDG) to the total silver halide grains in the emulsion | Ratio (by projected area) of (CED + EDG) to the total silver halide grains in the emulsion | Relative Sensitivity | γ |
|---|---|---|---|---|---|---|
| 6 | F | 0.85 | 18% | 18% | 100 | 1.15 |
| 7 | G | " | 85% | 90% | 127 | 1.30 |

The development centers of Samples 6 and 7 were observed as follows.

An exposure amount of large than the exposure amount giving a density of fog+0.5 by 1.5 as ΔlogE was uniformly given to each sample. Then, the sample was developed by a diluted developer having the composition shown below for 10 minutes at 20° C. and the silver halide grains were isolated from each sample using pronaze enzyme. Thereafter, a fine amount of the grains were placed on a micro mesh of electron microscope, carbon was vapor-deposited thereon in vacuo, the assembly was fixed in a fix solution to form a carbon replica, and the replica was observed by electron microscope.

| Developer for Observing Development Centers | |
|---|---|
| Metol | 0.45 g |
| Ascorbic Acid | 3.0 g |
| Borax | 5.0 g |
| Potassium Bromide | 1.0 g |
| Cetyl-trimethylammonium Chloride | 0.2 g |
| Water to make | 1.0 liter |

Figure 4:
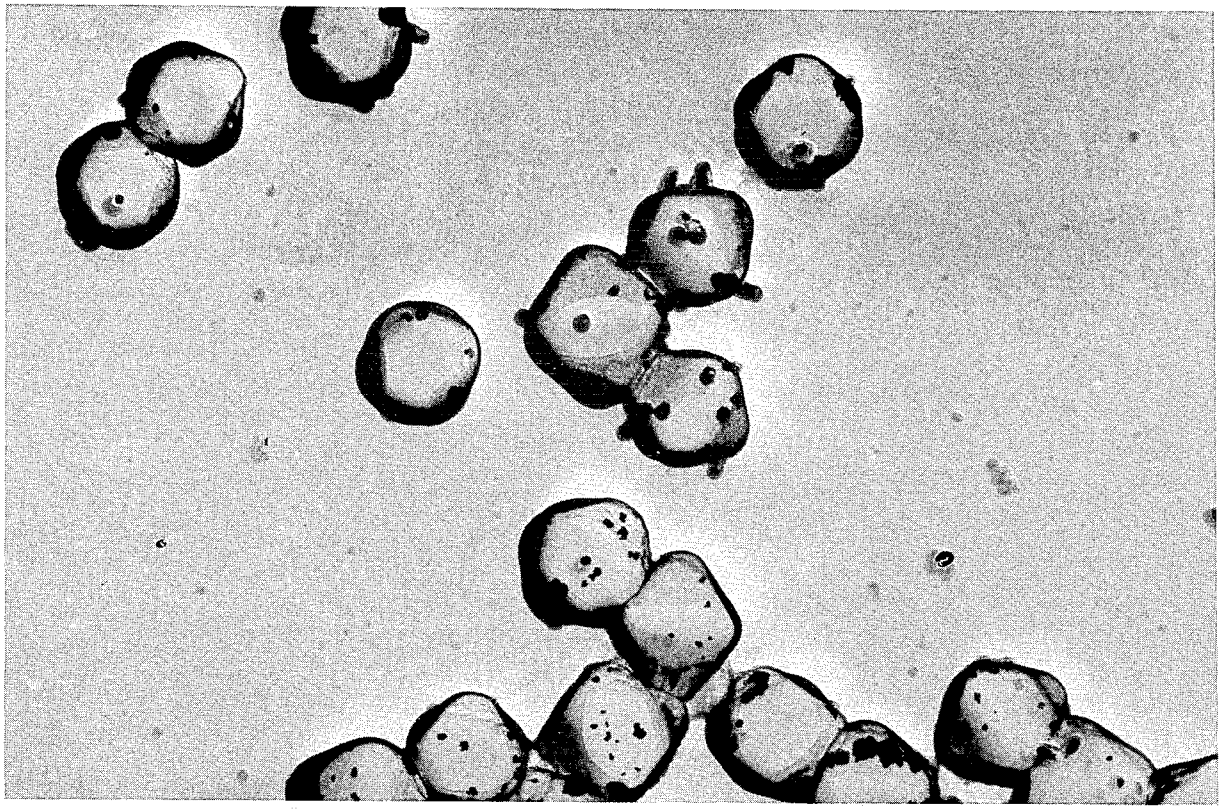
FIGS. 4 and 5 are electron microphotographs showing the development initiation points of the silver halide crystal grains in the silver halide emulsions for Samples 6 and 7, respectively, in Example 2. The magnification is 22,000.
Figure 5:
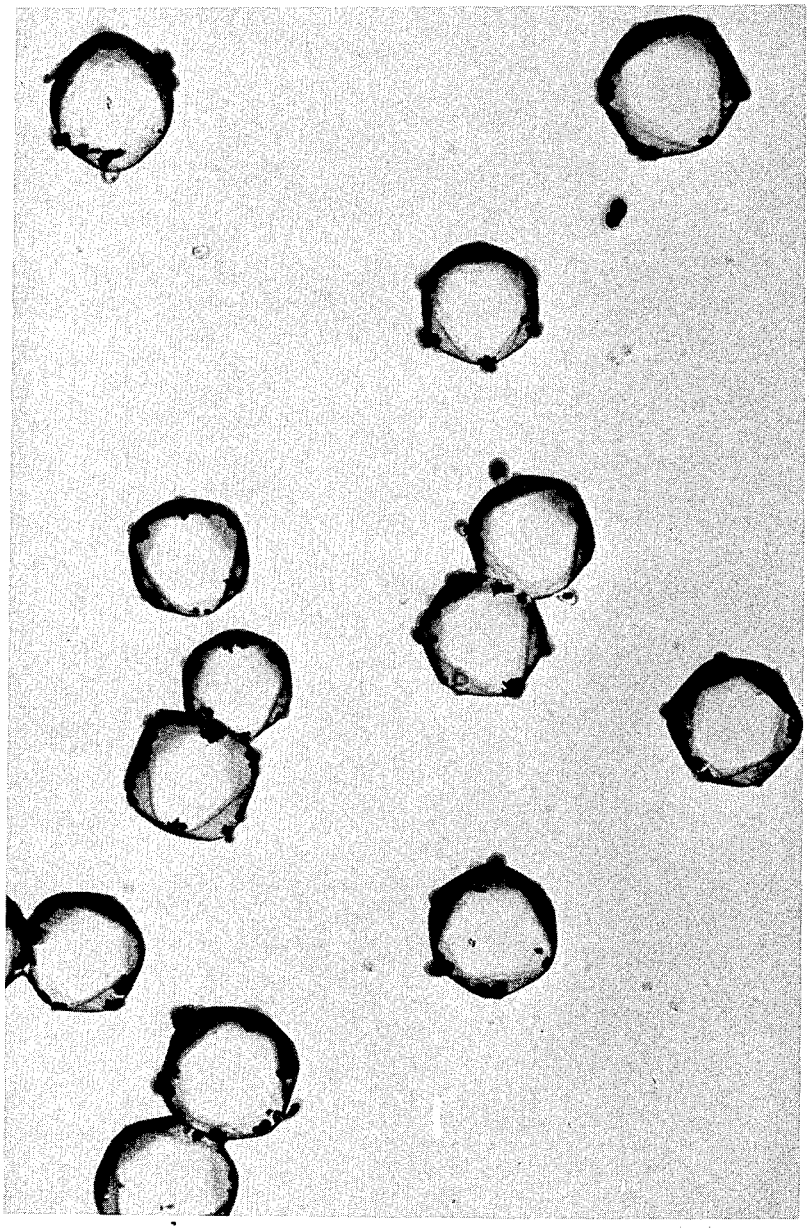

Electron microphotographs of the silver halide grains in the emulsions of Samples 6 and 7 are shown in FIG. 4 and FIG. 5, respectively.

As is clear from the photographs, in Sample 7 of this invention, developed silver (black points) are clearly formed at the corners of the octahedral grains as compared with Sample 6 (comparison) and as is clear from the results shown in Table 3 above, Sample 7 are superior in photographic performance to Sample 6.

By following the same procedure as the case of preparing Emulsion G described above except that 200 mg of CR-compound (36) was used in place of 250 mg of ribonucleic acid as a CR-compound, Emulsion V was prepared. Also by following the same procedure as the case of preparing Emulsion G except that 30 mg of CR-compound (50) in place of 250 mg of ribonucleic acid, Emulsion W was prepared. To each of the emulsions were added a coating aid and a gelatin hardening agent without using stabilizer and each emulsion was coated on a cellulose triacetate film support together with a surface protective layer to provide Samples 11 and 12.

Also, by following the same procedure as the case of preparing Sample G except that 100 mg of CR-compound (12) was added to the emulsion in place of 250 mg of ribonucleic acid and after adsorbing the compound of the silver halide grains, 50 mg of CR-compound (50) was added thereto, Emulsion X was prepared, and also by following the same procedure as above except that 50 mg of CR-compound (50) was added to the emulsion and after performing chemical sensitization, 100 mg of CR-compound (12) was added thereto, Emulsion Y was prepared.

Each of the emulsions was similarly coated on a cellulose triacetate film support together with a surface protective layer to provide Samples 13 and 14.

On each sample, the sensitometry was applied as in the case of aforesaid Sample 7 and the results obtained are shown in Table 4 below.

TABLE 4

| Sample | Emulsion | Mean Grain Size (μm) | Ratio by No. of CDG and EDG* | Relative Sensitivity | γ |
|---|---|---|---|---|---|
| 7 | G | 0.85 | 85% | 127 | 1.30 |
| 11 | V | " | 87% | 122 | 1.25 |
| 12 | W | " | 90% | 135 | 1.27 |
| 13 | X | " | 98% | 250 | 1.31 |
| 14 | Y | " | 70% | 225 | 1.22 |

*based on the total silver halide grains in the emulsion

As shown in the results of Table 4, excellent results are also obtained by using CR-compounds (36) and (50) and a combination of CR-compound (50) and CR-compound (12) gives particularly excellent results in the case of properly using CR-compound (12).

EXAMPLE 3

To an aqueous solution obtained by dissolving potassium bromide and gelatin in water and kept at 70° C. were added an aqueous solution of silver nitrate and an aqueous solution of potassium iodide and potassium bromide by a double jet method.

Thereafter, after removing soluble salts by a sedimentation method, gelatin was further dissolved therein and pH and pAg thereof were adjusted to 6.8 and 8.6, respectively.

The tabular silver halide grains thus formed had a mean diameter of 1.9 μm, a thickness of 0.3 μm, and a mean diameter/thickness ratio of 6.3, and the silver iodide content was 1 mole %.

The emulsion was divided into three portions and they were heated to 60° C. To each of the emulsions were gradually added each of the sulfur sensitizer and CR-compounds shown in Table 5 below over a period of 20 minutes, followed by ripening the emulsion for 40 minutes. To each of Emulsions H, I and J thus obtained, the stabilizer, the coating aid, and the hardening agent as described in Example 2 were added and then each emulsion was coated on a cellulose acetate film support together with a surface protective layer by a simultaneous extrusion method to provide Samples 8, 9 and 10.

Each of the samples was exposed through an optical wedge and processed as in Example 2. The results are shown in Table 5.

TABLE 5

| Sample | Sulfur Sensitizer or CR-compound (amount per mole of silver halide) | Ratio (by number) of (CDG + EDG) to the total silver halide grains in the emulsion | Ratio (by projected area) of (CDG + EDG) to the total silver halide grains in the emulsion | Relative Sensitivity |
|---|---|---|---|---|
| 8 | Sodium Thiosulfate (1.4 mg) | 7% | 5% | 100* |
| 9 | 2-(3-Ethylureido)-4-methyl-thiazole (1.6 mg) | 71% | 75% | 132 |
| 10 | 5-Benzylidene-3-ethyl-4-oxo-oxazolidine-2-thione (1.8 mg) | 89% | >90% | 135 |

*The relative sensitivity of Sample 8 was defined to be 100.

Figure 6:
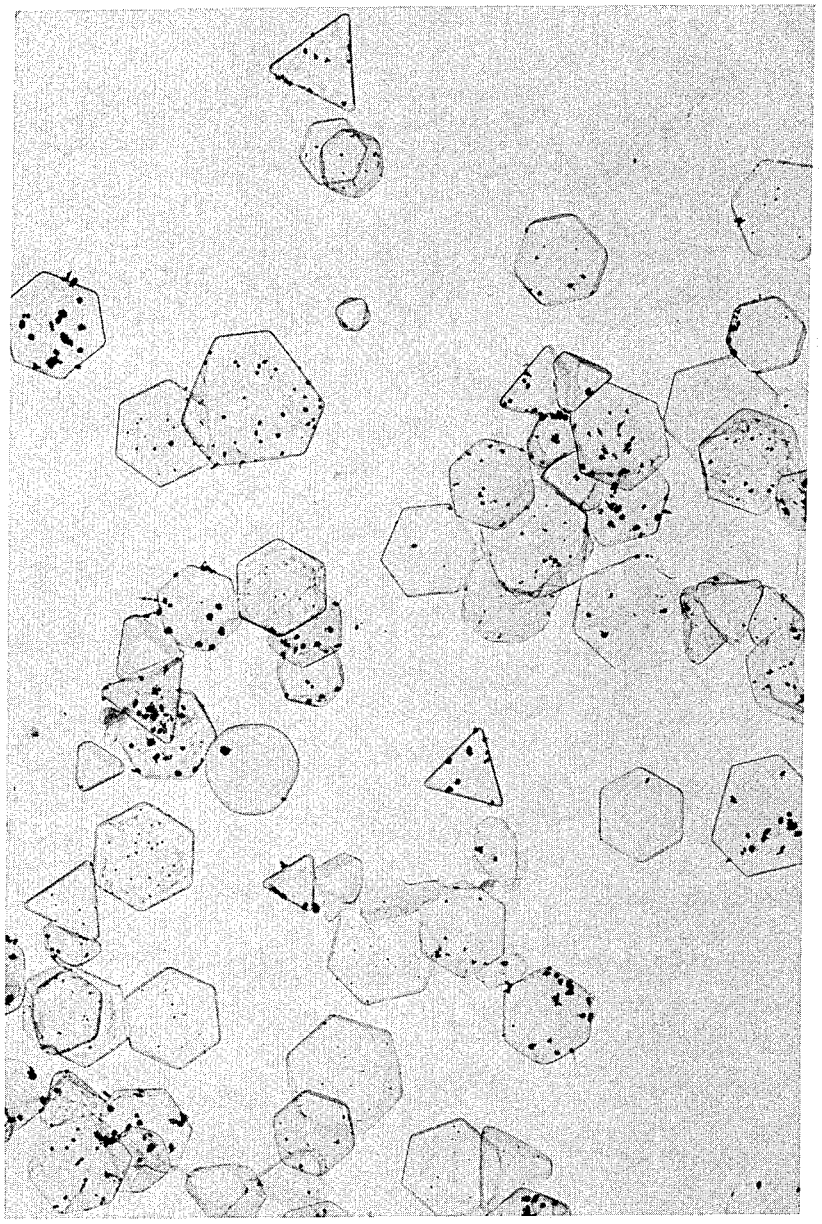
FIGS. 6 to 8 are electron microphotographs showing the development initiation points of the silver halide crystal grains in the silver halide emulsions for Samples 8, 9, and 10, respectively, in Example 3. The magnification is 7,300.
Figure 7:
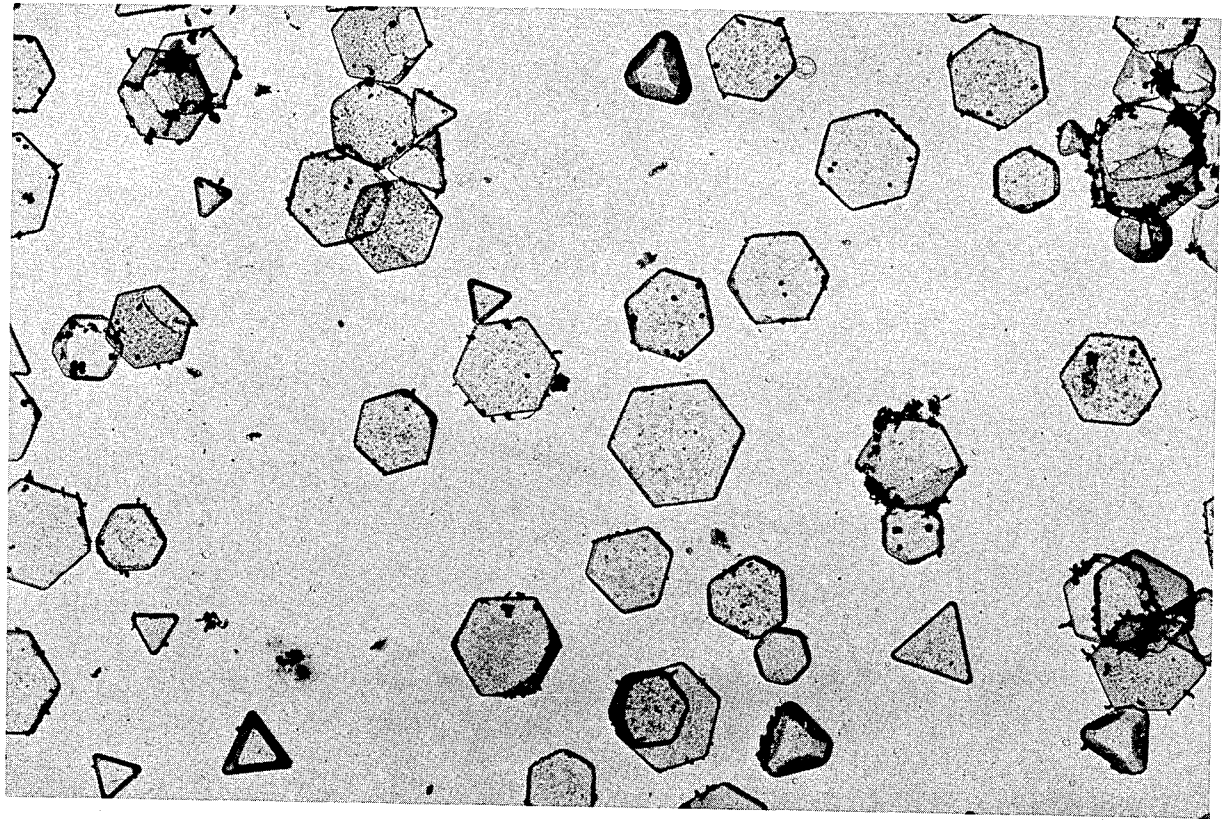
Figure 8:
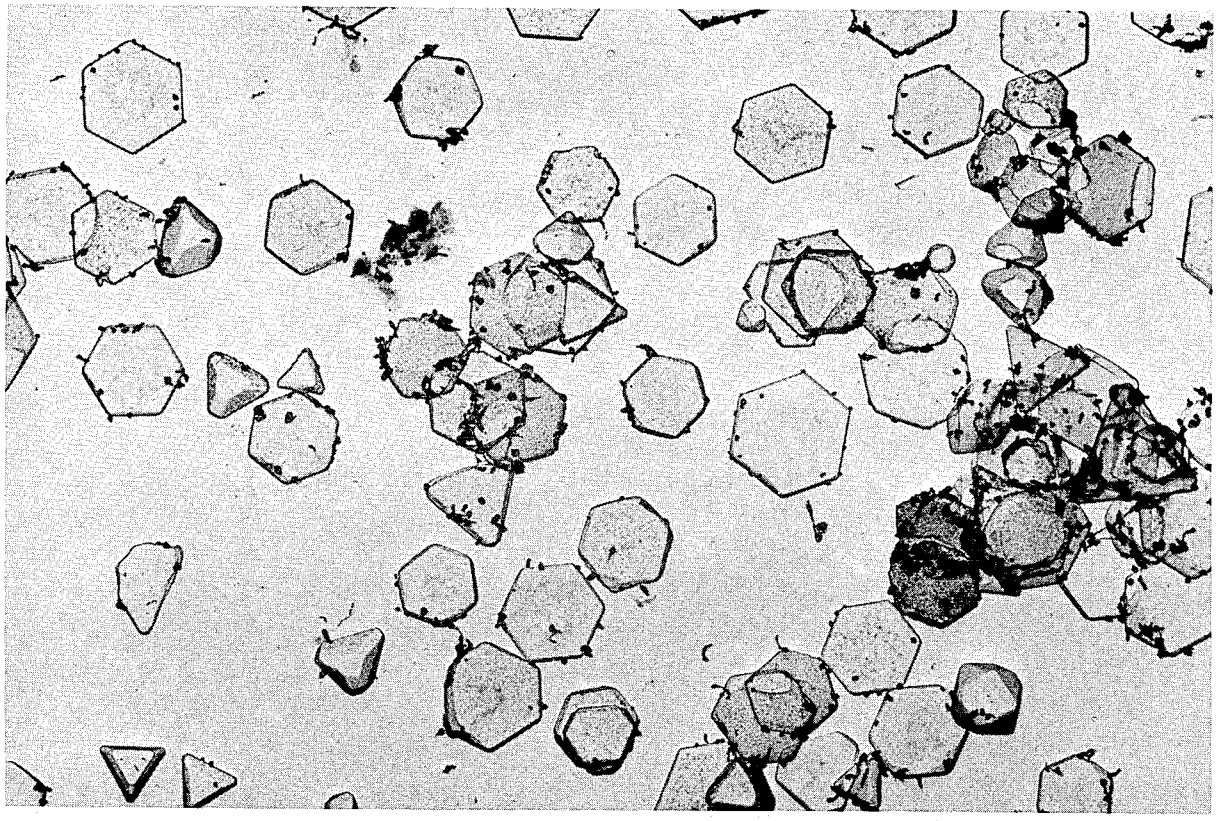

The development centers of Samples 8, 9, 10 were observed by electron microscope by the same manner as in Example 2 and the results obtained are shown in FIG. 6 (Sample 8), FIG. 7 (Sample 9), and FIG. 8 (Sample 10).

As is clear from the photographs, it can be seen that by suitably selecting the sulfur sensitizer or by using a sulfur sensitizer with a CR-compound, the development can initiate at the corners or in the vicinity of the edges of tabular silver halide grains having (111) faces and also as is clear from the results shown in Table 5, the samples of this invention (Samples 9 and 10) are excellent in photographic properties as compared to the comparison sample (Sample 8).

EXAMPLE 4

(Improvement of Reciprocity Law Failure)

Each of Samples 6 and 7 prepared in Example 2 was exposed for $10^{-6}$ second or 100 seconds and processed as in Example 3. The relative sensitivities obtained are shown in Table 6 below. The relative sensitivity is as in Example 3, wherein that of Sample 6 exposed for 1/100 second was defined as 100. In this case, however, the numerals in the parentheses on Sample 7 show the relative value when the relative sensitivity of Sample 7 at the exposure of 1/100 second was defined as 100.

TABLE 6

| Sample | Relative Sensitivity at Exposure of 1/100 second | Relative Sensitivity at Exposure of 100 seconds | Relative Sensitivity at Exposure of $10^{-6}$ second |
|---|---|---|---|
| 6 | 100 | 85 | 72 |
| 7 | 127 (100) | 113 (89) | 116 (91) |

As is clear from the results shown in Table 6, when the exposure time is long (100 seconds) or short ($10^{-6}$ second), the relative sensitivity is lowered as compared to the case of exposing for 1/100 second, which is frequently used at practical photographing. (In the field of art, the former is called as low-illuminance reciprocity law failure, and the improvement of the reduction of sensitivity in the case of changing the exposure time has been desired.)

It has now been clarified that when the latent image forming sites are limited to the corners of the silver halide grains as Sample 7 of this invention, the reduction of sensitivity at long exposure time or short exposure time is greatly improved as compared with the comparison sample (Sample 6).

EXAMPLE 5

Preparation of Emulsion

| | |
|---|---|
| Solution 1: | |
| Bone Gelatin | 30 g |
| Sodium Chloride | 3.8 g |
| Water to make | 1 liter |
| Ammonium Nitrate | 3 g |
| Solution 2: | |
| Silver Nitrate | 15 g |
| Ammonium Nitrate | 0.5 g |
| Water to make | 150 ml |
| Solution 3: | |
| Sodium Chloride | 6.3 g |
| Potassium Bromide | 0.52 g |
| Water to make | 150 ml |
| Solution 4: | |
| Silver Nitrate | 135 g |
| Ammonium Nitrate | 1 g |
| Water to make | 450 ml |
| Solution 5: | |
| Sodium Chloride | 51.7 g |
| Potassium Bromide | 1.8 g |
| Water to make | 450 ml |

Solution 1 was kept at 70° C. and after adjusting the pH thereof to 5.0 by 1N sulfonic acid, Solution 2 and Solution 3 were simultaneously added to Solution 1 with stirring vigorously over a period of 20 minutes. Then, Solution 4 and Solution 5 were simultaneously added to the mixture over a period of 40 minutes in such an acceleration addition method that the final flow rate became thrice the initial flow rate. For keeping the pH of the solution in the reaction bath, 0.1N sulfuric acid was added to the mixed solution under control.

In the case of preparing Emulsion K, when Solution 4 and Solution 5 were added to the mixed solution in the aforesaid step, Solution 6 obtained by dissolving 100 mg of CR-compound (34) in 200 ml of methanol was simultaneously added thereto at a constant rate. Furthermore, during the period of from one minute before finishing the addition of Solution 4 and Solution 5 to the end of the additions, Solution 7 obtained by dissolving 310 mg of CR-compound (19) in 310 ml of a mixture of water and methanol was added thereto at a constant rate.

Emulsion K thus prepared was composed of octahedral silver halide grains having a mean grain size of 0.82 μm and a variation coefficient of 10%. It was confirmed that CR-compound (19) used was adsorbed on the grains in saturated state. The emulsion had a large light absorption peak at 464 nm and a small light absorption peak at 437 nm.

Also, Emulsion L was prepared by the same manner as the case of preparing Emulsion K, in which, however, the addition amount of CR-compound (34) was changed to 25 mg. Emulsion L was composed of tetradecahedral silver halide grains ((111) faces of 40%) had a mean grain size of 0.83 μm and a variation coefficient of 9%.

Furthermore, Emulsion M was prepared by the same manner as Emulsion K, wherein, however, Solution 6 obtained by dissolving 100 mg of CR-compound (34) in 200 ml of methanol was added to the mixed solution during the period of 2 minutes, from 3 minutes before finishing the additions of Solution 4 and Solution 5 to 1 minute before finishing the additions. Emulsion M was composed of cubic silver halide grains having a mean grain size of 0.83 μm and avariation coefficient of 9%.

In each case of Emulsions L and M, 310 mg of CR-compound (19) was added to the mixed solution during a period from 1 minute before finishing the additions of Solutions 4 and 5 to the end of the additions thereof. The addition of the sensitizing dye directly before the finish of the additions gave no influences on the form of the silver halide grains.

Each emulsion was chemically sensitized using diphenylthiourea and chloroauric acid. The amounts of the chemical sensitizers are shown in Table 7 below.

After washing and desalting each emulsion by a fluctuation method, gelatin was added to the emulsion and pH and pAg thereof adjusted to 6.2 and 7.0, respectively at 40° C.

Moreover, by following the same procedure as the case of preparing Emulsion K except that the addition amount of CR-compound (19) was reduced to 155 mg, Emulsion T. In this case, the adsorbed amount of CR-compound (19) was about 45% and hence after the optimum chemical sensitization, the compound was additionally supplied to increase the adsorbed amount to about 95% to 100%.

Each of light-sensitive materials was prepared by forming each emulsion layer containing the following additives and the surface protective layer shown below on a triacetyl cellulose film support having a subbing layer.

(1) Emulsion Layer

Emulsion: The emulsion shown in Table 7.

Coupler: Shown below

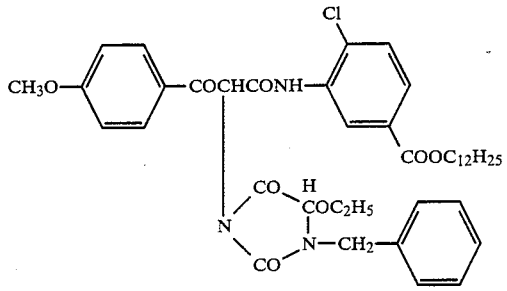

Stabilizer: 1-(3-Methylcarbamoylaminophenyl)-2-mercaptotetrazole

Coating Aid: Sodium dodecylbenzenesulfonate

Tricresyl phosphate

Gelatin (2) Protective Layer 2,4-Dichlorotriazine-6-hydroxy-s-triazine sodium salt Gelatin Each of the samples was sensitometrically exposed and processed as follows.

The density of the sample thus processed was measured using a blue filter and the results obtained are shown in Table 7 below.

The steps for the processing used were as follows and were performed at 38° C.

| | |
|---|---|
| 1. Color Development | 1 min. 5 sec. |
| 2. Bleach | 2 min. |
| 3. Wash | 2 min. |
| 4. Fix | 2 min. |
| 5. Wash | 2 min. 15 sec. |
| 6. Stabilization | 2 min. 15 sec. |

The processing compositions used for the aforesaid processing steps were as follows.

| Color Developer: | |
|---|---|
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 3-Methyl-4-amino-N-ethyl-N-β-hydroxyethylaniline sulfate | 4.5 g |
| Water to make | 1.0 liter |
| Bleach Solution: | |
| Ammonium bromide | 160.0 g |
| Aqueous ammonia (28%) | 25.0 ml |
| Ethylenediaminetetraacetic acid sodium salt | 130 g |
| Glacial acetic acid | 14 ml |
| Water to make | 1 liter |
| Fix Solution: | |
| Sodium tetrapolyphosphate | 2.0 g |
| Sodium sulfite | 4.0 g |
| Ammonium thiosulfate (70%) | 175.0 ml |
| Sodium hydrogensulfite | 4.6 g |
| Water to make | 1 liter |
| Stabilizer: | |
| Formalin | 8.0 ml |
| Water to make | 1 liter |

In Table 7 below, the sensitivity was shown by the reciprocal of an exposure amount necessary for giving an optical density of fog+0.2.

TABLE 7

| Emulsion | Sulfur-Sensitizer mol/AgX | Gold-Sensitizer mol/AgX | Fog | Photographic Sensitivity: Exposure of 1/100 sec | Photographic Sensitivity: Exposure of $10^{-4}$ sec | Ratio (by number) of (CDG + EDG) of the total silver halide grains in the emulsion | Ratio (by projected area) of (CDG + EDG) to the total silver halide grains in the emulsion |
|---|---|---|---|---|---|---|---|
| Em. K | $3.6 \times 10^{-6}$ | $2.7 \times 10^{-6}$ | 0.27 | 40 | 32 | 63% | 65% |
| Octahedron | | $9 \times 10^{-6}$ | 0.24 | 64 | 64 | 80% | 80% |
| | | $27 \times 10^{-6}$ | 0.10 | 100 | 95 | 90% | 92% |

TABLE 7-continued

| Emulsion | Sulfur-Sensitizer mol/AgX | Gold-Sensitizer mol/AgX | Fog | Photographic Sensitivity: Exposure of 1/100 sec | Photographic Sensitivity: Exposure of $10^{-4}$ sec | Ratio (by number) of (CDG + EDG) of the total silver halide grains in the emulsion | Ratio (by projected area) of (CDG + EDG) to the total silver halide grains in the emulsion |
|---|---|---|---|---|---|---|---|
| | | $90 \times 10^{-6}$ | 0.16 | 64 | 50 | 79% | 82% |
| Em. L | $3.6 \times 10^{-6}$ | $2.7 \times 10^{-6}$ | 0.29 | 36 | 30 | 55% | 60% |
| Tetra- | | $9 \times 10^{-6}$ | 0.24 | 64 | 50 | 78% | 82% |
| decahedron | | $27 \times 10^{-6}$ | 0.15 | 70 | 65 | 86% | 86% |
| Em. M | $3.6 \times 10^{-6}$ | $2.7 \times 10^{-6}$ | 0.40 | 10 | 5 | 10% | 12% |
| cube | | $9 \times 10^{-6}$ | 0.46 | 7 | 4 | 8% | 8% |
| | | $90 \times 10^{-6}$ | 0.49 | 6 | 4 | 8% | 10% |
| Em. T Octahedron | $3.6 \times 10^{-6}$ | $2.7 \times 10^{-6}$ | 0.18 | 92 | 78 | 95% | 88% |

From the results shown in Table 7 above, it can be seen that when the cubic silver halide emulsion is gold- and sulfur-sensitized, the formation of fog becomes high and the sensitivity is low. When the amount of the gold sensitizer is increased, the formation of fog is further increased and the sensitivity is more lowered. Also, a high-illuminance reciprocity law failure is large.

When the emulsion containing silver halide grains having (111) facts, such as tetradecahedral or octahedral silver halide grains is gold- and sulfur-sensitized, the formation of fog is low and the sensitivity becomes high. In particular, when the amount of the gold sensitizer is increased, very preferred characteristics such as the increase of sensitivity and the reduction of fog formation are obtained. It can be also seen that a high-illuminance reciprocity law failure is less.

Figure 9:
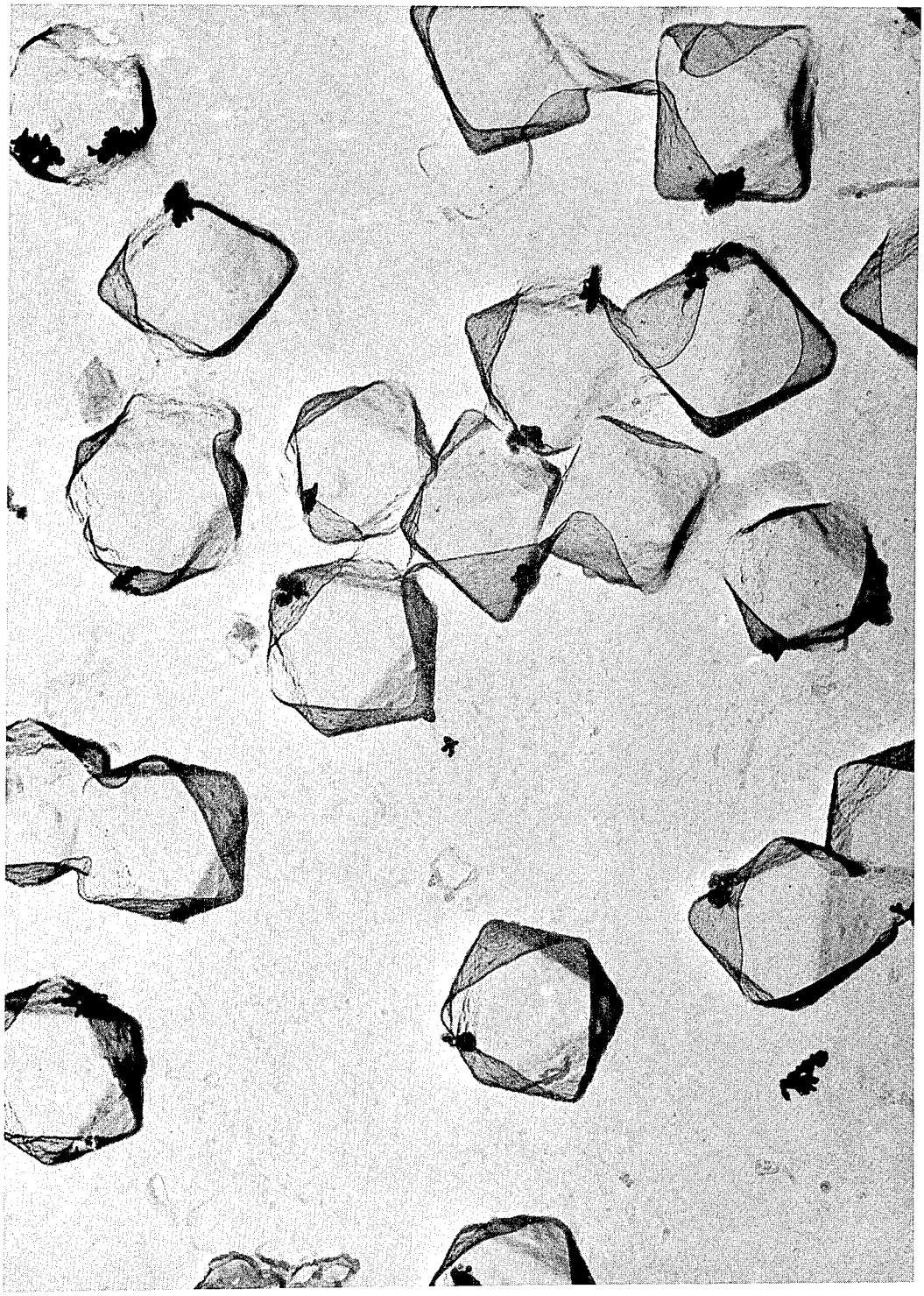
FIG. 9 is an electron microphotograph showing the development initiation points of the silver halide crystal grains of Emulsions K in Example 5. The magnification is 2,000.

Furthermore, a coated sample was prepared using Emulsion K shown in Table 7 containing $3.6 \times 10^{-6}$ mole of the sulfur sensitizer and $27 \times 10^{-6}$ mole of the gold sensitizer per mole of silver halide and the development centers were observed as in Example 2 described above. In this case, however, at color development, the color developer described above in the example was diluted to 20 times the original composition and the sample was developed for one minute at 20° C. The results are shown in FIG. 9.

From the figure, it is clear that developed silver is formed in the vicinity of the corners and edges of the octahedral silver halide grains.

EXAMPLE 6

By following the same procedures as the cases of preparing Emulsions K, L and M, Emulsions N, O and P, respectively, were prepared. In these cases, however, 280 mg of CR-compound (21) was used in place of CR-compound (19) and the addition temperature of the compound was lowered to 68° C.

CR-compound (21) also acted as spectral sensitizing dyes and had adsorbed on the silver halide grains in saturated state.

Emulsion N was composed of octahedral silver halide grains, Emulsion O tetradecahedral silver halide grains, and Emulsion P cubic silver halide grains, each having a mean grain size of 0.66 μm, 0.65 μm or 0.67 μm, respectively.

By following the same procedure as the case of preparing Emulsion N except that the amount (280 mg) of CR-compound (21) was changed to 120 mg, Emulsion U was prepared. In this case, the adsorbed amount of CR-compound (21) was about 40% and hence after the chemical sensitization, CR-compound (21) was supplied to increase the adsorbed amount to about 95%.

After desalting, each emulsion was chemically sensitized using sodium thiosulfate and chloroauric acid and a light-sensitive material was obtained as in Example 5.

In these cases, however, the compound shown below was used in place of the stabilizer;

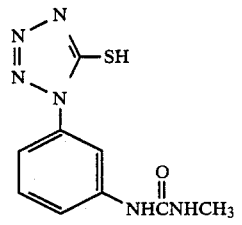

and also the following magenta coupler (Magenta-A) was used.

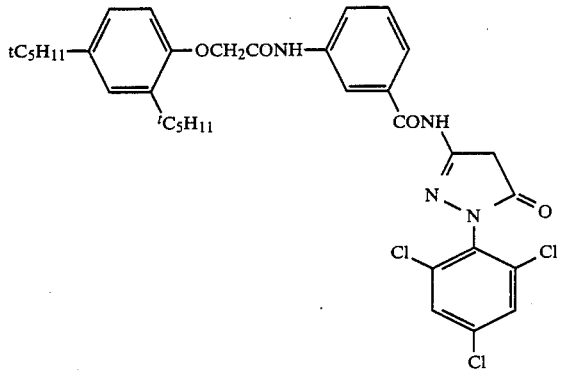

Each of the light-sensitive materials was sensitometrically exposed through a green filter and processed as in Example 5.

From the view points of fog, sensitivity, reciprocity law failure, Emulsions N and O gave preferred photographic characteristics as compared to Emulsion P. Also, in Emulsions N and O, the increase of the amount of the gold sensitizers gave preferred results.

Emulsion U was about 10% lower in sensitivity than Emulsion N and was slightly inferior from the view point of reciprocity law failure to Emulsion N.

Then, using each of the aforesaid emulsions N and U, a light-sensitive material was prepared by following the above procedure except that an equimolar amount of the coupler shown in Table 8 below was used in place of Magenta-A and the sensitometry was performed by the same manner as above.

The results obtained are shown in Table 8.

TABLE 8

| Emulsion | Coupler | Fog | Photographic Sensitivity: Exposure of 1/100 sec. | Photographic Sensitivity: Exposure of $10^{-4}$ sec. |
|---|---|---|---|---|
| N | Magenta-A | 0.12 | 100* | 82 |
| " | Magenta-1 | 0.15 | 132 | 112 |
| " | Magenta-6 | 0.13 | 130 | 116 |
| " | Magenta-10 | 0.13 | 130 | 122 |
| " | Magenta-11 | 0.12 | 128 | 118 |
| U | Magenta-A | 0.13 | 90 | 64 |
| " | Magenta-1 | 0.16 | 118 | 82 |
| " | Magenta-6 | 0.12 | 116 | 78 |
| " | Magenta-10 | 0.13 | 112 | 76 |
| " | Magenta-11 | 0.12 | 108 | 70 |

EXAMPLE 7

By following the same procedure as the cases of preparing Emulsions K, L, and M, Emulsions Q, R, and S were prepared, wherein 250 mg of CR-compound (12) was used in place of CR-compound (19).

Emulsion Q was composed of octahedral silver halide grains, Emulsion R tetradecahedral silver halide grains, and Emulsion S cubic silver halide grains each having a mean grain size of 0.71 μm, 0.70 μm, or 0.71 μm, respectively.

After desalting each emulsion, the emulsion was chemically sensitized using sodium thiosulfate, chloroauric acid, and potassium thiocyanate and each light-sensitive material was prepared using each emulsion by the same manner as in Example 5. In these cases, the cyan coupler having the following formula wa used.

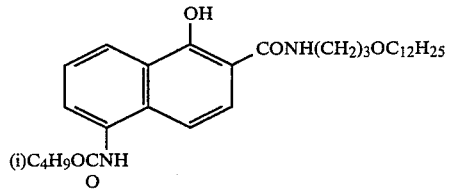

Each of these light-sensitive materials thus prepared sensitometrically exposed through a red filter and then developed by the same manner as Example 5.

The results obtained showed that when the amount of the gold sensitizer was increased, preferred results were obtained in sensitivity, fog, and reciprocity law failure in the cases of Emulsions Q and R as compared to the case of using Emulsion S.

EXAMPLE 8

A multilayer color photographic material having the layers of the following compositions on a cellulose triacetate film support having a subbing layer was prepared.

The coating amounts in the following compositions were shown by g/m² as silver about silver halide emulsion and colloid silver, by g/m² about additives and gelatin, and by mole number per mole of silver halide in a same layer about sensitizing dye.

| | | |
|---|---|---|
| Layer 1 (Antihalation Layer) | | |
| Black Colloid Silver | 0.2 | |
| Gelatin | 1.3 | |
| Colored Coupler C-1 | 0.06 | |
| Ultraviolet Absorbent UV-1 | 0.1 | |
| Ultrabiolet Absorbent UV-2 | 0.2 | |

-continued

| | | |
|---|---|---|
| Dispersion Oil Oil-1 | 0.01 | |
| Dispersion Oil Oil-2 | 0.01 | |
| Layer 2 (Interlayer) | | |
| Gelatin | 1.0 | |
| Colored Coupler C-2 | 0.02 | |
| Dispersion Oil Oil-1 | 0.1 | |
| Layer 3 (1st Red-Sensitive Emulsion Layer) | | |
| Emulsion (1) shown in Table 9 | 1.0 | as silver |
| Gelatin | 1.0 | |
| Coupler C-3 | 0.48 | |
| Coupler C-4 | 0.56 | |
| Coupler C-8 | 0.08 | |
| Coupler C-2 | 0.08 | |
| Coupler C-5 | 0.04 | |
| Dispersion Oil Oil-1 | 0.30 | |
| Dispersion Oil Oil-3 | 0.04 | |
| Layer 4 (2nd Red-Sensitive Emulsion Layer) | | |
| Emulsion (2) shown in Table 9 | 1.0 | as silver |
| Gelatin | 1.0 | |
| Coupler C-6 | 0.05 | |
| Coupler C-7 | 0.1 | |
| Dispersion Oil Oil-1 | 0.01 | |
| Dispersion Oil Oil-2 | 0.05 | |
| Layer 5 (Interlayer) | | |
| Gelatin | 1.0 | |
| Compound Cpd-A | 0.03 | |
| Dispersion Oil Oil-1 | 0.05 | |
| Layer 6 (1st Green-Sensitive Emulsion Layer) | | |
| Emulsion (3) shown in Table 9 | 0.8 | as silver |
| Coupler C-9 | 0.30 | |
| Coupler C-12 | 0.10 | |
| Coupler C-1 | 0.06 | |
| Coupler C-10 | 0.03 | |
| Coupler C-5 | 0.02 | |
| Dispersion Oil Oil-1 | 0.4 | |
| Layer 7 (2nd Green-Sensitive Emulsion Layer) | | |
| Emulsion (4) shown in Table 9 | 0.85 | as silver |
| Gelatin | 1.0 | |
| Coupler C-11 | 0.01 | |
| Coupler C-12 | 0.04 | |
| Coupler C-13 | 0.20 | |
| Coupler C-1 | 0.02 | |
| Coupler C-15 | 0.02 | |
| Dispersion Oil Oil-1 | 0.20 | |
| Dispersion Oil Oil-2 | 0.05 | |
| Layer 8 (Yellow Filter Layer) | | |
| Gelatin | 1.2 | |
| Yellow Colloid Silver | 0.08 | |
| Compound Cpd-B | 0.1 | |
| Dispersion Oil Oil-1 | 0.3 | |
| Layer 9 (1st Blue-Sensitive Emulsion Layer) | | |
| Emulsion (5) shown in Table 9 | 0.4 | as silver |
| Gelatin | 1.0 | |
| Coupler C-14 | 0.9 | |
| Coupler C-5 | 0.07 | |
| Dispersion Oil Oil-1 | 0.2 | |
| Layer 10 (2nd Blue-Sensitive Emulsion Layer) | | |
| Emulsion (6) shown in Table 9 | 0.5 | as silver |
| Gelatin | 0.6 | |
| Coupler C-14 | 0.25 | |
| Dispersion Oil Oil-1 | 0.07 | |
| Layer 11 (1st Protective Layer) | | |
| Gelatin | 0.8 | |
| Ultraviolet Absorbent UV-1 | 0.1 | |
| Ultraviolet Absorbent UV-2 | 0.2 | |
| Dispersion Oil Oil-1 | 0.01 | |
| Dispersion Oil Oil-2 | 0.01 | |
| Layer 12 (2nd Protective Layer) | | |
| Gelatin | 0.45 | |
| Polymethyl Methacrylate Particles (diameter 1.5 μm) | 0.2 | |
| Hardening Agent H-1 | 0.4 | |
| Formaldehyde Scavenger S-1 | 0.5 | |
| Formaldehyde Scavenger S-2 | 0.5 | |

Each layer further contained a surface active agent as a coating aid.

Then, the chemical structures and chemical names of the compounds for the aforesaid layers are shown below.
UV-1
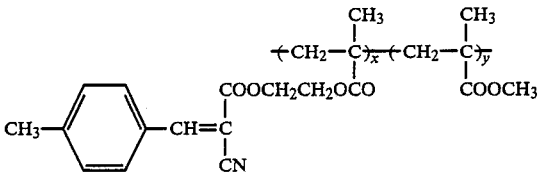
x/y = 7/3 (weight ratio)
UV-2
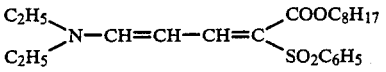
Tricresyl phosphate — Oil-1
Dibutyl phthalate — Oil-2
Bis(2-ethylhexyl) phthalate — Oil-3
C-1
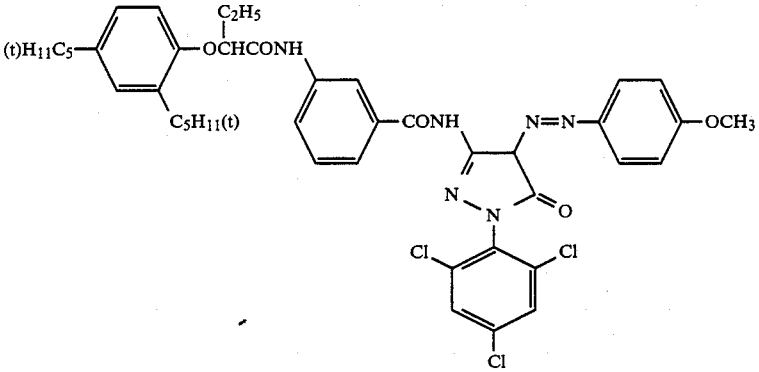
C-2
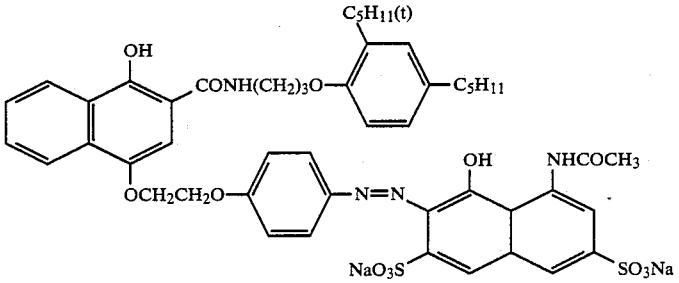
C-3
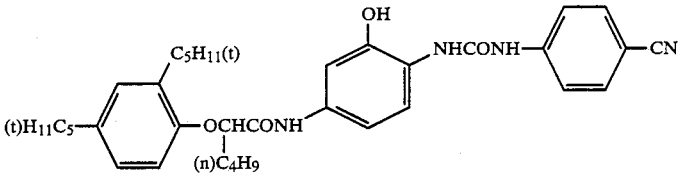
C-4
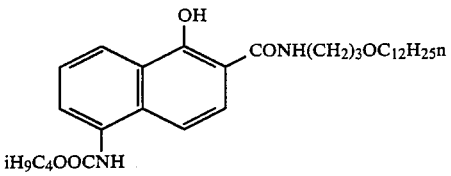

-continued
C-5
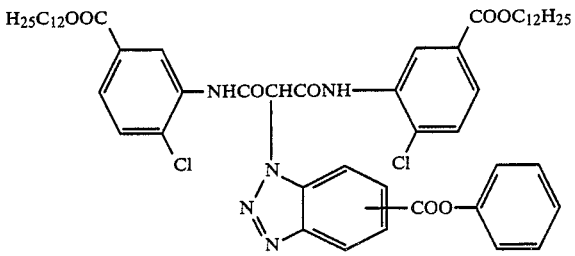
C-15
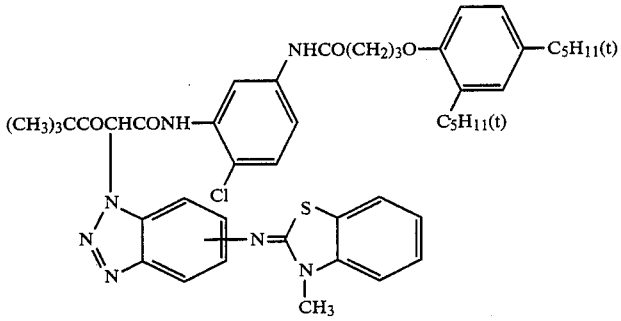
C-6
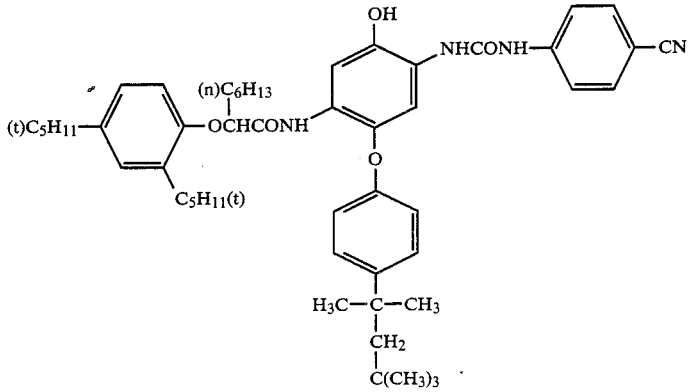
C-7
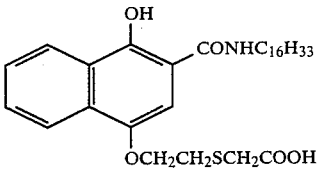
C-8
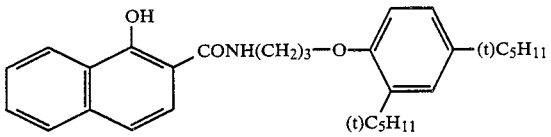

-continued
C-9
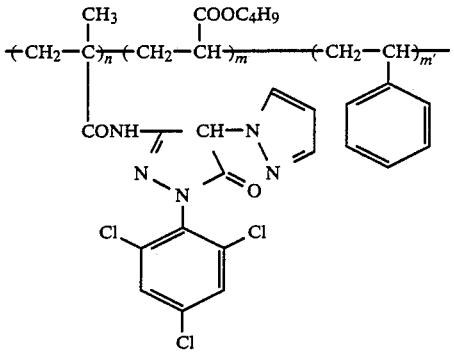
n = 50
m = 25
m' = 25
mol. wt. ca 20,000
C-12
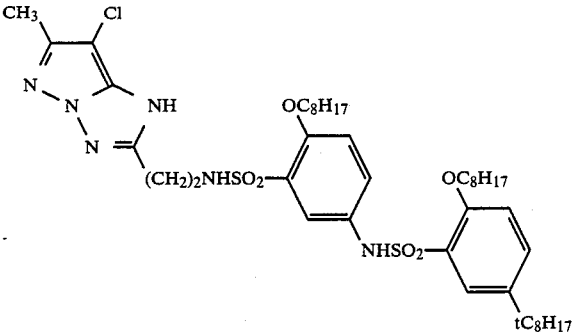
C-10
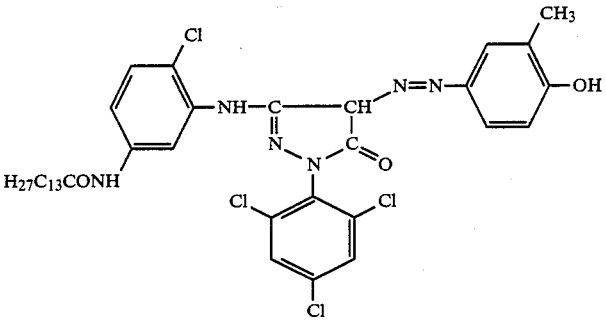
C-11
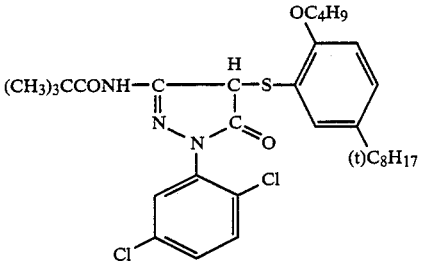

-continued

C-13

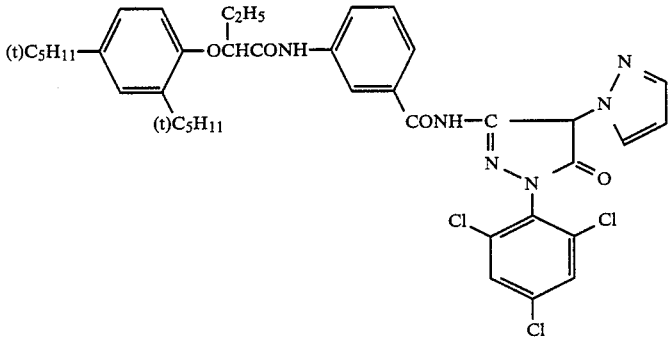

C-14

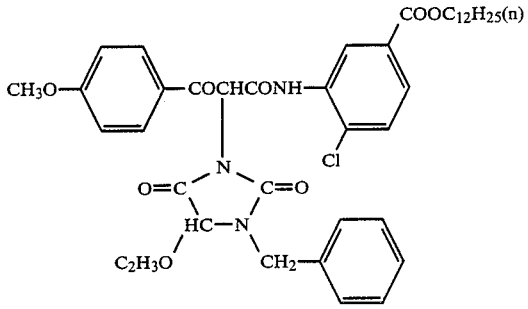

Cpd-A

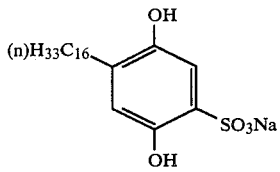

Cpd-B

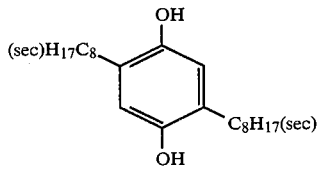

H-1

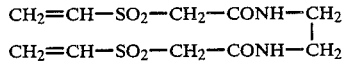

S-1

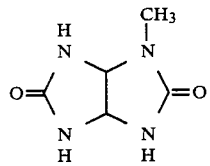

S-2

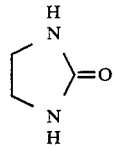

The emulsions used for the preparation of the sample were prepared as follows.

TABLE 9

| | |
|---|---|
| Emulsion (1): | In the procedure for preparing Emulsion G, the addition temperature was changed to 53° C., CR-compounds (12) ($3.0 \times 10^{-4}$ mol/mol-Ag), (22) ($5.1 \times 10^{-4}$ mol/mol-Ag), and (23) ($1.0 \times 10^{-4}$ mol/mol-Ag) were added, and the emulsion was |

TABLE 9-continued

| | |
|---|---|
| | most suitably chemically sensitized using sodium thiosulfate, chloroauric acid and potassium thiocyanate after desalting. The mean grain size was 0.40 μm and the variation coefficient was 12%. |
| Emulsion (2): | In the above procedure for Emulsion (1), the addition temperature was changed to 73° C. The mean grain size was 0.71 μm and the vari- |

TABLE 9-continued

| | |
|---|---|
| | ation coefficient was 11%. |
| Emulsion (3): | In the procedure for preparing Emulsion N, the addition temperature was changed to 53° C., CR-compounds (21) ($4.6 \times 10^{-4}$ mol/mol-Ag), and (24) ($4.5 \times 10^{-4}$ mol/mol-Ag) were added, and the emulsion was most suitably chemically sensitized using sodium thiosulfate and chloroauric acid after desalting. The mean grain size was 0.38 μm and the variation coefficient was 10%. |
| Emulsion (4): | In the above procedure for Emulsion (3), the addition temperature was changed to 73° C. The mean grain size was 0.66 μm and the variation coefficient was 10%. |
| Emulsion (5): | In the procedure for preparing Emulsion K, the addition temperature was changed to 55° C., CR-compound (19) ($9.2 \times 10^{-4}$ mol/mol-Ag) was added, and the emulsion was most suitably chemically sensitized using diphenylthiourea and chloroauric acid after desalting. |
| Emulsion (6): | In the procedure for preparing Emulsion K, the emulsion was most suitably chemically sensitized using chloroauric acid and diphenylthiourea. The mean grain size ws 0.70 μm and the variation coefficient was 10%. |

The sample thus prepared was exposed for a definite period of time based on JIS and processed as shown in Table 10.

The amount of the sample being processed was 50 meters per day, the processing was performed for 16 days while supplying each supplement, and after bringing each processing solution into a stationary composition in continuous processing, the test was performed.

TABLE 10

| Step | Time | Temperature | Supplement* | Tank Volume |
|---|---|---|---|---|
| Color Developer | 1 min. | 38° C. | 10 ml | 4 liters |
| Blix | 1 min. | 38° C. | 20 ml | 4 liters |
| Wash (1) | 15 sec. | 38° C. | Countercurrent replenishing from (2) to (1) | 2 liters |
| Wash (2) | 15 sec. | 38° C. | 10 ml | 2 liters |
| Drying | 30 sec. | 65° C. | — | — |

*The replenishing amount per sample of 35 mm in width and 1 m in length.

The compositions of the processing solutions were as follows.

| | Mother liquor | Replenisher |
|---|---|---|
| Color Developer: | | |
| Water | 900 ml | 900 ml |
| Potassium chloride | 1.0 g | 1.0 g |
| Potassium carbonate | 34.6 g | 38.0 g |
| Sodium hydrogencarbonate | 1.8 g | 2.0 g |
| Ethylenediamine-N,N,N,N-tetramethylenephosphonic acid | 1.0 g | 1.2 g |
| Triethylenediamine(1,4-diazabicyclo[2,2]octane) | 5.3 g | 6.0 g |
| Diethylenehydroxylamine | 4.2 g | 5.5 g |
| 3-Methyl-4-amino-N-ethyl-N-β-hydroxyethylaniline | 4.6 g | 7.5 g |
| pH adjusted by potassium hydroxide | 10.05 | 10.15 |
| Water to make | 1 liter | 1 liter |
| Blix Solution: (Mother liquor was same as replenisher) | | |
| Ethylenediaminetetraacetic acid ferric ammonium di-hydrate | 90.0 g | |
| Ethylenediaminetetraacetic acid di-sodium salt | 10.0 g | |
| Sodium sulfite | 12.0 g | |

-continued

| | |
|---|---|
| Aqueous solution (70%) of ammonium thiosulfate | 260.0 ml |
| Acetic acid (98%) | 5.0 ml |
| Bleach accelerator | 0.01 mole |

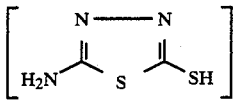

| | |
|---|---|
| Water to make | 1.0 liter |
| pH | 6.0 |
| Wash Solution: (Mother liquor was same as replenisher) | |
| Ion Exchange Water (City water treated by passing through a mixed bed type column packed with a H-type strong acid cation exchange resin (Diaion SK-1B, trade name, made by Mitsubishi Chemical Industries, Ltd.) and OH type strong basic anion exchange resin (Diaion SA-10A) at 1:1.5 by volume ratio to reduce the contents of calcium and magnesium below 3 mg/liter). | |
| Sodium dichloroisocyanurate | 20 mg |
| Sodium sulfate | 150 mg |
| Polyoxyethylene-p-monononyl phenyl ether (mean polymerization degree of 10) | 300 mg |
| pH | 6.5 to 7.5 |

After processing the aforesaid sample, the sample having the same structure as the processed sample, which was exposed for a definite time based on JIS, was processed.

When, ISO sensitivity was calculated about the processed film based on JIS, it was confirmed that the ISO sensitivity of the sample was 50, which was never been attained by a high silver chloride color photographic material.

Also, a sample was prepared by following the same procedure as above except that Magenta C-11 was used for Layer 7 (2nd green-sensitive emulsion layer) in place of Magenta C-13. When the sample was exposed for a period based on JIS and processed as shown in Table 8 above, the sensitivity was almost same as that of the case that Magenta C-13 was used for Layer 7.

EXAMPLE 9

When the same procedure as in Example 8 described above except that the processing steps shown in Table 11 below and the composition of processing solutions shown below were employed was followed, the sensitivity corresponding to almost ISO 50 was stably obtained as in Example 8. Also, when the development initiating points of Emulsions (1) to (6) were tested by the method described above, the emulsions were confirmed to be CDG emulsions.

TABLE 11

| Step | Time | Temperature | Replenisher* | Tank Volume |
|---|---|---|---|---|
| Color Development | 30 sec. | 42° C. | 20 ml | 4 liters |
| Blix | 30 sec. | 42° C. | 20 ml | 4 liters |
| Wash (1) | 10 sec. | 42° C. | Countercurrent replenishing from (2) to (1) | 2 liters |
| Wash (2) | 10 sec. | 42° C. | 20 ml | 2 liters |
| Drying | 30 sec. | 65° C. | — | — |

*The amount of replenisher per sample of 35 mm in width and 1 m in length.

Then, the compositions of the processing solutions were shown below.

| | Mother liquor | Replenisher |
|---|---|---|
| Color Developer: | | |
| Water | 900 ml | 900 ml |
| Potassium chloride | 2.0 g | 2.0 g |
| Potassium carbonate | 34.6 g | 38.0 g |
| Sodium hydrogencarbonate | 1.0 g | 1.5 g |
| Ethylenediamine-N,N,N,N-tetra-methylenephosphonic acid | 2.0 g | 2.4 g |
| Triethylenediamine(1,4-diaza-bicyclo[2,2,2]octane) | 5.3 g | 6.0 g |
| Diethylenehydroxylamine | 4.2 g | 5.5 g |
| 3-Methyl-4-amino-N-ethyl-N-β-hydroxyethylaniline sulfate | 6.0 g | 8.0 g |
| pH adjusted by sodium hydroxide | 10.2 | 10.3 |
| Water to make | 1 liter | 1 liter |
| Blix Solution: | | |
| Water | 600 ml | 600 ml |
| Ethylenediaminetetraacetic acid ferric ammonium di-hydrate | 90.0 g | 100.0 g |
| Ethylenediaminetetraacetic acid di-sodium salt | 10.0 g | 10.0 g |
| Ammonium sulfite | 10.0 g | 12.0 g |
| Aqueous solution (70%) of ammonium thiosulfate | 260.0 ml | 270.0 ml |
| Bleach accelerator | 0.01 mole | 0.015 mole |

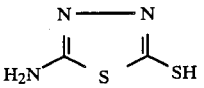

| | | |
|---|---|---|
| pH adjusted by acetic acid to | 5.5 | 5.0 |
| Water to make | 1.0 l | 1.0 l |

Wash Solution: (Mother liquor was same as replenisher)

| | |
|---|---|
| Ion Exchange Water (City water treated by passing through a mixed bed type column packed with a H-type strong acid cation exchange resin (Diaion SK-1B, trade name, made by Mitsubishi Chemical Industries, Ltd.) and an OH type strong basic anion exchange resin (Diaion SA-10A) to reduce the contents of calcium and magnesium below 3 mg/liter). | |
| Sodium dichloroisocyanurate | 20 mg |
| Sodium sulfate | 150 mg |
| Polyoxyethylene-p-monononyl phenyl ether (mean polymerization degree of 10) | 300 mg |
| pH | 6.5 to 7.5 |

EXAMPLE 10

A base support was prepared by forming each subbing layer having the following composition on both surfaces of a polyethylene terephthalate base of 175 μm in thickness colored in blue.

Subbing Layer Composition:

| | |
|---|---|
| Gelatin | 84 mg/m² |
| 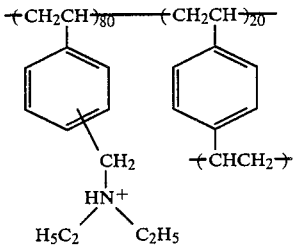 | 60 mg/m² |

-continued

Subbing Layer Composition:

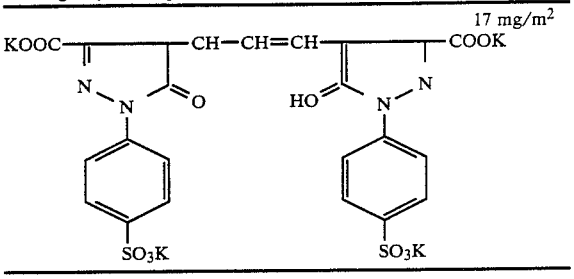

17 mg/m²

Then, Emulsion A or Emulsion E in Example I described above was coated on both surfaces of the base at a silver coverage of 1.95 g/m² in one layer.

A surface layer composed of 0.8 g/m² of gelatin and 0.8 g/m² of dextran was formed on each emulsion layer using the coating composition as in Example 1.

In this case, the amount of the hardening agent was changed to 20 millimoles/100 g-gelatin. Thus, photographic materials 10 (Emulsion A) and 11 (Emulsion E) were prepared.

Evaluation of Photographic Performance

After applying exposure as in Example 1 to both surface of each sample, the sample of processed using Developer (II) shown below and a fix solution shown below by means of an automatic processor.

| | |
|---|---|
| Developer Concentrate | |
| Potassium Hydroxide | 56.6 g |
| Sodium Sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 11.0 g |
| 5-Methylbenzotriazole | 2 g |
| Water to make (pH adjusted to 10.60) | 1 liter |
| Concentration of Fix Solution | |
| Ammonium thiosulfate | 560 g |
| Sodium sulfite | 60 g |
| Ethylenediaminetetraacetic acid disodium di-anhydride | 0.10 g |
| Sodium hydroxide | 24 g |
| Water to make | 1 liter |
| pH adjusted by acetic acid to | 5.10 |

| Automatic Processor: | | Processing: |
|---|---|---|
| Developer tank | (6.5 liters) | 35° C., 12.5 sec. |
| Fix tank | (6.5 liters) | 35° C., 10 sec. |
| Wash tank | (6.5 liters) | 20° C., 7.5 sec. |
| Drying | | 50° C. |
| Dry to dry processing time | | 48 sec. |

At starting processing, the following processing solution was filled each tank.

Development tank:

To the tank were added 333 ml of the aforesaid concentrate of developer, 667 ml of water, and 10 ml of a starter containing 2 g of potassium bromide and 1.8 g of acetic acid and the pH of the solution in the tank was adjusted to 10.15.

Fix tank:

To the tank were added 250 ml of the aforesaid concentrate of fix solution and 750 ml of water.

The results obtained are shown in Table 12 below.

TABLE 12

| Photographic Material | Sensitivity | Gradation |
|---|---|---|
| 10 | 120 | 2.90 |
| 11* | 100 | 2.50 |

*Comparison sample

From the above results, it can be seen that the sample of this invention is superior in sensitivity and gradation to the comparison sample.

EXAMPLE 11

Preparation of Emulsion E1

In one liter of water were dissolved 8 g of gelatin and 6 g of potassium bromide and white stirring at 40° C., an aqueous solution of 1 g of silver nitrate and an aqueous solution of 0.21 g of potassium bromide were added to the solution by a double jet method over a period of 15 seconds. Thereafter, 22 g of gelatin was added thereto and the temperature of the mixture was raised to 75° C. Thereafter, an aqueous solution of 6.5 of silver nitrate was added thereto over a period of 18 minutes. Then, an aqueous solution of 162.5 g of silver nitrate and an aqueous solution of potassium bromide containing iridium and rhodium were added to the mixture by a controlled double jet method while keeping pAg at 7.9.

The added amount of iridium and rhodium were 0.1 mg as $K_3IrCl_6$ and 0.02 mg of $(NH_4)_3RhCl_6$.

In this case, the flow rate was accelerated so that the flow rate at the end of the additions became 5 times that at the initiation of the additions.

Thereafter, 10 ml of an aqueous solution of 2N potassium thiocyanate was added to the mixture and then 10 ml of an aqueous solution of 5% potassium iodide was added thereto over a period of one minute. Thereafter, the temperature was lowered to 35° C., after removing soluble salts by sedimentation, the temperature was raised to 40° C., gelatin was added to the mixture, and pH and pAg thereof were adjusted to 6.5 and 8.3, respectively.

Then, the temperature was raised to 60° C., 1.6 g of 4-hydroxy-6-methyl-1,3,3a,7-tetraazaindene, 60 mg of sodium thiosulfate penta-hydrate, 163 mg of potassium thiocyanate, and 8.1 mg of chloroauric acid were added thereto, and after 65 minutes since then, the mixture was cooled to be caked.

The emulsion obtained was composed of silver halide grains, wherein 95% of the total sum of the projected areas of the whole grains had an aspect ratio of at least 3, the diameter of the mean projected area was 0.86 μm, the standard deviation was 15.3%, and mean thickness was 0.165 μm, and the mean aspect ratio of 5.2.

Preparation of Emulsion E2

In the preparation method for Emulsion D described in Example 1 above, the additions amounts of sodium thiosulfate penta-hydrate and chloroauric acid were changed to 60 mg and 8.1 mg, respectively, and the mixture was kept at 56° C. for 55 minutes. Furthermore, the addition of the sensitizing dye was omitted and 1.6 g of 4-hydroxy-6-methyl-1,3,3a,7-tetrazaindene was added instead.

Preparation of Photographic Materials 12 and 13

A coating composition for surface protective layer as in Example 1 was prepared, Emulsion E1 or Emulsion E2 prepared above was coated on both surfaces of a polyethyleneterephthalate film support having subbing layer of gelatin simultaneously with the coating composition for surface protective layer and dried to provide Photographic Materials 12 and 13. The coated amount of silver was 1.7 g/m$^2$ per one layer and in the surface protective layer, the gelatin coverage was 1.0 g/m$^2$ and the dextran coverage was 1.0 g/m$^2$.

Furthermore, in Photographic Materials 12 and 13, a latex of ethyl acrylate was incorporated in each of Emulsion Layers E1 and E2 as a plasticizer in an amount of 0.4 g/m$^2$ per one layer. Also, at coating, 1,2-bis(sulfonylacetamido)ethane was added to each coating composition in an amount of 8 millimoles/100 g-gelain.

Evaluation of Development Initiation Points

The development initiation points were evaluated as in Example 1. The results obtained are shown in Table 13.

TABLE 13

| Photographic Material | Emulsion | Ratio of development initiation points existing in the vicinity of corners $\left(\frac{DPcorner}{DPtotal}\right)$ |
|---|---|---|
| 12 | E1 | 77% |
| 13 | E2 | Lower than 10%, the designation of development initiation points was difficult |

*Comparison sample

Evaluations of Photographic Property and Development Progressing Property

After applying light exposure to both surfaces of each sample by blue light for 1/10 second, three properties were evaluated as in Example 1. The results obtained are shown in Table 14.

TABLE 14

| Photographic Material | Sensitivity | | |
|---|---|---|---|
| | 8 sec.** | 16 sec.** | 24 sec.** |
| 12 | 155 | 191 | 210 |
| 13* | 48 | 81 | 100 |

*Comparison sample
**The development time.

In the above table, the sensitivity of Comparison sample 13 developed for 24 seconds was defined as 100.

EXAMPLE 12

Preparation of Emulsion E3

In a 4-liter reaction vessel was placed an aqueous gelatin solution (composed of 1,000 ml of water, 7 g of deionized alkali-treated gelatin, 4.5 g of potassium bromide, and 1.2 ml of aqueous 1N-KOH solution, pBr being 1.42) and while keeping the solution at 30° C., 25 ml of an aqueous silver nitrate solution (containing 8.0 g of silver nitrate) and 25 ml of an aqueous potassium bromide solution (containing 5.8 g of potassium bromide) were simultaneously added thereto over a period of one minute (at a flow rate of 25 ml/min.) followed by stirring for 2 minutes, whereby an emulsion of seed crystals was obtained. Then, an aqueous gelatin solution (composed of 650 ml of water, 20 g of deionized alkali-treated gelatin, 3.4 ml of an aqueous 1N-KOH solution, and 0.5 g of potassium bromide) was added to 350 ml of the emulsion of seed crystals, and then the temperature was raised to 75° C. Thereafter, the emulsion formed was ripened for 30 minutes (at pBf of 1.76) and then an aqueous silver nitrate solution (containing 40 g of silver nitrate in 400 ml of water) and an aqueous potassium bromide solution (containing 33 g of potassium bromide in 400 ml of water) were added thereto by a controlled double jet method (CDJ) at a silver potential of +10 mV and a rate of 10 ml/min. over a period of 10 minutes. Then, after stirring the emulsion for 5 minutes, the remaining aqueous silver nitrate solution and aqueous potassium bromide solution were added thereto at a silver potential of +10 mV and at a rate of 15 ml/min. over a period of 20 minutes by CDJ. Thereafter, the emulsion was stirred for 3 minutes, 3 ml of an aqueous solution of 5% $HO(CH_2)_2S(CH_2)_2S(CH_2)_2OH$, and then 282 mg of the sensitizing dye having the following structure was added to the emulsion.

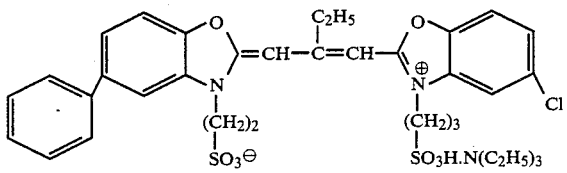

Thereafter, 14 ml of an aqueous 1% potassium iodide solution was added to the emulsion over a period of 20 seconds and after stirring for 3 minutes, the emulsion washed with water and dispersed in water. After adjusting the pAg and pH thereof to 8.25 and 6.7; respectively, 3.5 mg of sodium thiosulfate penta-hydrate, 50 mg of potassium thiocyanate, and 2.3 mg of chloroauric acid were added to the emulsion, and after 5 minutes, the emulsion was quickly cooled to be caked.

The emulsion obtained was composed of silver halide grains having a diameter of mean projected area of 0.55 μm, a standard deviation of 8.7%, a mean thickness of 0.095 μm, and a mean aspect ratio of 5.8.

When the emulsion was coated on a support and the evaluation was performed as in Example 1, the ratio of the development initiation points existing in the vicinity of corners was 90.5%.

EXAMPLE 13

Preparation of Emulsion E4

To 1 liter of water were added 5 g of potassium bromide, 0.05 g of potassium iodide, 35 g of gelatin, and 2.5 ml of an aqueous solution of 5% thioether [$HO(CH_2)_2S(CH_2)_2S(CH_2)_2OH$] and the mixture was kept at 75° C. While stirring the mixture, an aqueous solution of 8.33 g of silver nitrate and an aqueous solution containing 5.94 g of potassium bromide and 0.726 g of potassium iodide were added by a double jet method for a period of 45 seconds. Then, after adding thereto 2.5 g of potassium bromide, an aqueous solution containing 8.33 g of silver nitrate was added thereto over a period of 7 minutes and 30 seconds so that the flow rate at the end of the addition became twice that at the initiation of the addition. Thereafter, an aqueous solution of 53.34 g of silver nitrate and a solution containing potassium bromide and potassium iodide were added thereto by a controlled double jet method while keeping pAg at 8.1 over a period of 15 minutes while accelerating the flow rate. In this case, the consumed amount of potassium iodide was 3.5 g.

Furthermore, an aqueous solution of 100 g of silver nitrate and an aqueous potassium bromide solution were added to the emulsion by a controlled double jet method while keeping pAg at 7.9.

(When the emulsion in this stage was samples and the X-ray diffraction thereof after annealing was determined, the mean silver iodide content was confirmed to be 2.6 mole % from the diffraction angles. Furthermore, when the surface iodine content thereof was determined by an ESCA method without annealing, the content was 0.4 mole %.)

Then, after adding 20 ml of an aqueous solution of 2N potassium thiocyanate to the emulsion, 0.3 mole of fine silver iodide grains having a mean grain diameter of 0.07 μm were added thereto followed by stirring for 10 minutes. Thereafter, the temperature was lowered to 35° C., after removing soluble salts by sedimentation method, the temperature was raised to 40° C., gelatin and phenol were added to the emulsion and pAg and pH thereof were adjusted to 8.40 and 6.55, respectively. After raising the temperature to 60° C., 650 mg of the sensitizing dye having the structure shown below, 12 mg of sodium thiosulfate penta-hydrate, 160 mg of potassium thiocyanate, and 8 mg of chloroauric acid were added to the emulsion. After 10 minutes, the emulsion was quickly cooled, and then pAg thereof was readjusted to 8.8 with potassium bromide.

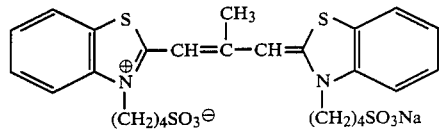

The emulsion obtained was composed of silver halide grains having a diameter of mean projected area of 0.95 μm, a standard deviation of 25%, a mean thickness of 0.153 μm, and a mean aspect ratio of 6.2.

Preparation of Emulsion E5

An aqueous solution of potassium bromide and potassium iodide and an aqueous solution of silver nitrate were added to an aqueous gelatin solution by an ordinary method with stirring vigorously to provide a tabular grain silver iodobromide emulsion (silver iodide content of 4 mole %) containing tabular silver halide grains having a diameter of mean projected area of 1 μm, a mean thickness of 0.33 μm, and a mean aspect ratio of 3.0.

Soluble salts were removed therefrom by a sedimentation method, gelatin was dispersed thereon and chemical sensitization by chloroauric acid and sodium thiosulfate was applied thereto. Then, 360 mg of the sensitizing dye as used for Emulsion E4 was added thereto per mole of silver to provide Emulsion E5. (When the sensitizing dye was added thereto in an amount of 650 mg as in Emulsion E4, the emulsion was greatly desensitized and the optimum sensitivity was obtained in an amount of 360 mg.)

Preparation of Photographic Materials

Each of Photographic materials was prepared by forming successively the layers having the composition shown below on a triacetyl cellulose film support.

| | |
|---|---|
| Emulsion Layer | |
| Silver halide emulsion | 5.5 g/m$^2$ as silver |
| Gelatin (binder) | 1.6 g/l g-Ag |
| 4-Hydroxy-6-methyl-1,3,3a,7-tetraazaindene | 8.0 mg/m$^2$ |
| $C_{18}H_{35}O(CH_2CH_2)_{20}H$ | 5.8 mg/l g-Ag |
| Sodium dodecylbenzenesulfonate (Coating aid) | 0.1 mg/m$^2$ |
| Potassium poly-p-styrenesulfonate (Coating aid) | 1 mg/m$^2$ |
| Surface Protective Layer | |
| Gelatin (binder) | 0.7 g/m$^2$ |
| N-Oleyl-N-methyltaurine sodium salt (Coating aid) | 0.2 mg/m$^2$ |
| Polymethyl methacrylate fine particles (mean particle size 3 μm) (Matting agent) | 0.13 mg/m$^2$ |

Evaluation of Development Initiation Points

Each photographic material was stored for 7 days, after coating under the conditions of 25° C. and 65% RH, developed by the developer having the following composition for 30 seconds at 20° C., and after immediately stopping the development by an aqueous acetic acid solution, the development initiation points were determined as in Example 1.

| Developer | |
|---|---|
| Metal | 2 g |
| Sodium sulfite | 100 g |
| Hydroquinone | 5 g |
| Borax $10H_2O$ | 2 g |
| Water to make | 1.0 liter |

The results obtained are shown in Table 15.

TABLE 15

| Photographic Material | Emulsion | Ratio of development initiation points existing in the vicinity of corners |
|---|---|---|
| 14 | E4 | 77% |
| 15* | E5 | Less than 10% |

*Comparison sample

Evaluations of Photographic Property and Graininess

After storing the samples for 7 days after coating under the conditions of 25° C. and 65%, each sample was developed in the developer described above for 7 minutes at 20° C., fixed by the fix solution shown below, washed and dried. Then, the photographic performance and the graininess were determined.

Fix Solution

Fuji Fix (trade name, made by Fuji Photo Film Co., Ltd.) was used.

The evaluation of the photographic performance was performed by light exposure of 1/100 second using white light.

The graininess was evaluated by RMS graininess (at the portion of optical density of 0.8) measured by an aperture diameter of 48 μm. The RMS graininess is described in T. H. James, *The Theory of the Photographic Process*, pages 610–620, published by Macmillan (1977).

The results obtained are shown in Table 16.

TABLE 16

| Photographic Material | Sensitivity at a density of fog + 0.8 | RMS |
|---|---|---|
| 14 | 151 | 0.027 |
| 15* | 100 (standard) | 0.032 |

*Comparison sample

As is clear from the results shown in Table 16 above, photographic material 14 of this invention has a sensitivity of 1.5 times higher than that of photographic material 15 and shows good RMS value, which shows that the relation between the sensitivity and graininess is greatly improved by the present invention.

EXAMPLE 13

Preparation of Emulsion E6

To an aqueous 1.5 wt % inert gelatin solution containing 6 g of potassium bromide, 0.3 g of potassium iodide, and 20 ml of a solution of 0.5 wt % thioether $[HO(CH_2)_2S(CH_2)_2S(CH_2)_2OH]$ were simultaneously added an aqueous solution of 0.1M silver nitrate and an aqueous solution of 1.0M of potassium bromide and potassium iodide (99:1 by mole ratio) in an amount of 50 ml for 45 seconds. During the addition, the solution was kept at 35° C.

Then, the temperature was raised to 53° C. and after adjusting the silver potential thereof to −20 mV with silver nitrate, 500 ml of an aqueous solution of 1.75M of silver nitrate was added thereto while accelerating the flow rate (the flow rate at the end of the addition was 20 times that at the initiation of the addition) over a period of 50 minutes. During the addition thereof, an aqueous 1.75M potassium bromide solution was added thereto for keeping the potential at −20 mV. Thereafter, 50 ml of an aqueous solution of 0.5 wt % thioether $[HO(CH_2)_2S(CH_2)_2S(CH_2)_2OH]$ was added thereto and further 100 ml of an aqueous 0.06M potassium iodide solution was added to the emulsion over a period of one minute. Thereafter, the emulsion was cooled to 35° C., washed by ordinary flucculation method, and after dispersing therein 90 g of gelatin at 40° C., pH and pAg thereof were adjusted to 6.5 and 8.5, respectively. Furthermore, the temperature was raised to 56° C. and 800 mg/mole-Ag of a spectral sensitizing dye, anhydro-5,5'-dichloro-9-ethyl-3,3'-di(3-sulfopropyl)oxacarbocyanine hydroxasodium salt was added to the emulsion followed by ripening for 10 minutes.

Thereafter, after adding thereto 8 mg/mole-Ag of chloroauric acid, 130 mg/mole-Ag of sodium thiocyanate, and 8 mg/mole-Ag of sodium thiosulfate pentahydrate, the emulsion was ripened for 30 minutes.

The emulsion obtained was composed of monodispersed tabular silver halide grains having a diameter of mean projected area (corresponding to circle) of 0.55 μm, a standard deviation of 9.5%, and a mean thickness of 0.08 μm.

Preparation of Coating Composition

The emulsion thus obtained was fused at 40° C. and 4-hydroxy-6-methyl-1,3,3a,7-tetraazaindene as antifoggant and polypotassium p-vinylbenzenesulfonate as tackifier were added thereto to provide a coating composition for emulsion layer.

Preparation of Coating Composition for Surface Protective Layer

A coating composition containing gelatin, a tackifier (polypotassium p-vinylbenzenesulfonate), a matting agent (polymethyl methacrylate fine particles; particle size of 3.0 μm), a hardening agent (1,2-bis(sulfonylacetamido)ethane), a coating aid (sodium t-octylphenoxyethoxyethanesulfonate), a lubricant (fluid paraffin), and an antistatic agent ($C_{16}H_{33}O(CH_2—CH_2O)_{10}H$) was prepared.

Preparation of Photographic Material

The coating composition for emulsion layer and the coating composition for surface protective layer were simultaneously coated on a polyethylene terephthalate film support having 100 μm in thickness colored in blue by extrusion. The thickness of the surface protective layer and the emulsion layer were 1 μm and 3 μm, respectively and the coated silver amount of 2.0 g/m$^2$.

Evaluation of Photographic Performance and Graininess

After exposing the sample thus prepared by green light, the sample was developed by a developer having the composition shown below, fixed, washed, and dried. Thereafter, the sensitivity, fog and the graininess were measured. The results obtained are shown in Table 17 below.

The RMS value showing the graininess was measured by an aperture of 48×48 μm at a density of 10.

| Developer | |
|---|---|
| 1-Phenyl-3-pyrazolidone | 0.5 g |
| Hydroquinone | 10.0 g |
| Ethylenediaminetetraacetic acid di-sodium | 2.0 g |
| Potassium sulfite | 60.0 g |
| Boric acid | 4.0 g |
| Potassium carbonate | 20.0 g |
| Sodium bromide | 5.0 g |
| Diethylene glycol | 30.0 g |
| Water to make | 1 liter |
| pH adjusted by sodium hydroxide to | 10.0 |

TABLE 17

| Development Condition | (D = 1.0) Sensitivity | Fog | ($D_{0.25-1.25}$) Gamma** | (D = 1.0) RMS value |
|---|---|---|---|---|
| 20° C., 1 min. | 100 | 0.01 | 1.65 | 0.015 |
| 20° C., 2 min. | 110 | 0.01 | 1.65 | 0.017 |
| 26° C., 1 min. | 115 | 0.01 | 1.65 | 0.017 |
| 26° C., 2 min. | 125 | 0.01 | 1.65 | 0.018 |

*Relative value, taking the sensitivity obtained under the development condition of 20° C. for 1 min. as being 100.
**Mean contrast of the density Fog +0.25 and the density Fog +1.25.

As shown in the above table, it can be seen that in the case of using the emulsion of this invention, variations of sensitivity, fog, and gamma to the change in processing time and processing temperature are very less and also the RMS value is good.

Also, each of the sample thus prepared and commercially available X-ray cine-film was photographed and the evaluation of image quality was performed by magnifying 20 times through a viewer, the sample of this invention showed very fine graininess and fine blood vessels could be clearly shown.

In addition, when the development initiation points were determined on the emulsion in the development of 10 seconds at 20° C., the ratio of the development initiation points existing in the vicinity of the corners of the silver halide grains was 93%.

EXAMPLE 14

Preparation of Emulsion E7

As the case of preparing Emulsion E1, silver halide grains were formed and soluble salts were removed by a sedimentation method. After raising the temperature to 40° C., 68 g of gelatin, 2 g of phenol, and 7.5 g of trimethylolpropane were added to the emulsion and pH and pAg thereof were adjusted to 6.45 and 8.20, respectively by sodium hydroxide and potassium bromide. The emulsion in a state of being not chemically sensitized (without adding a sensitizing dye) was defined to a finished state of Emulsion E7.

Preparation of Coating Composition

The coating composition for emulsion layer was prepared by fusing Emulsion E7 at 38° C. and the following chemicals were added thereto per mole of silver halide.

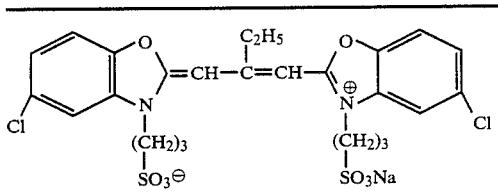

735 mg

| | |
|---|---|
| Sodium thiosulfate penta-hydrate | 8.2 mg |
| Potassium thiocyanate | 163 mg |
| Chloroauric acid | 5.4 mg |
| 4-Hydroxy-6-methyl-1,3,3a,7-tetra-azaindene | 1.94 g |
| 2,6-Bis(hydroxyamino)-4-diethylamino-1,3,5-triazine | 80 mg |
| Sodium polyacrylate (mean molecular weight 41,000) | 4.0 g |

Preparation of Photographic Material

The aforesaid coating composition was simultaneous coated with a coating composition for surface protective layer in Example 1 on one surface of a polyethylene terephthalate film support by an extrusion method and dried.

In this case, the coated amount of silver, the coated amount of the surface protective layer, the amount of the hardening agent, etc., were same as in Example 1.

Evaluation of Photographic Material

When the development initiation points existing in the vicinity of the corners of silver halide grains were determined by the method shown in Example 1, the rate was 86%.

Also, it was confirmed that the sample had almost same sensitivity and development progressing property as Sample 1.

EXAMPLE 15

Using Emulsions H and J in Example 3, an emulsion layer and a protective layer were formed on a triacetyl cellulose film support as shown in Table 18 to provide Samples 15 and 16.

TABLE 18

| | Sample 15 | Sample 16 |
|---|---|---|
| Emulsion Layer: | | |
| Emulsion | Emulsion H<br>Ag 0.85 g/m$^2$ | Emulsion J<br>" |
| Coupler | Magenta-11<br>0.4 | "<br>" |
| Oil-1 | 0.2 | " |
| Additive* | 0.005 g/m$^2$ per mole of silver | " |
| Gelatin | 2.0 g/m$^2$ | " |
| Protective Layer: | | |
| Gelatin | 1.0 g/m$^2$ | " |

*Additive: 1-(3-Methylcarbamoylaminophenyl)-2-mercaptotetrazole

For the protective layer, 2,4-dichlorotriazine-6-hydroxy-s-triazine sodium salt was used as a hardening agent and the layer was coated using sodium dodecylbenzenesulfonate as a coating aid.

After exposing the samples for 1/100 sec. or $10^{-4}$ sec., each sample was processed by the following steps at 38° C. using the processing solutions shown in Example 5 above.

| | | |
|---|---|---|
| 1. | Color Development | 3 min. 15 sec. |
| 2. | Bleach | 6 min. 30 sec. |
| 3. | Wash | 3 min. 15 sec. |
| 4. | Fix | 6 min. 30 sec. |
| 5. | Wash | 3 min. 15 sec. |
| 6. | Stabilization | 3 min. 15 sec. |

The sensitivity of the samples thus processed was measured and the results obtained are shown in Table 19.

In this case, the sensitivity was shown by the relative value of the reciprocal of an exposure amount necessary for giving an optical density of fog+0.2.

TABLE 19

| | | | | Photographic Sensitivity | |
|---|---|---|---|---|---|
| Sample | Emulsion | Ratio** | Fog | Exposure of 1/100 sec. | Exposure of $10^{-4}$ sec. |
| 15 | H | 10% | 0.18 | 100 | 70 |
| 16* | J | 92% | 0.14 | 132 | 118 |

*Comparison sample
**The ratio by number of CDG and EDG to the whole grains.

The ratio of CDG and EDG was obtained as follows.

Each sample was exposed for 1/100 second using ND filter having a density of about 1.5 and developed using the aforesaid color developer diluted twice the original concentration for about 10 seconds. Immediately after the initiation of development, the development was stopped using an aqueous solution of 5% glacial acetic acid. Then, the development initiation points were observed by electron microphotographs. (Similar to FIGS. 7 and 8)

From the results shown above, it can be seen that the effect of this invention is also obtained about tabular grain silver halide emulsions and by using the emulsion for light-sensitive layers of multilayer structure, in particular for high-speed light-sensitive emulsion layers, the objects of this invention can be attained.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing silver halide grains dispersed in a dispersion medium, wherein said silver halide grains have (111) faces and at least 50% (by projected area) of the silver halide grains having (111) faces are (a) silver halide grains controlled so that the development thereof is initiated at the corners or in the vicinity of the corners of the grains, and/or (b) silver halide grains controlled so that the development thereof is initiated at the edges or in the vicinity of the edges of the grains, and said silver halide grains are substantially normal crystal grains or tabular grains having no epitaxial junction in form.

2. The silver halide photographic emulsion as claimed in claim 1, wherein the emulsion contains corner development type grains (a) and/or edge development type silver halide grains (b) prepared by adding thereto a CR-compound selected from the compounds shown by formulae (I) to (V) and nucleic acids before or during the chemical sensitization thereof:

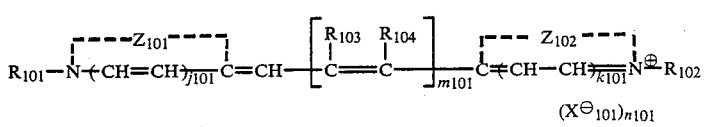

(I)

wherein $Z_{101}$ and $Z_{102}$ each represents an atomic group necessary for forming a heterocyclic nucleus; $R_{101}$ and $R_{102}$ each represents an alkyl group, an alkenyl group, an alkinyl group or an aralkyl group; $m_{101}$ represents 1, 2 or 3; when $m_{101}$ is 1, $R_{103}$ represents a hydrogen atom, a lower alkyl group, an aralkyl group, or an aryl group and $R_{104}$ represents a hydrogen atom; when $m_{101}$ is 2 or 3, $R_{103}$ represents a hydrogen atom, $R_{104}$ represents a hydrogen atom, a lower alkyl group, or an aralkyl group, or $R_{104}$ combines with $R_{102}$ to form a 5-membered or 6-membered ring, or $R_{103}$ combines with the other $R_{103}$ to form a hydrocarbon ring or a heterocyclic ring, provided that $R_{104}$ is a hydrogen atom; $j_{101}$ and $k_{101}$ each represents 0 or 1; $X^{\ominus}_{101}$ represents an acid anion; and $n_{101}$ represents 0 or 1;

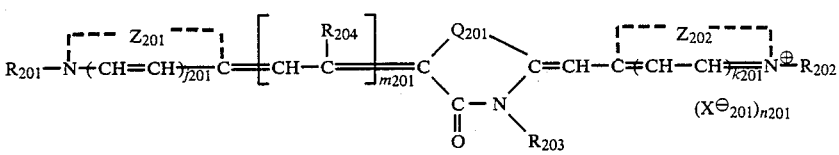

(II)

wherein $Z_{201}$ and $Z_{202}$ have the same significance as $Z_{101}$ and $Z_{102}$, $R_{201}$ and $R_{202}$ have the same significance as $R_{101}$ and $R_{102}$; $R_{203}$ represents an alkyl group, an alkenyl group, an alkinyl group or an aryl group; $m_{201}$ represents 0, 1, or 2; $R_{204}$ represents a hydrogen atom, a lower alkyl group, or an aryl group, and when $m_{201}$ represents 2, $R_{204}$ and the other $R_{204}$ may combine with each other to form a hydrocarbon ring or a heterocyclic ring; $Q_{201}$ represents a sulfur atom, an oxygen atom, a selenium atom or

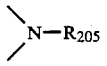

wherein $R_{205}$ has the same significance as $R_{203}$, and $j_{201}$, $k_{201}$, $X^{\ominus}_{201}$ and $n_{201}$ have the same significance as $j_{101}$, $k_{101}$, $X^{\ominus}_{101}$, and $n_{101}$, respectively;

(III)

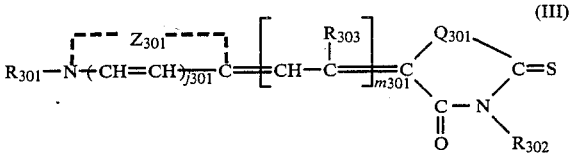

wherein $Z_{301}$ represents an atomic group necessary for forming a heterocyclic group; $Q_{301}$ has the same significance as $Q_{201}$, $R_{301}$ has the same significance as $R_{101}$ or $R_{102}$, and $R_{302}$ has the same significance as $R_{203}$; $m_{301}$ has the same significance as $m_{201}$; $R_{303}$ has the same significance as $R_{204}$ and further when $m_{301}$ is 2 or 3, said plural $R_{303}$ may be combined with each other to form a hydrocarbon ring or a heterocyclic group; and $j_{301}$ has the same significance as $j_{101}$;

(IV)

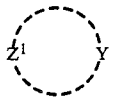

wherein Y represents a sulfur atom or an oxygen atom, and $Z^1$ represents an atomic group necessary for forming a saturated or unsaturated heterocyclic ring with a sulfur atom or an oxygen atom; and $$R_1—S—(X)_m—Y'—R_2 \quad (V)$$

wherein X represents an alkylene group, an arylene group, an alkenylene group, $—SO_2—$, —SO—, —O—, —S—,

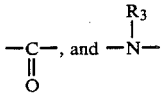

or a combination thereof, wherein $R_3$ represents a hydrogen atom, an alkyl group, or an aryl group; m represents 0 or 1; $R_1$ represents a hydrogen atom, an alkali metal, an alkaline earth metal, an alkyl group, an aryl group, or a heterocyclic group; $R_2$ represents a hydroxy group, an alkyl group, an aryl group, a heterocyclic group, an amino group, an alkoxy group, or an aryloxy group; and Y' represents —CO— or $—SO_2—$.

3. The silver halide photographic emulsion as claimed in claim 2, wherein the silver halide grains are chemically sensitized after adsorbing thereto a CR-compound shown by formula (I).

4. The silver halide photographic emulsion as claimed in claim 3, wherein the silver halide grains are chemically sensitized after adsorbing thereto a CR-compound of formula (I) in an amount of at least 50% of the saturated adsorption amount.

5. The silver halide photographic emulsion as claimed in claim 2, wherein the silver halide grains are chemically sensitized after adsorbing thereto a CR-compound shown by said formula (I) and at least one of a CR-compound shown by formula (VI) or (VII) on the surfaces of the grains:

(VI)

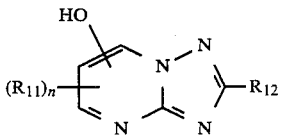

(VII)

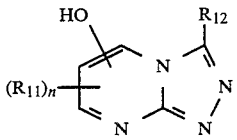

wherein $R_{11}$ and $R_{12}$, which may be the same or different, each represents a hydrogen atom, an aliphatic residue, or an aromatic residue, and n represents 1 or 2.

6. The silver halide photographic emulsion as claimed in claim 1 wherein the silver halide grains in the emulsion are silver halide grains selected from silver bromide, silver chlorobromide, or silver chloride, having a mean silver iodide content of not more than 4 mole % and are composed of normal crystal grains, or tabular grains having an aspect ratio of from 2 to 10 and having no epitaxial junction in form, each having (111) faces.

7. The silver halide photographic emulsion as claimed in claim 1, wherein the silver halide grains in the emulsion have a mean silver chloride content of at least 70 mole % and are composed of substantially normal crystal grains, or tabular grains having an aspect ratio of from 2 to 10 and having no epitaxial junction in form, each having (111) faces.

8. The silver halide photographic emulsion as claimed in claim 1, wherein the silver halide grains existing in the emulsion are tabular grains having no epitaxial junction in form and having (111) faces, in which at least 70% (by projected area) of the silver halide grains having (111) faces are corner development type grains (a) and edge development type grains (b), at least 10% (by projected area) of which are corner development type grains (a).

9. The silver halide photographic emulsion as claimed in claim 1, wherein the emulsion contains corner development type grains (a) and/or edge development type silver halide grains (b) obtained by applying halogen conversion to the surface of the grains after adsorbing a CR-compound selected from the compounds shown by formulae (I) to (V) and nucleic acids to the surface of the mother grains having (111) faces and then applying chemical sensitization to them:

(I)

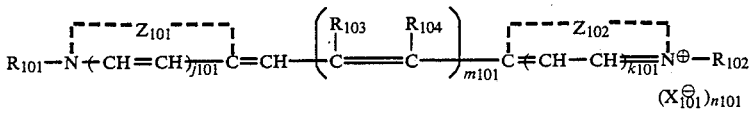

wherein $Z_{101}$ and $Z_{102}$ each represents an atomic group necessary for forming a heterocyclic nucleus; $R_{101}$ and $R_{102}$ each represents an alkyl group, an alkenyl group, an alkinyl group or an aralkyl group; $m_{101}$ represents 1,2 or 3; when $m_{101}$ is 1, $R_{103}$ represents a hydrogen atom, a lower alkyl group, an aralkyl group, or an aryl group and $R_{104}$ represents a hydrogen atom; when $m_{101}$ is 2 or 3, $R_{103}$ represents a hydrogen atom and $R_{104}$ represents a hydrogen atom, a lower alkyl group, or an aralkyl group, or $R_{104}$ combines with $R_{102}$ to form a 5-membered or 6-membered ring, or $R_{103}$ combines with the other $R_{103}$ to form a hydrocarbon ring or a heterocyclic ring, provided that $R_{104}$ is a hydrogen atom; $j_{101}$ and $k_{101}$ each represents 0 or 1; $X^{\ominus}_{101}$ represents an acid anion; and $n_{101}$ represents 0 or 1;

(II)

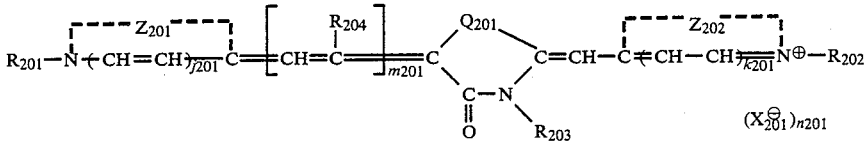

wherein $Z_{201}$ and $Z_{202}$ have the same significance as $Z_{101}$ and $Z_{102}$, $R_{201}$ and $R_{202}$ have the same significance as $R_{101}$ and $R_{102}$; $R_{203}$ represents an alkyl group, an alkenyl group, an alkinyl group or an aryl group; $m_{201}$ represents 0, 1, or 2; $R_{204}$ represents a hydrogen atom, a lower alkyl group, or an aryl group, and when $m_{201}$ represents 2, $R_{204}$ and the other $R_{204}$ may combine with each other to form a hydrocarbon ring or a heterocyclic ring; $Q_{201}$ represents a sulfur atom, an oxygen atom, a selenium atom or

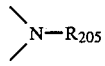

wherein $R_{205}$ has the same significance as $R_{203}$, and $j_{201}$, $k_{201}$, $X^{\ominus}_{201}$ and $n_{201}$ have the same significance as $j_{101}$, $k_{101}$, $X^{\ominus}_{101}$, and $n_{101}$, respectively;

(III)

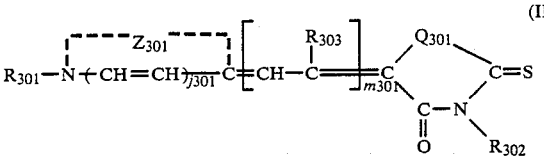

wherein $Z_{301}$ represents an atomic group necessary for forming a heterocyclic group; $Q_{301}$ has the same significance as $Q_{201}$, $R_{301}$ has the same significance as $R_{101}$ or $R_{102}$, and $R_{302}$ has the same significance as $R_{203}$; $m_{301}$ has the same significance as $m_{201}$; $R_{303}$ has the same significance as $R_{204}$ and further when $m_{301}$ is 2 or 3, said plural $R_{303}$ may be combined with each other to form a hydrocarbon ring or a heterocyclic group; and $j_{301}$ has the same significance as $j_{101}$;

(IV)

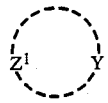

wherein Y represents a sulfur atom or an oxygen atom, and $Z^1$ represents an atomic group necessary for forming a saturated or unsaturated heterocyclic ring with a sulfur atom or an oxygen atom; and $$R_1-S-(X)_m-Y'-R_2 \quad (V)$$

wherein X represents an alkylene group, an arylene group, an alkenylene group, $-SO_2-$, $-SO-$, $-O-$, $-S-$,

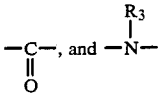

or a combination thereof, wherein $R_3$ represents a hydrogen atom, an alkyl group, or an aryl group; m represents 0 or 1; $R_1$ represents a hydrogen atom, an alkali metal, an alkaline earth metal, an alkyl group, an aryl group, or a heterocyclic group; $R_2$ represents a hydroxy group, an alkyl group, an aryl group, a heterocyclic group, an amino group, an alkoxy group, or an aryloxy group; and Y' represents —CO— or $-SO_2-$.

10. The silver halide photographic emulsion as claimed in claim 1, wherein said silver halide grains are normal crystal grains or tabular grains having no epitaxial junction in form each having (111) faces and at least 50% (by projected area) of the silver halide grains contributing to the image formation at the density of from [maximum density − minimum density] × $\frac{3}{4}$ to [maximum density + 0.2] in the characteristic curve obtained by coating the emulsion on a support and developing the emulsion layer are silver halide grains (a) and/or silver halide grains (b).

11. The silver halide photographic emulsion as claimed in claim 1, which contains at least 500 mg of a sensitizing dye per mole of silver halide.

12. The silver halide photographic emulsion as claimed in claim 1, wherein said silver halide grains having (111) faces are tabular grains having no epitaxial junction in form and having an iodine content higher in the surface portion thereof than the mean iodine content in the grain.

13. The silver halide photographic emulsion as claimed in claim 1, wherein said silver halide grains having (111) faces are tabular grains having no epitaxial junction in form the surfaces of which are subjected to halogen conversion.

14. A process for producing a silver halide photographic emulsion as claimed in claim 1, which comprises chemically sensitizing silver halide grains having (111) faces in the presence of at least 500 mg of a sensitizing dye per mole of silver halide.

15. The process as claimed in claim 14, wherein halogen conversion is carried out after formation of silver halide grains having (111) faces is substantially completed.

16. The process as claimed in claim 15, wherein the silver halide grains prior to the halogen conversion have an iodine content of not more than 1 mole % at the surface thereof.

17. The process as claimed in claim 16, wherein said iodine content is not more than 0.3 mole %.

18. The process as claimed in claim 15, wherein the amount of halogen used in the halogen conversion ranges from 0.2 to 0.6 mole % based on silver in the emulsion before the conversion.

19. The process as claimed in claim 15, wherein a thioether compound is present during the halogen conversion.

20. The process as claimed in claim 15, wherein a thiocyanate compound is present during the halogen conversion.

21. The process as claimed in claim 14, wherein 4-hydroxy-6-substituted (1,3,3a,7)tetrazaindene is present with the sensitizing dye.

* * * * *